US010962341B2

(12) United States Patent
Feda et al.

(10) Patent No.: US 10,962,341 B2
(45) Date of Patent: Mar. 30, 2021

(54) FUZE SETTING SYSTEMS AND TECHNIQUES

(71) Applicant: BAE Systems Information and Electronic Systems Integration Inc., Nashua, NH (US)

(72) Inventors: Francis M. Feda, Sudbury, MA (US); John R. Franzini, Hollis, NH (US); Gregory S. Notaro, Bedford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/605,450

(22) PCT Filed: Jan. 23, 2019

(86) PCT No.: PCT/US2019/014682
§ 371 (c)(1),
(2) Date: Oct. 15, 2019

(87) PCT Pub. No.: WO2019/147620
PCT Pub. Date: Aug. 1, 2019

(65) Prior Publication Data

US 2020/0393229 A1 Dec. 17, 2020

Related U.S. Application Data

(60) Provisional application No. 62/621,085, filed on Jan. 24, 2018.

(51) Int. Cl.
*F24C 11/00* (2006.01)
*F42C 11/00* (2006.01)
(Continued)

(52) U.S. Cl.
CPC ..... *F42C 11/002* (2013.01); *F42C 17/04* (2013.01); *F42C 19/02* (2013.01); *F42B 10/64* (2013.01)

(58) Field of Classification Search
CPC ..... F42C 11/002; F42C 17/04; F42C 19/02; F24B 10/64
(Continued)

(56) References Cited

U.S. PATENT DOCUMENTS

2007/0246797 A1* 10/2007 Pharn ..... H01L 23/544 257/529
2010/0058946 A1* 3/2010 Geswender ..... F42C 19/02 102/206
(Continued)

OTHER PUBLICATIONS

International Search Report, PCT/US19/14682, 9 pages, dated Jun. 25, 2019.
(Continued)

*Primary Examiner* — Samir Abdosh
(74) *Attorney, Agent, or Firm* — Scott J. Asmus; Sand, Sebolt & Wernow LPA

(57) ABSTRACT

Techniques and architecture are disclosed for a system that includes a fuze at a leading end of a projectile body and a fuze setter configured to engage the fuze and to program the same prior to launch. The system, in one example, includes a plurality of electrical contact pads on an exterior surface of a fuze radome housing and a plurality of electrical contact pins on the fuze setter. The electrical contact pads are arranged in a rotationally symmetric pattern that enables an electrical interface to be formed with the electrical contact pins, regardless of the rotational orientation of the fuze. Commutation is performed to rotate signals to the electrical contact pins instead of requiring that the fuze be physically rotated to bring the electrical contact pads into alignment with the electrical contact pins.

20 Claims, 29 Drawing Sheets

(51) Int. Cl.
*F42C 17/04* (2006.01)
*F42C 19/02* (2006.01)
*F42B 10/64* (2006.01)

(58) Field of Classification Search
USPC ..... 89/6
See application file for complete search history.

(56) References Cited

U.S. PATENT DOCUMENTS

2014/0160944 A1* 6/2014 Venkatesan ..... H04L 1/24
370/249
2016/0341532 A1* 11/2016 Owen ..... H04B 5/0031

OTHER PUBLICATIONS

Fuze Setter Adapter Systems and Techniques, PCT Application PCT/US19/26545, filed Apr. 9, 2019.
Fuze Setter Interface for Powering and Programming a Fuze on a Guided Projectile, U.S. Appl. No. 16/294,505, filed Mar. 6, 2019.

* cited by examiner

FUZE SETTING SYSTEMS AND TECHNIQUES

CROSS REFERENCE TO RELATED APPLICATIONS

This application is a US371 of PCT/US19/14682 filed Jan. 23, 2019 and claims the benefit of U.S. Provisional Application Ser. No. 62/621,085, filed on Jan. 24, 2018; the entire disclosure of which is incorporated herein by reference.

TECHNICAL FIELD

The following disclosure relates generally to fuze setters and in particular to direct contact fuze setters.

BACKGROUND

Background Information

Artillery fuzes are typically attached to a leading end of an artillery projectile prior to launch from a gun platform. Next generation artillery fuzes provide guidance capability that may correct for firing errors and steer the projectile to a desired target impact point. The artillery projectile with attached fuze may be loaded into the gun either manually or through use of an automatic loader (autoloader) mechanism.

Fuze setting is the process of quickly programming targeting and other data into artillery fuzes such as those with precision guidance capability. Fuze setting has to occur prior to launch and is typically accomplished by engaging the fuze with a fuze setter. The fuze setter may be part of an autoloader system used to automatically load artillery projectiles into a gun platform while minimizing the need for operator intervention.

In direct connect fuze setters, the fuze setter typically utilizes an electrical interface with a direct electrical connection between a connector on the fuze and a mating connector on the fuze setter. The fuze is attached to the end of the projectile and the fuze setter is attached to the fuze to permit fuze setting. When the fuze setter is attached to the fuze, the fuze setter connector may generally be misaligned to the fuze. The fuze setter electrical interface may be part of an autoloader, or it may be part of stand-alone fuze setting equipment when an autoloader is not used. Initially, the fuze electrical contacts may be misaligned to the corresponding contacts on the fuze setter. This rotational misalignment may create difficulties during fuze setting since the fuze connector must be rotationally aligned to the mating fuze setter connector in order to establish an electrical connection.

To overcome this rotational misalignment problem, an autoloader may need to incorporate a rotational alignment capability. This adds complexity into the design and operation of autoloaders that incorporate fuze setting capability. The added complexity may decrease the reliability of the autoloader and may also increase the cost of the device. Additionally, the need to rotationally align the fuze connector to the fuze setter connector may increase the overall timeline required for fuze setting because the time required for alignment must be added. This increase in the overall timeline due to rotational alignment problems may result in a reduction of the maximum rate of fire of the gun platform.

SUMMARY

There is therefore a need in the art for some way to ensure that the electrical connector on a fuze is able to mate to an electrical connector on a fuze setter without physically rotating the fuze or projectile relative to the fuze setter. The apparatus and method disclosed herein are directed to implementing a mechanical and electrical interface between a fuze and a fuze setter that does not require physical rotational alignment of the fuze to the fuze setter.

The present disclosure relates to a system for programming a fuze on an artillery projectile utilizing a fuze setter. There are two interfaces between the fuze and fuze setter to accomplish programming. The first interface is a mechanical interface and the second interface is an electrical interface. In the mechanical interface, a radome on the fuze is received in a port of the fuze setter. The radome is a housing that forms the tip of the fuze and is used to cover and protect components within the fuze while having an exterior form factor of a suitable aerodynamic shape. The radome housing may be transparent to radar emissions from a Height of Burst (HoB) sensor that may be located within the fuze and covered by the radome housing.

In one example, a fuze setter station (also known as a fuze setter cup) is mounted on an articulated mechanism such as a swing arm that may be provided on an autoloader. The swing arm swings into a position where the cup fits over at least a portion of the radome housing. Once programming has occurred, the swing arm moves the cup away from the radome housing. In this arrangement, the cup of the fuze setter tightly couples to the radome housing when in place. In another example, a programming block is moved toward a sidewall of the radome housing to bring electrical contacts, such as electrical contact pins, into engagement with electrical contact pads on the radome housing. The electrical contacts, such as the electrical contact pins, may be suitable for transfer of electrical power and/or communication of electrical signals from the fuze setter to the fuze.

In one example, in the electrical interface between fuze setter and fuze there are eight electrical signals required, namely, two loopback resistor signals, two power/ground signals, two Time Mark Indicator (TMI) signals, and two communications signals. The loopback resistor signals are utilized to detect a resistor within the fuze and the loopback resistor signals may therefore be used by a fuze setter to determine if it is connected to a fuze. The loopback resistor signals are also used to help determine rotational orientation of the fuze. The power/ground signals include one contact for input power and one for ground return current. The TMI signals provide Ground Positioning Satellite (GPS) time mark indication to the fuze. The two interface signals are a half-duplex serial communication interface. Half-duplex communication means that only one of the fuze and the fuze setter sends data at a time while the other of the fuze and the fuze setter listens. Half duplex is consistent with the messaging protocol between fuze setter and fuze and may require a reduced electrical contact pin count. In one example, data rates of 10 Mbit/sec are supported by system of the present disclosure.

In one example, in the electrical interface between fuze setter and fuze there are additional interface signals that are utilized to implement full-duplex communications, allowing simultaneous, bi-directional communication between the fuze setter and the fuze. In one example there are ten electrical signals, namely, two loopback resistor signals, two power/ground signals, two TMI signals, and four communications signals. The four communications signals enable the full-duplex serial communication between fuze and fuze setter. In other words, the fuze and the fuze setter can send data and listen at substantially the same time.

The TMI electrical contact pads are used for GPS time synchronization. If the fuze does not need to synchronize to the GPS clock, these TMI electrical contact pads can either be removed or used for some other purpose.

As indicated above, in order to form the electrical interface between the fuze and fuze setter, the electrical contact pads on the fuze make electrical contact with electrical contact pins on the fuze setter. In one example there may be eight electrical contact pads and in another example there may be ten electrical contact pads provided on the radome housing. It will be understood that any desired number of electrical contact pads may be utilized. The references herein to eight electrical contact pads or ten electrical contact pads are by way of example only and shouldn't be considered to be unnecessarily narrowing or limiting the number of electrical contact pads that are used on the fuze. In some examples, the electrical contact pads are located on a sidewall of the radome housing. In other examples, the electrical contact pads are located on the flat front end of the radome housing, i.e., on the nose end of the fuze. In other examples, some electrical contact pads may be located on the sidewall and others may be positioned on the front end of the radome. Regardless of the number and/or placement of the electrical contact pads, the electrical contact pads are arranged so as to be rotationally symmetrical. In other words, no matter the physical orientation in which the fuze is located relative to the fuze setter, an electrical interface is formed and communication is able to occur between the electrical contact pads on the fuze and the electrical contact pins on the fuze setter. Furthermore, the electrical contact pads may be of any desired shape and may be arranged as circular rings, segmented rings, or as discrete spaced-apart pads.

Depending on the placement and configuration of the electrical contact pads on the radome housing, the mechanical interface with the fuze setter may be formed by a nose approach, a side approach, or a clamshell approach of the fuze setter on the fuze. In a nose approach, the front end of the fuze is moved into a port of the fuze setter or a fuze setter cup is moved into place over the front end of the radome housing. In a side approach, a programming block may be moved into engagement with electrical contact pads on a sidewall of the radome housing. In a clamshell approach, two or more opposed programming blocks may be moved inwardly and receive a portion of the fuze between them. These different approaches have pros and cons, that will be described later herein.

With respect to forming the electrical interface between fuze setter and fuze, there are two approaches disclosed herein that may accomplish the formation of the electrical interface without the need to rotationally orient the fuze radome housing relative to the fuze setter. The first approach is commutation and the second approach is direct contact.

In the commutation approach, each electrical contact pad on the fuze is assigned to a specific signal. Each electrical contact pad engages a corresponding electrical contact pin on the fuze setter that is unassigned to a signal. Using a scanning technique to identify the rotational orientation between the fuze and the fuze setter, a switching/commutation technique is then used to dynamically assign signals to the fuze setter electrical contact pins. The fuze setter interrogates pairs of electrical contact pins engaged with electrical contact pads on the radome housing to locate a loopback resistor. Locating the loopback resistor aids in identifying the fuze rotational orientation. Electrical commutation is performed by the fuze setter to reassign signals on the fuze setter electrical contact pins to match the determined fuze rotational orientation.

In the direct contact approach, each electrical contact pad or contact band on the fuze radome housing is assigned a specific signal, one pad, or band being required per signal. Segmented rings or bands on the fuze radome housing may be utilized to reduce inductive/antenna effects and these require one electrical contact per segment. Each electrical contact pad or band on the radome housing engages a corresponding fuze setter electrical contact pin dedicated to a specific signal. There is a direct 1-for-1 electrical connection between the fuze contact bands and the corresponding fuze setter electrical contact pins.

The present disclosure provides rotationally symmetric electrical contact pads on the exterior surface of a radome housing that can be engaged by electrical contacts on the fuze setter. Since the initial rotational orientation of the fuze is unknown, any electrical contact on the fuze setter can engage any electrical contact pad on the fuze. Thus, a means of ensuring that each electrical contact on the fuze setter side correctly engages the corresponding electrical contact on the fuze side of the interface is required.

One approach described in the present disclosure is to utilize electrical commutation, whereby signals are dynamically assigned to the physical electrical contacts, in effect rotating the signals instead of the fuze. The fuze setter electrically interrogates the fuze contacts prior to this assignment to determine the rotational orientation, based on a known electrical impedance between two of the electrical contact pads. Once the orientation is known, the signals can be properly assigned. In addition, it may occur that an electrical contact on the fuze setter side falls on the edge of an electrical contact pad on the fuze side of the interface. A means to detect and resolve this situation, using a separate pair of edge detect contacts is also described in the present disclosure.

Generally, commutation functions will occur in the fuze setter, i.e., the signals in the fuze setter assigned to particular pins in the fuze setter, after the rotational orientation between the fuze setter and fuze contacts has been determined. It will be understood, however, that in principle, nothing prevents the roles between fuze and fuze setter with respect to performing commutation from being reversed. Owing to implementation complexity, there are, however, some benefits to the fuze setter performing the commutation functions.

A second approach is to use circularly symmetric electrical contact bands surrounding the fuze, such that each band corresponds to an individual signal. Electrical contact, i.e., electrical contact pins on the fuze setter side are mechanically aligned to the bands such that each pin directly contacts its corresponding band directly, making direct electrical contact.

In one aspect, an exemplary embodiment of the present disclosure may provide a system, comprising a fuze adapted to be engaged with a projectile body; a fuze setter configured to engage with the fuze; a plurality of first electrical contacts provided on an exterior surface of the fuze; and a plurality of second contacts provided on the fuze setter, and when the fuze and fuze setter are engaged, the plurality of first electrical contacts and the plurality of second electrical contacts form an electric interface adapted to transfer one or both of power and data from the fuze setter to the fuze. Electrical power is transferred from the fuze setter to the fuze. Data may be transferred in either direction, from the fuze setter to the fuze, or vice versa.

In another aspect, an exemplary embodiment of the present disclosure may provide a system comprising a projectile including a fuze having a radome housing at a leading end; a fuze setter configured to engage the radome housing; a plurality of electrical contact pads on the radome housing, wherein the plurality of electrical contact pads are in electrical communication with a system of electronics internal to the fuze; a plurality of electrical contact pins provided on the fuze setter, wherein the plurality of electrical contact pins are positioned to engage the plurality of electrical contact pads when the fuze setter engages the radome housing; and a loopback resistor integrated with a pair of the electrical contact pads.

In yet another aspect, an exemplary embodiment of the present disclosure may provide a method of transferring one or both of power and data from a fuze setter to a fuze, comprising bracketing a selected electrical contact pin of a plurality of electrical contact pins on a fuze setter with a pair of edge detect contacts; interrogating the pair of edge detect contacts; determining whether the selected electrical contact pin is in contact with an edge of an electrical contact pad of a plurality of electrical contact pads provided on a fuze; interrogating adjacent electrical contact pins of the plurality of electrical contact pins; locating a loopback resistor connected to two electrical contact pads of the plurality of electrical contact pads; determining a location of each of the plurality of electrical contact pads based on the location of the loopback resistor; performing electrical commutation to rotate electrical contact pin assignments on the fuze setter to match the locations of the plurality of electrical contact pads on the fuze; and assigning a signal to each of the plurality of electrical contact pins. In one example, the method includes rotating the plurality of electrical contact pins through a half pitch of one of the plurality of electrical contact pads after the interrogating of the edge detect contacts. In one example, the method includes programming the fuze after the assigning of the signal to each of the plurality of electrical contact pins.

An example embodiment of the present disclosure provides a system that may include a fuze attached to an end of a projectile body and a fuze setter configured to engage with the fuze. The system may include a plurality of electrical contact pads on the fuze, particularly on the radome housing thereof, and a plurality of electrical contacts, such as electrical contact pins (or electrical contact pins) located on the fuze setter, where the plurality of electrical contact pins corresponds to the plurality of electrical contact pads.

Particular implementations may include one or more of the following features. There may be a loopback resistor integrated with the electrical contact pads, where the loopback resistor is situated between two electrical contact pads. The loopback resistor may be used by the fuze setter as a means to determine that the fuze setter is electrically connected to the fuze. This is accomplished by sensing the electrical resistance between the corresponding contacts in the fuze across which the loopback resistor is connected. In one embodiment the present loopback resistor is used as a means to determine the rotational orientation of the fuze relative to the fuze setter.

There may be a band of the plurality of electrical contact pads situated on a nose of the fuze housing. The spring electrical contact pins may be radially situated on the fuze setter. There may be a plurality of bands of the electrical contact pads located on a side of the fuze housing. The plurality of bands of the electrical contact pads may be segmented. The spring electrical contact pins may be axially aligned on a programming block of the fuze setter, thereby allowing the spring electrical contact pins to engage with the plurality of bands of the electrical contact pads. The fuze setter may have at least two contact interfaces, where the at least two contact interfaces are configured to engage with the electrical contact pads of the fuze. The plurality of electrical contact pads may be configured to be removed by aerodynamic heating or by aerodynamic wind forces. The fuze housing may further comprise an external surface capable of being metallized, thereby allowing the external surface to have the plurality of electrical contact pads. The plurality of electrical contact pads may be configured to be in electrical communication with a system of electronics internal to the fuze.

Another example embodiment provides a system that may include a fuze attached to an end of a projectile body, and a fuze setter configured to engage with the fuze. There may be a fuze housing situated on an end of the fuze, further comprising a plurality of electrical contact pads on the fuze housing, wherein the plurality of electrical contact pads are configured to be in electrical communication with a system of electronics internal to the fuze. There may be a plurality of electrical contact pins situated on the fuze setter, where the plurality of electrical contact pins correspond to the plurality of electrical contact pads. There may be a loopback resistor integrated with the electrical contact pads, where the loopback resistor is situated between two electrical contact pads.

Particular implementations may include one or more of the following features. There may be a band of the plurality of electrical contact pads situated on a nose of the fuze housing. The spring electrical contact pins may be radially situated on the fuze setter. There may be a plurality of bands of the electrical contact pads located on a size of the fuze housing. The plurality of bands of the electrical contact pads may be segmented. The spring electrical contact pins may be axially aligned on a programming block of the fuze setter, thereby allowing the spring electrical contact pins to engage with the plurality of bands of the electrical contact pads. The fuze setter may have at least two contact interfaces, where the at least two contact interfaces are configured to engage with the electrical contact pads of the fuze. The plurality of electrical contact pads may be configured to be removed by aerodynamic heating or by aerodynamic wind forces. The fuze housing may further comprise an external surface capable of being metallized, thereby allowing the external surface to have the plurality of electrical contact pads.

Another example embodiment provides a method including interrogating a plurality of edge detect contacts to determine whether a first electrical contact pin or a second electrical contact pin of a pair group might be contacting an electrical contact pad edge; interrogating a plurality of pair groups; locating a loopback resistor, thereby identifying a location of the plurality of pair groups; identifying locations of other contacts; performing electrical commutation to rotate electrical contact pin assignments on a fuze setter interface; matching a rotational orientation of a fuze electrical contact pad; and assigning a signal to each of the electrical contact pins.

Implementations of the techniques discussed above may include a method or process, a system or apparatus, a kit, or a computer software stored on a computer-accessible medium. The details or one or more implementations are set forth in the accompanying drawings and the description below. Other features will be apparent from the description and drawings, and form the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

FIG. 15 is a block diagram depicting a process of how the location of the loopback resistor is determined in a signal commutation approach, where the process is illustrated in greater detail in FIGS. 15A and 15B.

Figure 1:
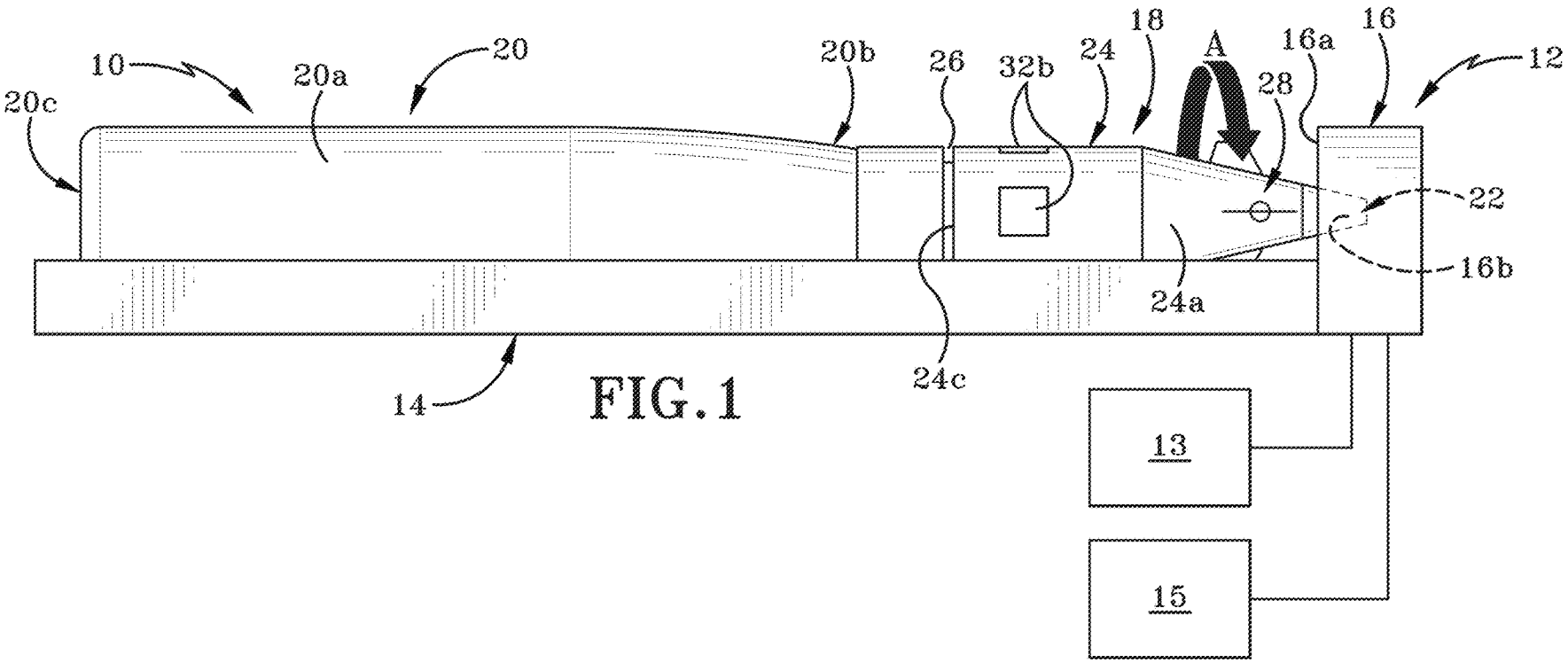
FIG. 1 is a side elevation view of a guided projectile positioned in an autoloader of a fuze setter system in accordance with the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

This disclosure relates to a system for a fuze setter for autoloader compatibility, particularly rotationally symmetric physical electrical contacts on the fuze that can be engaged by the fuze setter connector. The system may have a fuze setter and a fuze. The fuze setter and fuze may have electrical contacts. The fuze setter may electrically interrogate the fuze electrical contacts to determine the rotational orientation. Once the orientation is determined, the signals may be assigned to the electrical contacts. This disclosure relates to a method for electrically interrogating the fuze electrical contacts to determine the rotational orientation of the fuze.

Preparation for launch of an artillery projectile includes programming data into an artillery fuze with precision guidance capability such that the programming process is compatible with both manually performed and autoloader operations and associated equipment. The programming of the data into an artillery fuze must be done quickly to maintain a maximum rate of fire for the gun platform to which an autoloader may be affixed. The fuze is attached to the tip of the projectile body and typically positioned in the autoloader in an arbitrary rotational orientation. This leads to rotationally misaligning the location of the electrical contact pads on the fuze to mating electrical contacts on the fuze setter side of the interface on the autoloader. This condition may be exacerbated in some applications whereby the fuze itself may be rotationally decoupled from the projectile body, allowing it to spin freely relative to the projectile. In other applications, the fuze is hard mounted to the projectile body so that it does not rotate independently. However, the entire projectile and fuze assembly may be positioned in the autoloader such that it is rotationally misaligned to the fuze setter connector on the autoloader.

This rotational misalignment creates a difficulty during fuze setting since an external connector located on the exterior of the fuze must be rotationally aligned to the mating connector on the fuze setter in order to make the necessary electrical connections prior to initiating the fuze setting process. This need for rotational alignment adds complexity into the design and operation of an autoloader that incorporates fuze setting capability in that either manual intervention, or a rotation mechanism incorporated into the autoloader may be necessary to perform this rotational orientation. This complexity can decrease the reliability and increase the cost of the autoloader. Additionally, the cycle time required for rotational alignment and fuze programming must be included in the overall timeline for fuze setting prior to launch. The increase in time necessary to rotationally orient the fuze can increase the overall time required to prepare and program the fuze prior to launch. This increased time can degrade the maximum rate of fire of the gun platform and impacts operational effectiveness. The present inventors have recognized there is a need for direct electrical connections between the fuze setter and the fuze that do not require rotational alignment of the fuze.

Thus, and in accordance with embodiments, techniques and architecture are disclosed herein for a system for a fuze setter for autoloader compatibility. The system may comprise rotationally symmetric physical electrical contacts on the fuze that can be engaged by the fuze setter connector.

Figure 4A:
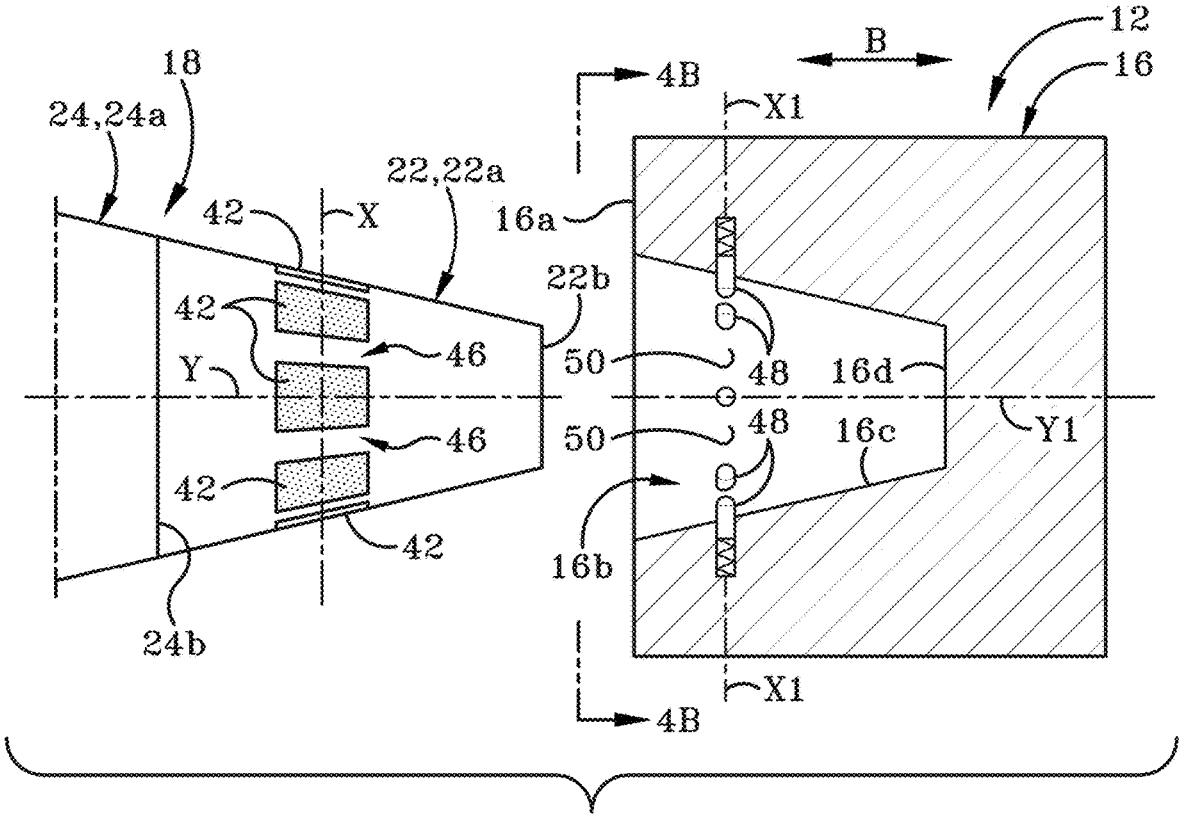
FIG. 4A is a side elevation view of the fuze radome housing of FIG. 2 positioned for engagement in a fuze setter station and showing a complementary pattern of electrical contact pins provided in the fuze setter station for engagement with the radome housing's electrical contact pads.

FIGS. 1 and 4A illustrate a fuze setting system configured in accordance with an example of the present disclosure. As will be described hereafter, the fuze setting system includes a fuze and a fuze setter station that is configured to engage at least a leading end of the fuze. FIG. 1 shows a guided projectile 10 engaged with a fuze setter 12. The figures show fuze setter 12, an autoloader 14, and a fuze setter station 16 that all may be located on a gun platform (not shown). Fuze setter 12 includes a computer 13 and a power source 15. Computer 13 and power source 15 may be integral with fuze setter 12 or may be located remote therefrom and be operatively engaged with fuze setter 12. The computer 13 may be provided with software to operate fuze setter 12 and to transfer power and data from fuze setter 12 to the fuze of guided projectile 10. Guided projectile 10 is shown positioned on a feed tray of autoloader 14. Autoloader 14 directs guided projectile 10 into fuze setter station 16 and in some instances may then further direct guided projectile into a launch tube of a gun platform (not shown).

FIGS. 2 to 5B show a fuze 18 that includes a first embodiment of an electrical contact pad configuration for engagement with complementary electrical contacts of fuze setter station 16. Fuze setter station 16 includes a wall 16*a* (FIG. 4A) that defines an opening to a port 16*b*. Port 16*b* is bounded and defined by an interior sidewall 16*c* and an interior front wall 16*d* of fuze setter station 16. Front wall 16*d* may be generally parallel to wall 16*a*. The sidewall 16*c* and front wall 16*d* are shaped to be complementary to the exterior surfaces of a leading end of guided projectile 10. Port 16*b* may be of slightly greater dimensions than the leading end of guided projectile 10 so that this leading end may be received within port 16*b*. The leading end of guided projectile 10 may be introduced into port 16*b* through the opening defined in wall 16*a* by autoloader 14. As will be discussed later herein, fuze setter station 16 includes a plurality of electrical contacts that are positioned on sidewall 16*c* and are utilized to form an electrical interface that is used to configure or program fuze 18.

Figure 3:
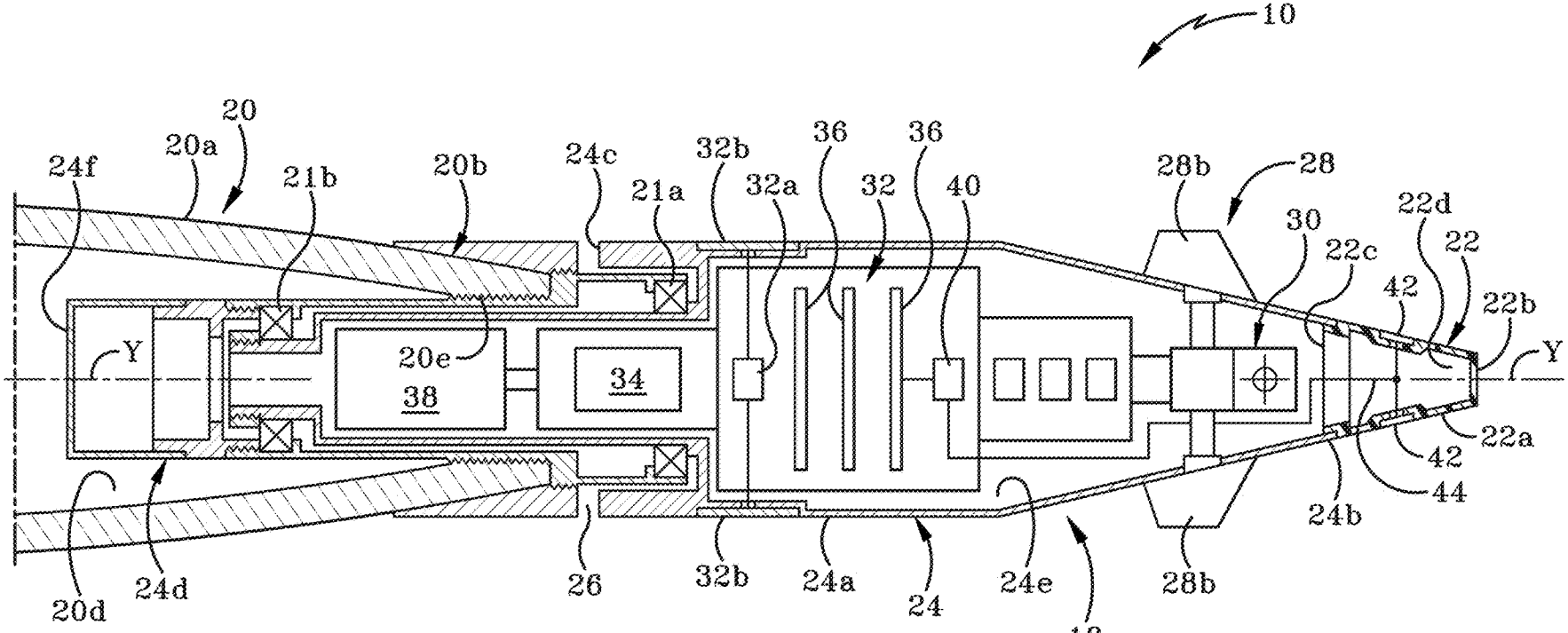
FIG. 3 is a longitudinal cross-section of the guided projectile taken along line 3-3 of FIG. 2.

Referring to FIGS. 1 and 3, guided projectile 10 comprises fuze 18 and a projectile body 20. Projectile body 20 may take any of a variety of different forms and may include an exterior wall 20*a* having a first end 20*b* (FIG. 3) and a second end 20*c* (FIG. 1). Wall 20*a* bounds and defines an interior cavity 20*d* and may be fabricated from a material, such as metal, that is structurally sufficient to enable projectile 10 to carry an explosive charge in interior cavity 20*d*. A coupling region 20*e* may be provided proximate first end 20*b* of projectile body 20 and is utilized to engage projectile body 20 and fuze 18 together. A pair of roll bearings 21*a*, 21*b* is provided that allow the fuze 18 to rotate (roll) relative to the projectile body 20. FIG. 3 shows forward roll bearing 21*a* and rear roll bearing 21*b*.

Guided projectile 10 is placed on the feed tray of autoloader 14 and the feed tray is configured to move a leading end of fuze 18 into port 16*b* of fuze setter station 16. As will be described later herein, when the leading end of fuze 18 is engaged in port 16*b*, an electrical interface is established between electrical contact pads on fuze 18 and mating electrical contacts on fuze setter 12 and fuze 18. This electrical interface enables electrical power and/or data to be transferred from fuze setter 12 to fuze 18. The data may include information related to projectile guidance, navigation, fuze operational mode, etc. to be communicated to the fuze. The fuze can also report status and other information back to the fuze setter, during the fuze setting process.

Referring to FIGS. 2 to 4A, fuze 18 includes a radome housing 22 and a fuze body 24 that are operatively engaged with each other. Radome housing 22 includes an exterior sidewall 22*a* that may be generally of a truncated conical shape. Radome housing 22 may further include a front end 22*b* and a rear end 22*c* (FIG. 3). Sidewall 22*a* and front end 22*b* bound and define an interior cavity 22*d* (FIG. 3) within which various components may be housed. Radome housing 22 forms the nose or leading end of fuze 18 and therefore of guided projectile 10.

As shown in FIG. 3, fuze body 24 includes an exterior sidewall 24*a* having a first end 24*b* (FIG. 2), an intermediate region 24*c*, and an extension 24*d* that extends rearwardly from intermediate region 24*c*. Extension 24*d* is of a smaller circumference than sidewall 24*a* and is adapted to be received within cavity 20*d* of projectile body 20. Sidewall 24*a* bounds and defines an interior cavity 24*e* within which a number of components are housed. Intermediate region 24*c* terminates in a second end 24*f* that is remote from first end 24*b*. Fuze 18 has a longitudinal axis "Y" that extends between a central region of front end 22*b* and a central region of second end 24*f*.

First end 24*b* of fuze body 24 may be operatively engaged with rear end 22*c* of radome housing 22 or be integrally formed therewith. Extension 24*d* of fuze body 24 may be coupled to coupling region 20*e* of projectile body 20. A space 26 (FIG. 3) may be defined between intermediate region 24*c* of fuze body 24 and a portion of coupling region 20*e* on projectile body 20. Extension 24*d*, which may be tubular in configuration, may be threadedly engaged with coupling region 20*e*. The engagement between fuze 18 and projectile body 20 may be one that permits fuze 18 to rotate relative to projectile body 20 and about longitudinal axis "Y". This possible rotation is indicated by the arrow "A" in FIG. 1.

Figure 2:
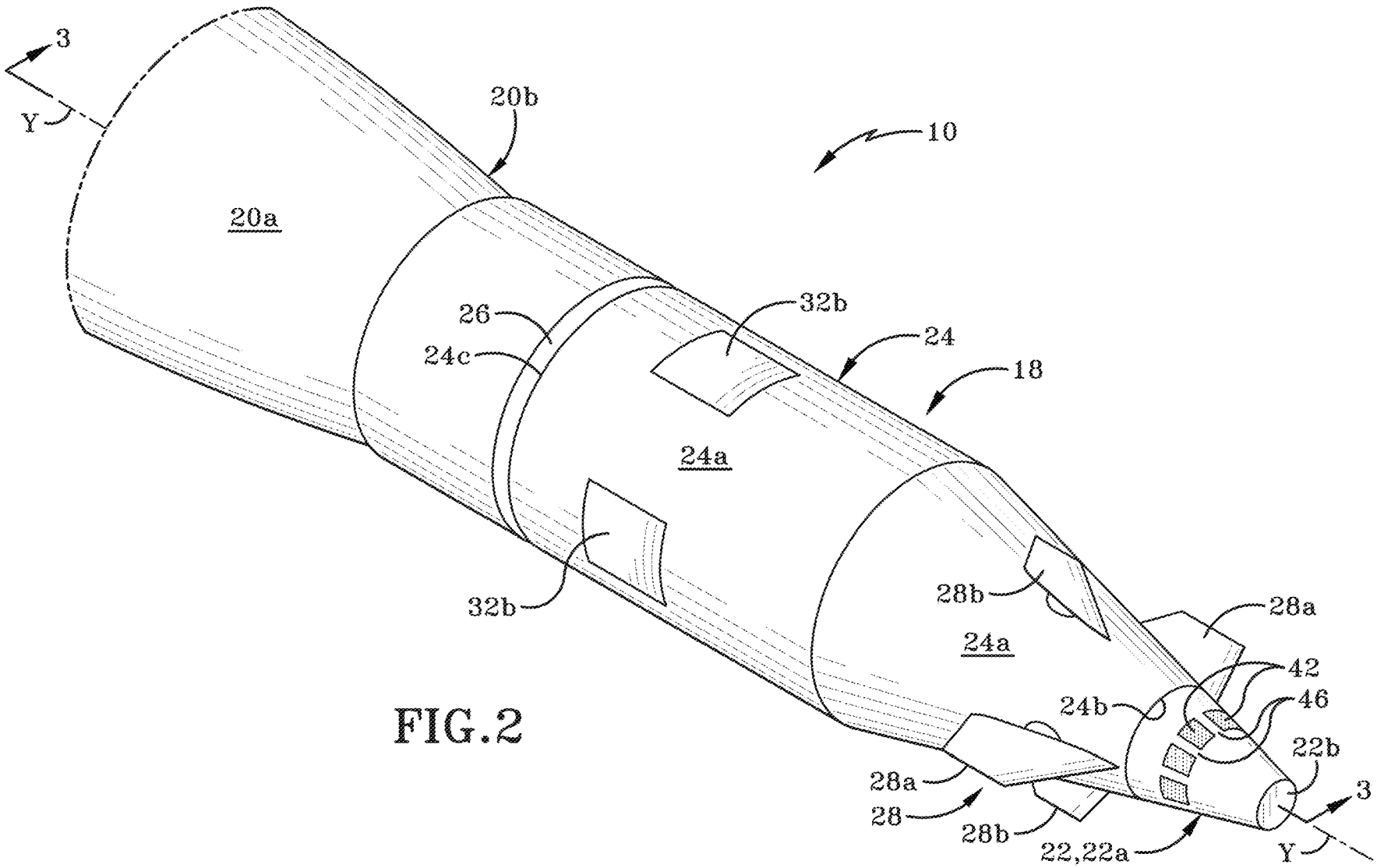
FIG. 2 is front perspective view of a fuze showing a first embodiment of an electrical contact pad configuration provided on a sidewall of the fuze radome housing.

Referring still to FIGS. 2 and 3, a canard assembly 28 may be provided on fuze body 24. Canard assembly 28 may include one or more lift canards 28*a* and one or more roll canards 28*b*. Canards 28*a*, 28*b* are utilized to provide stability and/or control to guided projectile 10 and are operatively engaged with a control actuation system 30 located within interior cavity 24*e* of fuze body 24. Canards 28*a*, 28*b* are operated by control actuation system 30 to steer projectile 10 during its flight towards a remote target.

Referring still to FIG. 3, fuze 18 may further include a guidance, navigation, and control (GNC) assembly 32 located within cavity 24*e*. GNC assembly 32 may comprise a Global Positioning System (GPS) receiver 32*a* and other components as necessary to navigate and guide the projectile 10 to the location programmed during fuze setting. At least one GPS antenna 32*b* is provided on the exterior surface of sidewall 24*a*. Although not specifically illustrated herein, GNC assembly 32 may also include a plurality of other sensors, including, but not limited to, laser guided sensors, electro-optical sensors, imaging sensors, inertial navigation systems (INS), inertial measurement units (IMU), or any other sensors suitable or necessary for use on a guided projectile 10. These sensors may be provided in cavity 22*d* of radome housing 22 or in cavity 24*e* of fuze body 24.

At least one non-transitory computer-readable storage medium 34, and at least one processor or microprocessor 36 may be housed within cavity 24*e* of fuze body 24. The storage medium 34 may include instructions encoded thereon that, when executed by the processor or microprocessor 36, implements various functions and operations to aid in guidance, navigation and control of guided projectile 10. A battery 38 and a capacitor 40 may be located within interior cavity 24*e*. Battery 38 may be operatively engaged with any of the aforementioned components that require power to operate.

It will be understood that the placement of the various components within fuze 18 may be different from what is illustrated herein. In some examples, some of the above-mentioned components may be omitted from guided projectile 10. In other examples, additional components may be included in guided projectile 10. Some or all of the components may be operatively engaged with each other via wiring. Only some wiring has been illustrated in FIG. 3 for the sake of clarity of illustration. It will be understood that any type of connections may be provided between the various components within fuze 18.

In accordance with the present disclosure, fuze 18 includes a first embodiment of an electric contact configuration and fuze setter 12 includes a complementary electric contact configuration. The first embodiment electric contact configurations of fuze 18 and fuze setter 12 form a first embodiment electrical interface between fuze 18 and fuze setter 12. The electrical interface enables power and/or data to be transferred from fuze setter 12 to fuze 18 during a fuze setting operation.

FIGS. 2 to 5B illustrate that the first embodiment electric contact configuration on fuze 18 comprises a plurality of first electrical contacts. These first electrical contacts are electrical contact pads 42 that are provided on the exterior surface of sidewall 22*a* of radome housing 22. In one example, there are eight discrete electrical contact pads 42 provided on radome housing 22. In one example, the electrical contact pads 42 comprise two power electrical contact pads, two loopback electrical contact pads, two Time Mark Indicator (TMI) electrical contact pads, and two serial communications electrical contact pads. One electrical contact pad 42 is provided for each signal. Electrical contact pads 42 are operatively engaged with the electronic system of fuze 18 via wiring 44 (FIG. 3). For example, each electrical contact pad 42 may be operatively engaged with one or more of the computer readable storage medium 34, processor 36, battery 38, capacitor 40, and any other electronic components on fuze 18. As indicated earlier herein, the TMI electrical contact pads are utilized to transfer GPS time signals from the fuze setter 50 to the fuze 18, allowing the fuze 18 to synchronize to GPS time. TMI signals are only relevant to embodiments utilizing GPS. In other embodiments, these to electrical contact pads could be used for other purposes, or they could be omitted.

The location of electrical contact pads 42 on sidewall 22*a* as illustrated in FIGS. 2-5B avoids obscuration of any Height of Burst (HoB) sensor transmitter located within cavity 22*d* of radome housing 22. There is furthermore more surface area available on sidewall 22*a* than on front end 22*b* and therefore the use of larger electrical contact pads 42 is possible than if the electrical contact pads were placed on front end 22*a*. Additionally, electrical contact pads 42 are positioned closer to a bottom region of radome housing 22 and therefore there is a shorter electrical path length to electronics within radome housing 22. An additional benefit of placing electrical contact pads 42 on sidewall 22*a* is that the electrical contact pads 42 may be readily accessed by a fuze setter 12 that utilizes a nose approach, a side approach, or a clamshell approach. The placement on the sidewall 22*a* also helps to accommodate larger mechanical misalignments between electrical contact pads 42 and complementary electrical contacts provided on fuze setter 12. (The electrical contacts on fuze setter 12 will be described later herein.) Furthermore, placing electrical contact pads 42 on sidewall 22*a* may allow for higher electrical current carrying ability (for power/ground signals). Since there are eight electrical contact pads 42, the connection to electronics within radome housing 22 is simplified.

Electrical contact pads 42 may be applied to sidewall 22*a* of radome housing 22 in any suitable manner. One suitable manner may be through contact metallization. In one example, electrical contact pads 42 may be bonded to the exterior surface of sidewall 22*a* using an adhesive. In one example, a recess is defined in the exterior surface of sidewall 22*a* for each electrical contact pad 42 and an associated electrical contact pad is placed into each recess. In one example, an outermost surface of the electrical contact pad 42 within a recess is substantially flush with the exterior surface of the sidewall 22*a*. In one example, an outermost surface of the electrical contact pad 42 within a recess is located a short distance outwardly beyond the exterior surface of the sidewall 22*a*. In one example, an outermost surface of the electrical contact pad 42 within a recess is located a short distance inwardly from the exterior surface of the sidewall 22*a*.

In accordance with an aspect of the present disclosure, electrical contact pads 42 are arranged in a rotationally symmetric pattern. This rotationally symmetric pattern aids in accommodating an unknown rotational orientation of fuze 18 when the fuze is engaged by fuze setter 12. Providing electrical contact pads 42 in a rotationally symmetric pattern also helps to avoid the need to physically rotationally orient the fuze 18 prior to engagement with the fuze setter 12.

FIG. 2 shows electrical contact pads 42 arranged in pattern on the sidewall 22*a*. Electrical contact pads are arranged an annular ring that circumscribes the exterior surface of sidewall 22*a* and are spaced circumferentially from each other around the circumference of sidewall 22*a*. In one example, the electrical contact pads 42 are spaced at regular intervals around the circumference of sidewall 22*a*. In one example, adjacent electrical contact pads 42 are separated from each other by a space 46 (FIG. 4A) or by a section of sidewall 22*a*. In one example, eight electrical contact pads 42 are provided in the annular ring of electrical contact pads. Each electrical contact pad 42 and each space 46 extends longitudinally rearwardly away from front end 22*a*. In one example, each electrical contact pad 42 is generally rectangularly-shaped when sidewall 22*a* is viewed from the side. In one example, electrical contact pads 42 are aligned with each other along a vertical plane "X" (FIG. 4A) that is oriented at right angles to longitudinal axis "Y".

In accordance with an aspect of the present disclosure, fuze setter station 16 includes a plurality of second electrical contacts that engage with the plurality of first electrical contacts in the fuze 18 to form an electrical interface. The second electric contact 48 are arranged in a pattern complementary to the pattern of electrical contact pads 42 on fuze 18. Electrical contacts 48 are arranged an annular ring that circumscribes an interior surface of sidewall 16*c* that bounds port 16*b*. Contacts 48 are spaced circumferentially from each other around the circumference of sidewall 16*c*. In one example, the contacts 48 are spaced at regular intervals around the circumference of sidewall 16*c*. In one example, adjacent contacts 48 are separated from each other by a space 50 (FIG. 4B) or by a section of sidewall 16*c*. In one example, eight contacts 48 are provided in the annular ring of contacts 48.

Electrical contacts 48 may be of any construction that will establish an electrical connection with electrical contact pads 42. In one example, the electrical contacts 48 on fuze setter station 16 may be spring contacts such as axially aligned electrical contact pins 48 (e.g. a pogo electrical contact pin) or any other configuration of spring contact that provides mechanical compliance and wiping action. The electrical contact pins 48 may be used for either for transfer of electrical power or signals. It will be understood that the electrical contacts 48 on fuze setter station 16 are not limited to electrical contact pins but may be of any other desired construction. The electrical contacts 48 will be referred to hereafter as electrical contact pins 48 and should be understood to be capable of transferring power or data to electrical contact pads 42.

Figure 4B:
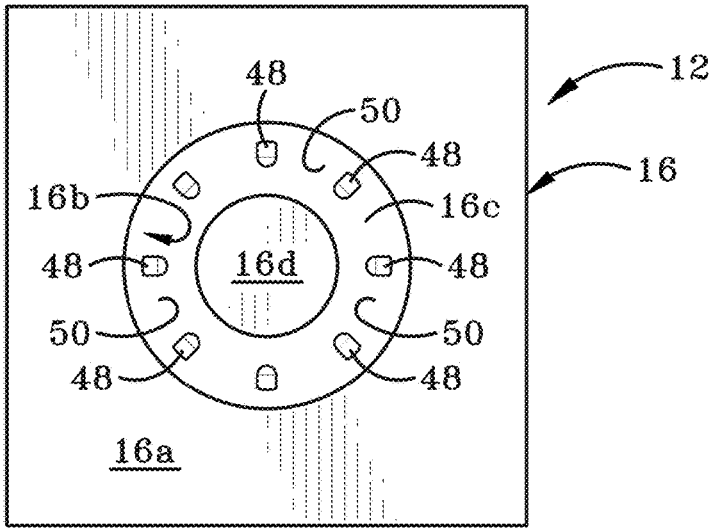
FIG. 4B is a rear end elevation view of the fuze setter station showing the arrangement of the electrical contact pins.

Electrical contact pins 48 are arranged in a pattern substantially identical to the pattern of electrical contact pads 42 on fuze 18. FIGS. 4A and 4B show electrical contact pins 48 are arranged radially on fuze setter station 16 and are capable of extending outwardly beyond the interior surface of sidewall 16*c* and into port 16*b*. Electrical contact pins 48 are aligned with each other along a vertical plane "X1" that is oriented at right angles to the longitudinal axis "Y1" of fuze setter port 16*b*. FIG. 4B shows electrical contact pins 48 are arranged in a circular pattern. In one example there are equivalent numbers of electrical contact pads 42 on fuze 18 and electrical contact pins 48 on fuze setter station 16. In other words, there is a one-to-one ratio between electrical contact pads 42 and electrical contact pins 48. Electrical contact pins 48 are operatively engaged with the electronics within fuze setter 12 and may be utilized to transfer power and/or data to fuze 18.

The placement of electrical contact pins 48 on sidewall 16*c* is such that when radome housing 22 is received in port 16*b*, electrical contact pins 48, and electrical contact pads 42 will come sufficiently into alignment and contact with each other that an electrical interface is formed between them. Each electrical contact pad 42 engages a corresponding electrical contact pin 48 on fuze setter 12 that is unassigned to a signal. In one example, power will be transferred from fuze setter 12 to fuze 18 via the interface formed between electrical contact pins 48 and electrical contact pads 42. In one example, data will be transferred or shared between fuze setter 12 and fuze 18 via the interface formed between electrical contact pins 48 and electrical contact pads 42. In one example, data will be bi-directionally shared between fuze setter 12 and fuze 18 via this interface.

In accordance with an aspect of the present disclosure, the placement of electrical contact pads 42 relative to the placement of electrical contact pins 48 and thereby the development of the electrical interface is such that no matter the rotational orientation of fuze 18 relative to projectile body 20 (and to fuze setter station 16), power and/or data is able to be transferred across the interface. The first embodiment configuration of electrical contact pads 42 and electrical contact pins 48 negates the need for a specific physical orientation of the fuze 18 to be adopted relative to the fuze setter 12 before power/and or data can be transferred between fuze setter 12 and fuze 18. When fuze 18 is placed on autoloader 14 and is engaged by fuze setter station 16, the fuze rotational position is initially undefined relative to fuze setter station 16. Later in this disclosure a method of determining the rotational orientation of the fuze 18 will be described.

In one example, feedthroughs on each of electrical contact pads 42 can be used to bring electrical signals through to the interior 16*d* (FIG. 3) of the radome housing 22, e.g. via wiring 44, where electrical contact can be made using conventional techniques. These feedthroughs allow fuze setting to occur. In other words, the feedthroughs permit downloading of programs that include targeting information into the fuze 18. The feedthroughs also enable power to be transferred to the fuze 18. The feedthroughs are engaged with the electronic system of fuze 18.

It will be understood that the system disclosed herein is able to use fuze setting for other purposes. For example, the system may be used for periodic monitoring of the fuze while the fuze is in storage, and/or reprogramming the fuze operating software in a more efficient manner. The fuze is typically not attached to the projectile while in storage inventory. Instead, the fuzes are usually kept separate and only assembled to the projectile body just prior to launch. A single fuze or multiple fuzes (typically 4 to 6) may be stored in a single, environmentally sealed storage container. Because fuzes can be in storage for many years, it may be necessary to periodically turn a fuze on to verify that it is still fully functional, or to reprogram the fuze's operating software with an update. In the prior art, this may have necessitated removing each fuze from the storage container to gain access to its communications and power ports. Because the presently disclosed interface is located on the radome housing, (i.e., the nose of the fuze), the interface may be directly accessible while the fuze is still in its storage container once the storage container lid has been opened. This allows each fuze to be connected to the fuze setter (or other maintenance or test equipment which may utilize the same fuze setter interface) and operated in-situ, thereby avoiding the need to remove each fuze from its storage container. This reduces the overall time it takes to program a fuze (or a large inventory of fuzes) and minimizes handling of the fuze, reducing the potential for damage.

The system may also be used as a general communications interface for purposes including status query. Additionally, the interface formed between fuze 18 and fuze setter 12 may be used for checking fuze configuration, including part number, serial number and revision. The interface may further be used to initiate built-in testing and other diagnostic tests of fuze 18, and may have fuze 18 report back the results of the test. In other examples, the disclosed interface may also be utilized to test equipment used to support various diagnostic, maintenance and upgrade and repair functions. The test equipment could incorporate an interface akin to what is used on the fuze 18 and fuze setter 12.

Fuze 18 and fuze setter station 16 may be brought into contact with each other in a number of different ways. In one example, shown in FIG. 1, the feed tray of autoloader 14 may move guided projectile 10 forwardly toward fuze setter station 16 until radome housing 22 of fuze 18 enters port 16*b*. Alternatively, fuze setter station 16 may be moved toward fuze 18 until radome housing 22 is received in port 16*b*. The possible movements of fuze 18 relative to fuze setter station 16 and vice versa are indicate by arrow "B" in FIG. 4A. This type of movement may be referred to herein as a "nose approach". When radome housing 22 is received in port 16*b*, a mechanical interface is established between fuze 18 and fuze setter station 16. The contact between electrical contact pins 48 and electrical contact pads 42 will establish an electrical interface between fuze 18 and fuze setter station 16. Fuze setting (i.e., programming) will occur and then the feed tray may move guided projectile 10 (and thereby fuze 18) away from fuze setter station 16. When this occurs, the mechanical interface and electrical interface is broken.

Figure 4C:
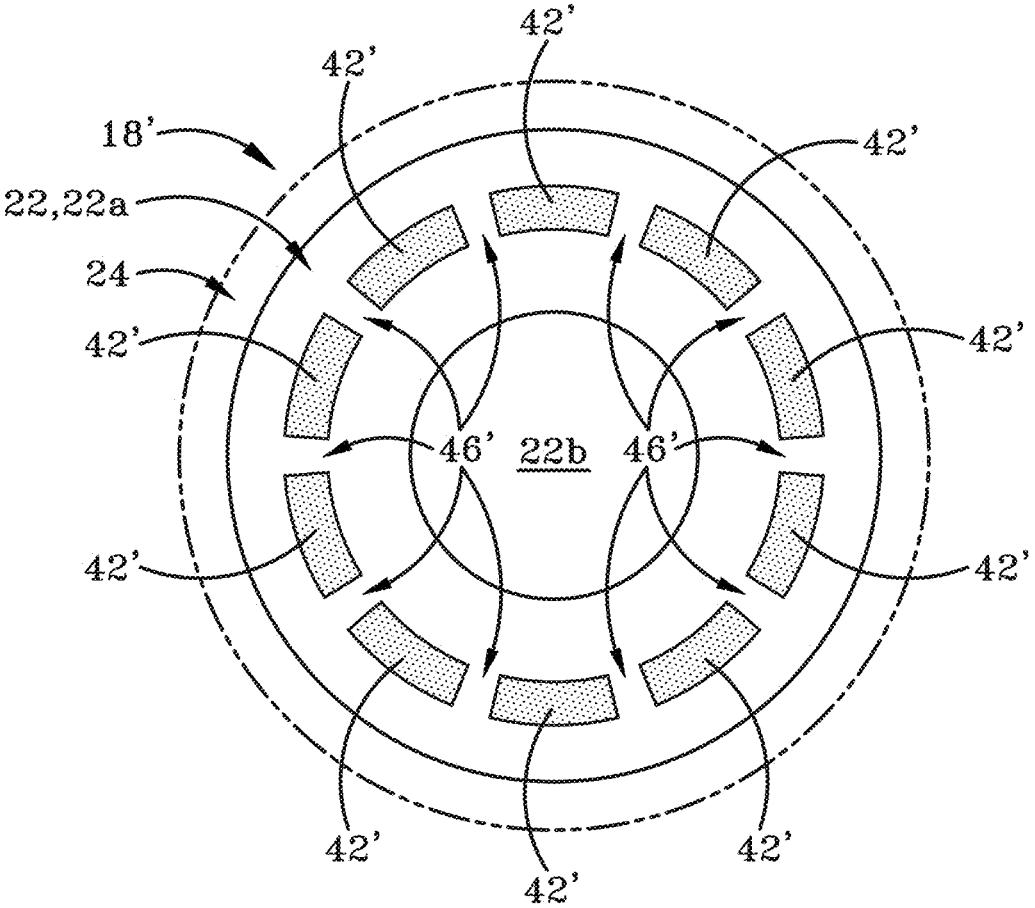
FIG. 4C is a front end elevation view of the fuze radome housing of FIG. 2 showing a second configuration of ten electrical contact pads provided on the sidewall of the radome housing.

FIG. 4C shows a fuze 18' that is substantially identical to the fuze 18 shown in FIGS. 1-4B except that the number of electrical contact pads is different. In particular, fuze 18 as shown in FIGS. 1-4B has eight electrical contact pads 42 while fuze 18' shown in FIG. 4C has ten electrical contact pads 42'. Adjacent electrical contact pads 42' are separated from each other by a space 46' or by a section of the sidewall 22*a* of radome housing 22. Electrical contact pads 42' are arranged in a rotationally symmetric pattern.

It will be understood that a fuze setter that is to engage fuze 18' will be provided with a sufficient number of electrical contacts (e.g. electrical contact pins) to engage electrical contact pads 42'. In one example, the fuze setter that is to engage fuze 18' will have twenty electrical contact pins 48 that are arranged in a complementary location and configuration to engage electrical contact pads 42'. In other examples, the fuze setter that is to engage fuze 18' may have fewer or more than twenty electrical contact pins 48 to engage electrical contact pads 42'. Whatever the number of electrical contact pins 48 on the fuze setter, the electrical contact pins 48 will be arranged to be complementary to the electrical contact pads 42' and configured to communicate therewith.

The electrical contact pads 42' on fuze 18' comprise two loopback resistor contacts, two power/ground contacts, two TMI contacts and four contacts for communications. The loopback resistor contacts are provided so that the complementary fuze setter will be able to sense the loopback resistor within fuze 18' which is electrically connected between the two loopback resistor contacts, and therefore will be able to determine if the fuze setter is connected to fuze 18'. The power/ground contacts include one contact each for input power and ground return current. The two TMI contacts provide GPS time mark indication to fuze 18'. The four communications contacts enable full duplex serial communications between fuze 18' and a complementary fuze setter. (Fuze 18 shown in FIGS. 1-4B includes only two communications contacts instead of four communications contacts.)

In one example, less than eight electrical contact pads 42 may be provided on the fuze 18. In one example, more than eight electrical contact pads 42 may be provided on the fuze 18. Whatever the number of electrical contact pads 42 provided on the fuze 18, the mating fuze setter 16 will include a complementary number of electrical contacts 48. It will be understood that all electrical contact pads 42 on the fuze 18 and mating electrical contacts 48 on the fuze setter 16 will be sized appropriately.

Figure 5A:
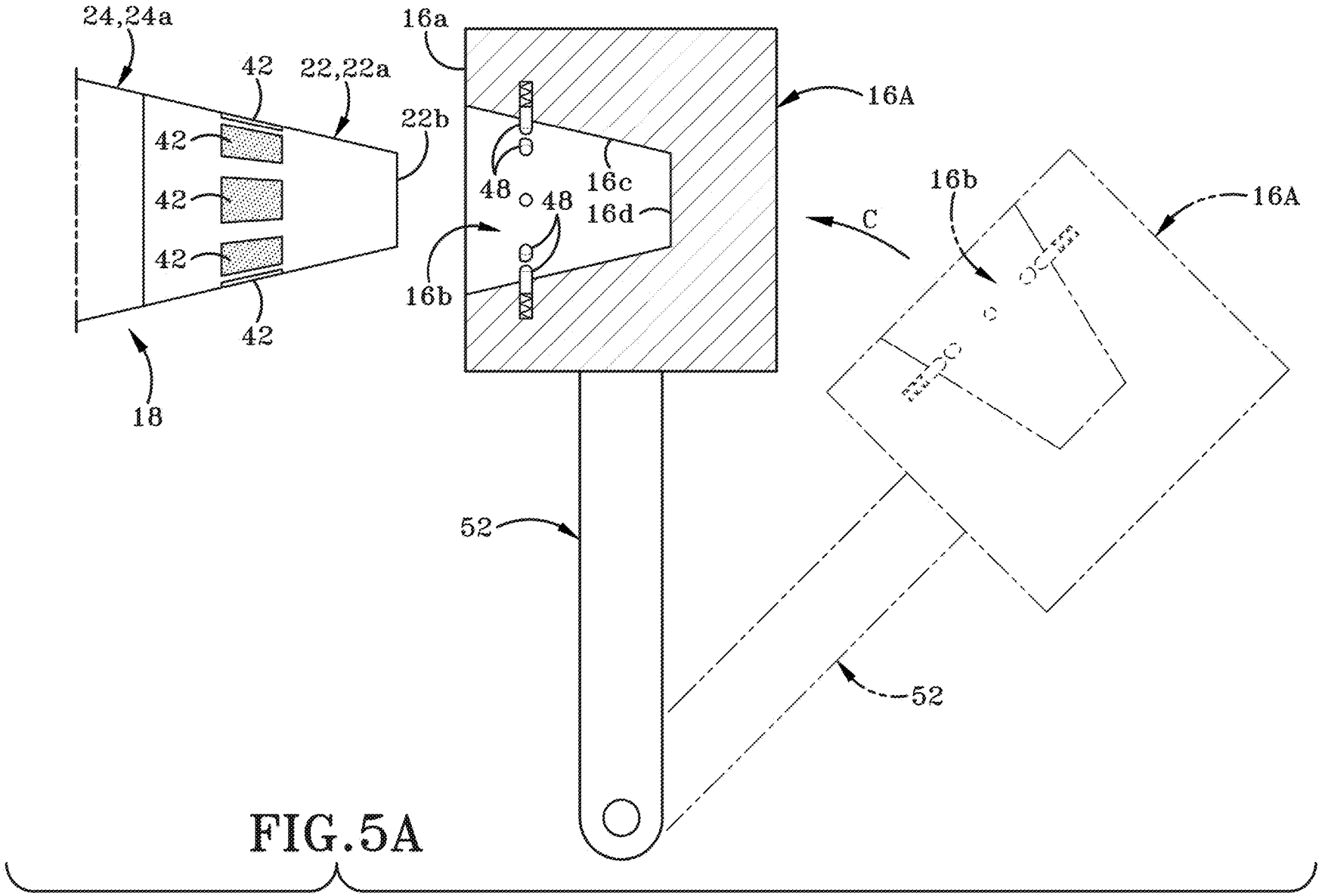
FIG. 5A is a side elevation view showing a fuze setter station adjacent the fuze of FIG. 2, where the fuze setter station is pivotally movable between a fuze setting position and a retracted position.

FIG. 5A shows another type of fuze setter station, indicated by the reference number 16A. Fuze setter station 16A is an autoloader cup or programming cup mounted on a swing arm 52 and movable between a fuze setting position (shown in solid lines) and a retracted position (shown in phantom). Swing arm 52 may be pivotally mounted to a frame of autoloader 14 or to part of a launch platform, e.g., a gun platform. Swing arm 52 will rotate fuze setter station 16A in the direction indicated by arrow "C" and into the fuze setting position when fuze 18 is to be programmed. In the fuze setting position, a cup or port 16*b* of fuze setter station 16A is positioned over radome housing 22 to place electrical contact pins 48 in engagement with electrical contact pads 42. This engagement of radome housing 22 in port 16*b* therefore establishes both of the mechanical interface and the electrical interface between fuze 18 and fuze setter station 16A. The type of engagement between fuze 18 and fuze setter station 16 as indicated herein is, again a nose approach of engagement. Once fuze 18 is programmed, swing arm 52 will rotate fuze setter station 16A in the opposite direction to arrow "C", away from fuze 18, and into the retracted position. The movement of fuze setter station 16A in the opposite direction to arrow "C" breaks the mechanical interface and the electrical interface between fuze 18 and fuze setter station 16A.

Figure 5B:
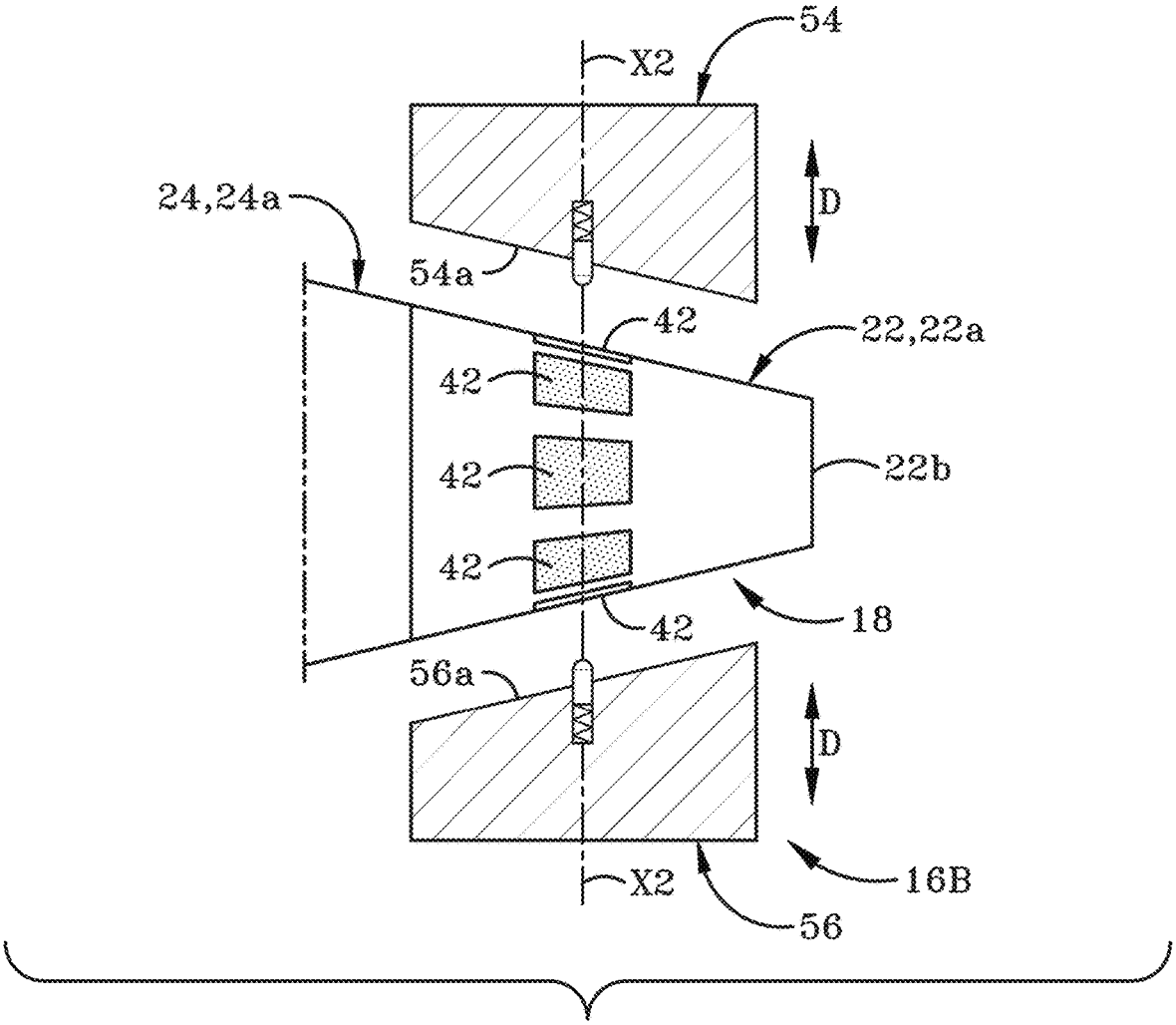
FIG. 5B is a side elevation view of the fuze of FIG. 2 positioned within a fuze setter station that has side walls that are selectively movable in a first direction toward the fuze and into a fuze setting position, and in a second direction away from the fuze and into a retracted position.

FIG. 5B shows another example of a fuze setter station, generally indicated as fuze setter station 16B. Fuze setter station 16B forms a clamshell-type of arrangement and includes a plurality of programming blocks that are selectively movable toward and away from the fuze 18. This type of engagement approach may be referred to herein as a "clamshell approach". Fuze setter station 16B is illustrated to include two programming blocks 54, 56 that are moved inwardly toward fuze 18 when fuze 18 is to be programmed. Programming blocks 54, 56 are moved outwardly away from fuze 18 and into a retracted position when programming is completed. The movement of programming blocks 54, 56 is indicated by the arrows "D". (FIG. 5B shows the programming blocks 54, 56 in the retracted position.) When programming blocks 54, 56 are moved into contact with fuze 18, a mechanical interface is established between fuze setter 16B and fuze 18.

FIG. 5B shows a plurality of spring-loaded electrical contact pins 48 are provided on each programming block 54, 56 and pins 48 are located so as to be extendable outwardly from respective surfaces 54*a*, 56*a* to engage electrical contact pads 42. When electrical contact pins 48 engage electrical contact pads 42, an electrical interface is established between fuze setter station 16B and fuze 18. Programming blocks 54, 56 may be configured such that all the electrical contact pads 42 on fuze 18 are simultaneously contacted from at least two directions by the programming blocks 54, 56. Each of the surfaces 54*a*, 56*a* of the programming blocks 54, 56 may be angled so as to substantially match the taper on sidewall 22*a* of radome housing 22. In one example, electrical contact pins 48 on programming block 54 are generally aligned in the same plane "X2" as electrical contact pins 48 on programming block 56. Electrical contact pins 48 are furthermore generally aligned with electrical contact pads 42.

The provision of electrical contact pads 42 on sidewall 22*a* is suitable for a signal commutation (or electrical commutation) option for orienting the fuze 18 relative to the fuze setter 12 by rotating the signals from the fuze setter 12 instead of physically rotating the fuze 18. Commutation will be described in detail later herein.

It will be understood that a wide variety of other electrical contact pad/electrical contact pin configurations may be utilized on radome housing 22 and fuze setting station 16, 16A, since the entire radome housing exterior surface area is accessible when utilizing a nose-first approach, i.e. engaging the radome housing 22 in port 16*b* of fuze setting station 16. A number of other configurations will be described later herein.

Figure 6A:
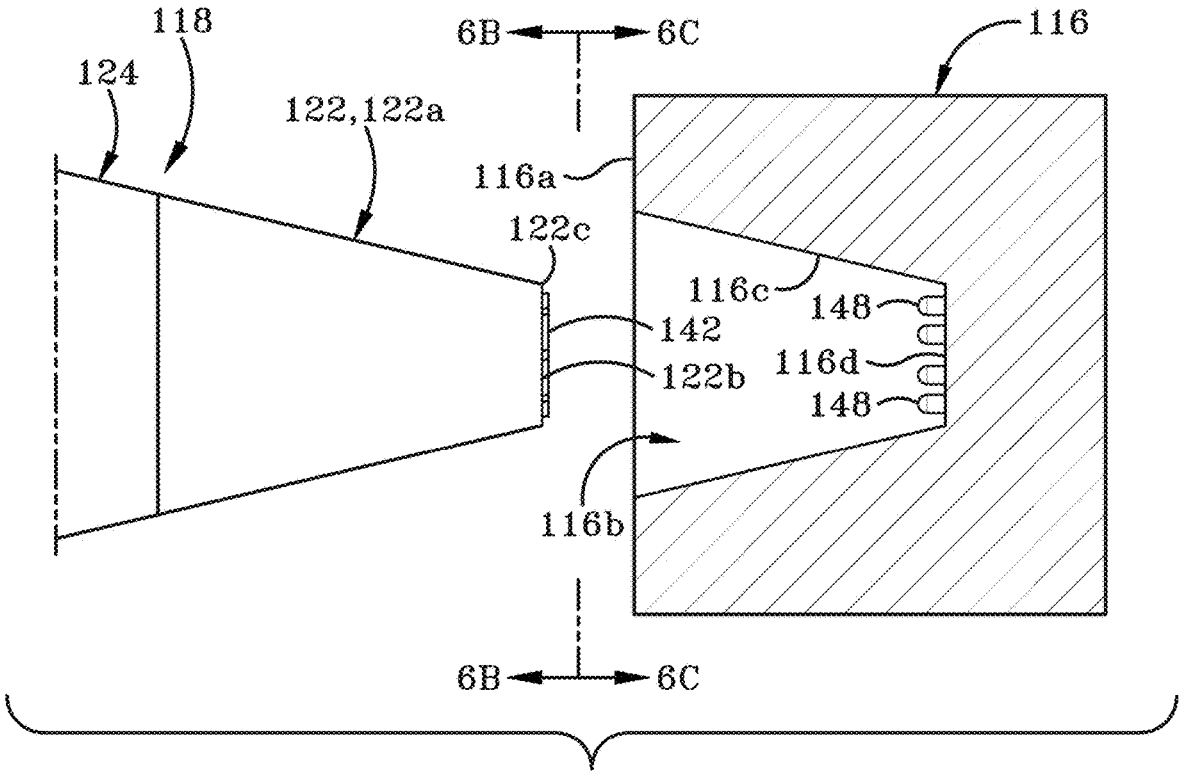
FIG. 6A is a side elevation view of a fuze radome housing showing a second embodiment of an electrical contact pad configuration on the front end of the radome housing, and showing the radome housing positioned for insertion into a fuze setter station having a complementary set of electrical contact pins.
Figure 6B:
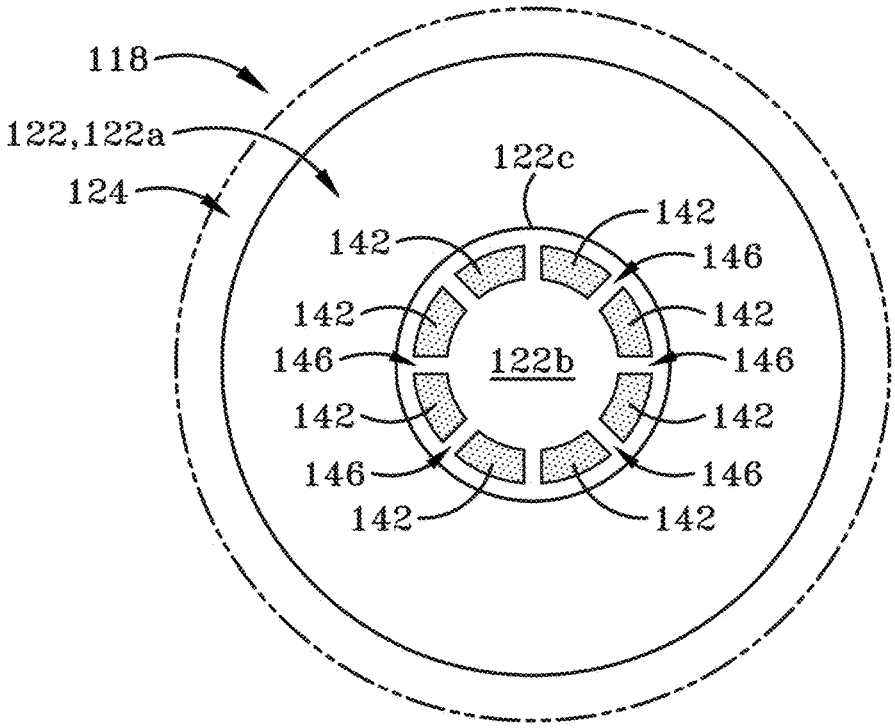
FIG. 6B is a front end elevation view of the radome housing taken along line 6B-6B of FIG. 6A.
Figure 6C:
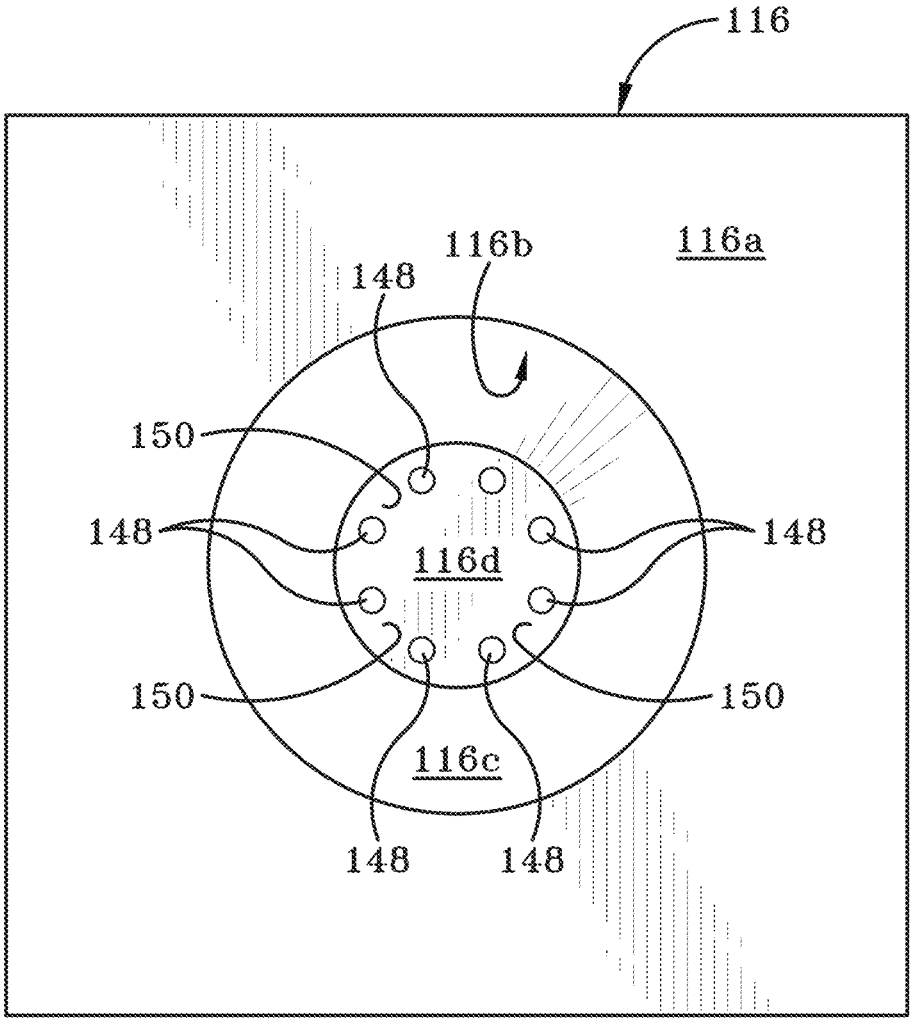
FIG. 6C is a rear end elevation view of the fuze setter station taken along line 6C-6C of FIG. 6A.

Referring to FIGS. 6A to 6C, there is shown a second embodiment of a fuze setter system that is able to be utilized to form an electrical interface between a fuze 118 and a fuze setter 112. The second embodiment is suitable for a direct contact interface. The fuze setter system has a rotationally symmetric signal location and tends to be inherently insensitive to fuze rotational orientation. In accordance with the present disclosure, fuze 118 includes a second embodiment of an electric contact arrangement and fuze setter 112 includes a complementary electric contact arrangement to that of fuze 118. The second embodiment electric contact arrangements of fuze 118 and fuze setter 112 form a second embodiment electrical interface between fuze 118 and fuze setter 112. This electrical interface enables power and/or data to be transferred from fuze setter 112 to fuze 118 during a fuze setting operation.

Fuze 118 includes a radome housing 122 and fuze setter 112 includes a fuze setter station 116. Radome housing 122 extends forwardly from fuze body 124 and includes a sidewall 122*a* and a front end 122*b*. A circumferential edge 122*c* is provided where sidewall 122*a* and front end 122*b* intersect. A plurality of electrical contact pads 142 is provided on an exterior surface of front end 122*b* of radome housing 122. Although not illustrated herein, it will be understood that feedthroughs extend from each electrical contact pad 142 to the electronics within fuze 118. It will be understood that electrical contact pads 142 are substantially identical in all aspects of structure and function to electrical contact pads 42 except that their placement and shape may differ therefrom.

FIG. 6B shows that, in one example, electrical contact pads 142 are arranged in a concentric segmented ring pattern on the flat front end 122*b* of radome housing 122. There is one segment (i.e., electrical contact pad 142) for each signal. Electrical contact pads 142 are arranged in a rotationally symmetric pattern. The electrical contact pads 142 are positioned a short distance inwardly from edge 122*c* where front end 122*b* intersects sidewall 122*a*. In one example, electrical contact pads 142 are arranged in a single circle. In one example, adjacent electrical contact pads 142 are separated from each other by a radially-oriented space 146. In one example, electrical contact pads 142 are spaced at regular intervals from each other around the circle. Since all of the electrical contact pads 142 are provided on front end 122*b*, electrical contact pads 142 are all located in the same plane. This configuration of electrical contact pads 142 is suitable for a nose approach to forming the mechanical and electrical interfaces between fuze setter station 116 and fuze 118.

Placing electrical contact pads 142 on front end 122*b* of radome housing 22 may obscure a HoB sensor radar transmitter provided in radome housing 122. However, this potential obscuration of a HoB sensor is at least somewhat offset by front end 122*b* being an aerodynamic stagnation point on the projectile. Additionally, front end 122*b* of radome housing 122 tends to have the highest aerodynamic heating temperature and this potentially will cause electrical contact pads 142 to melt off radome housing 122 during flight of the guided projectile. The melting of the electrical contact pads 142 will remove the obscuring effect on the HoB sensor. In order to help ensure the electrical contact pads 142 are removed during flight, it is possible to utilize a low melting point alloy for electrical contact pads 142 or utilize low temperature adhesives to bond electrical contact pad 142 to radome housing 122. Aerodynamic wind forces can also help to remove the electrical contact pads 142 during flight, possibly in conjunction with the effects of aerodynamic heating on the electrical contact pads 142.

FIGS. 6A and 6C show fuze setter station 116 includes a wall 116*a* defining an opening to a port 116*b*. Sidewall 116*c* and front wall 116*d* bound and define port 116*b*. Port 116*b* is complementary to the region of radome housing 122 that is receivable in port 116*b*. A plurality of electrical contact pins 148 is provided on front wall 116*d* of fuze setter station 116. Electrical contact pins 148 are arranged in a pattern complementary to the pattern of electrical contact pads 142 on front end 122*b* of radome housing 122. In one example, there is a one-to-one ratio between electrical contact pads 142 and electrical contact pins 148. In one example, electrical contact pins 148 are arranged in a circular pattern. In one example, electrical contact pins 148 are spaced at regular intervals from each other around the circle. In one example, adjacent electrical contact pins 148 are separated from each other by a space 150 or a section of front wall 116*d*. In one example, space 150 extends radially between adjacent electrical contact pins 148. Since all of the electrical contact pins 148 are provided on front wall 116*d*, the electrical contact pins 148 are all located in the same plane. Electrical contact pins 148 are located in positions sufficiently complementary to the placement of electrical contact pads 142 on radome housing 122 that an electrical interface is formed between electrical contact pins 148 and electrical contact pads 142 when fuze 112 is inserted into port 116*b* of fuze setter station 116.

The provision of the discrete electrical contact pads 142 is suitable for a signal commutation (or electrical commutation) option of orienting the fuze 118 relative to the fuze setter station 116 by rotating the signals from the fuze setter station 116 instead of physically rotating the fuze 118.

Figure 6D:
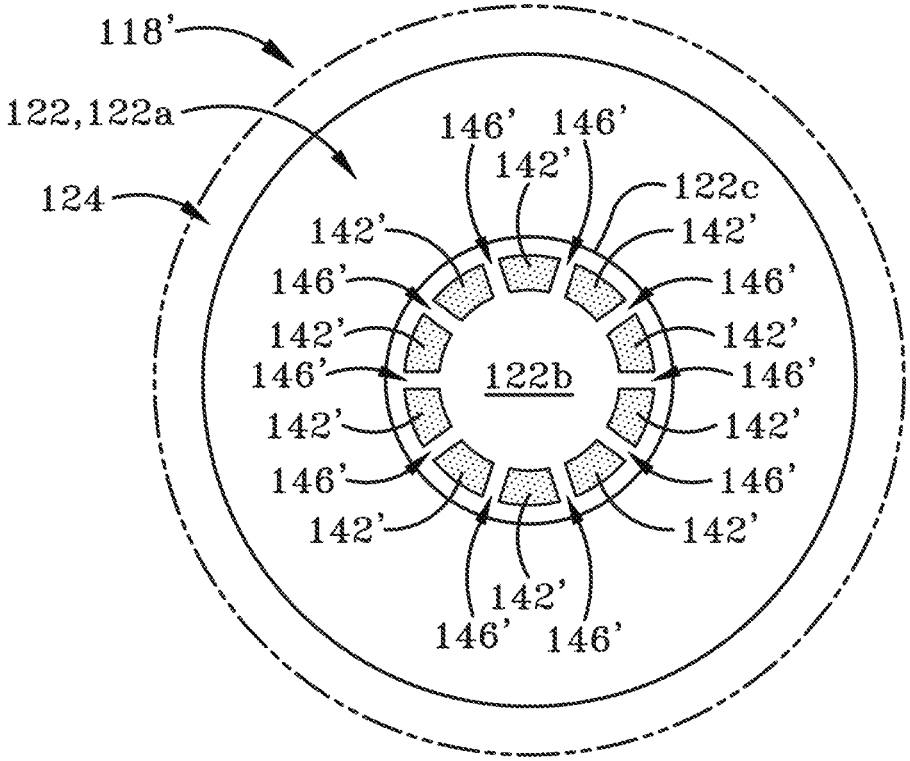
FIG. 6D is a front end elevation view of the radome housing showing a second configuration of ten electrical contact pads provided on the front end of the radome housing.

FIG. 6D is a front end elevation view of the radome housing of a fuze 118' showing a second configuration of electrical contact pads provided on the front end 122*b* of the radome housing 122. Fuze 118' is substantially identical to fuze 118 except that instead of having eight electrical contact pads 142 provided on front end 122*b*, fuze 118' has ten electrical contact pads 142' provided on front end 122*b*. (It will be understood that the wiring within fuze 118' will differ from the wiring in fuze 118 because of the additional electrical contact pads 142'.) Adjacent electrical contact pads 142' on front end 112*b* are separated from each other by a space 146' or by a section of front end 122*b*. Electrical contact pads 142' are arranged in a rotationally symmetric pattern.

It will be understood that a fuze setter that is to engage fuze 118' will be provided with a sufficient number of electrical contacts (e.g. electrical contact pins) to engage electrical contact pads 142'. In one example, the fuze setter that is to engage fuze 118' will have twenty electrical contact pins 148 that are arranged in a complementary location and configuration to engage electrical contact pads 142'. In other examples, the fuze setter that is to engage fuze 118' may have fewer or more than twenty electrical contact pins 148 to engage electrical contact pads 142'. Whatever the number of electrical contact pins 148 on the fuze setter, the electrical contact pins 148 will be arranged to be complementary to the electrical contact pads 142' and be configured to communicate therewith.

The electrical contact pads 142' on fuze 18' comprise two electrical contacts for a loopback resistor, two power/ground contacts, two TMI contacts and four contacts for communications. (Fuze 18' includes only one loopback resistor. Signals from the two electrical leads or contacts from the loopback resistor are assigned to two of the electrical contact pads in the fuze.) The loopback resistor contacts are provided so that the complementary fuze setter will be able to sense the loopback resistor within fuze 118' which is electrically connected between the two loopback resistor contacts, and therefore will be able to determine if the fuze setter is connected to fuze 118'. The power/ground contacts include one contact each for input power and ground return current. The two TMI contacts provide GPS time mark indication to fuze 118'. The four communications contacts enable full duplex serial communications between fuze 118' and a complementary fuze setter. (Fuze 118 shown in FIGS. 6A-6C includes only two communications contacts instead of four communications contacts. Apart from the increased number of communications contacts, all other electrical contacts 142' and 142 in fuzes 118' and 118 are the same as the electrical contacts 42 in fuze 18.

In one example, less than eight electrical contact pads 142 may be provided on the fuze 118. In one example, more than eight electrical contact pads 142 may be provided on the fuze 118. Whatever the number of electrical contact pads 142 provided on the fuze 118, the mating fuze setter will include a complementary number of electrical contact pins 148. It will be understood that all electrical contact pads 142 on the fuze 118 and mating electrical contact pins 148 on the fuze setter 116 will be sized appropriately.

Figure 7A:
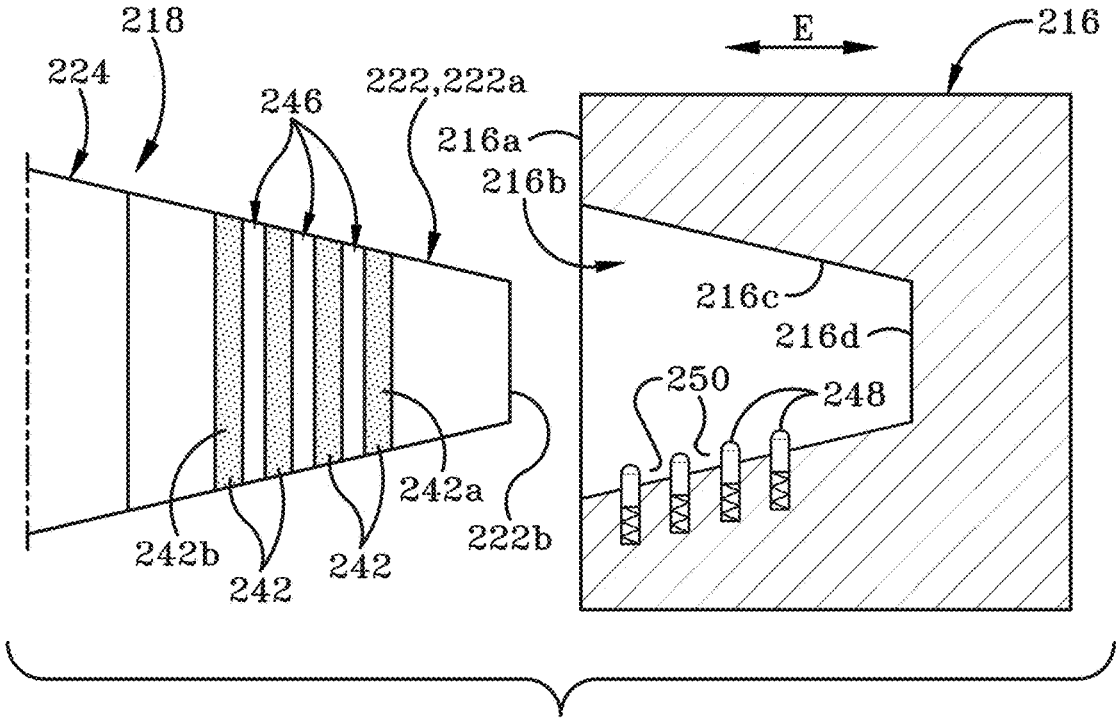
FIG. 7A is a side elevation view of a fuze radome housing showing a third embodiment of an electrical contact pad configuration on the sidewall of the radome housing, and showing the radome housing positioned adjacent a fuze setter station that includes a complementary set of electrical contact pins.
Figure 7B:
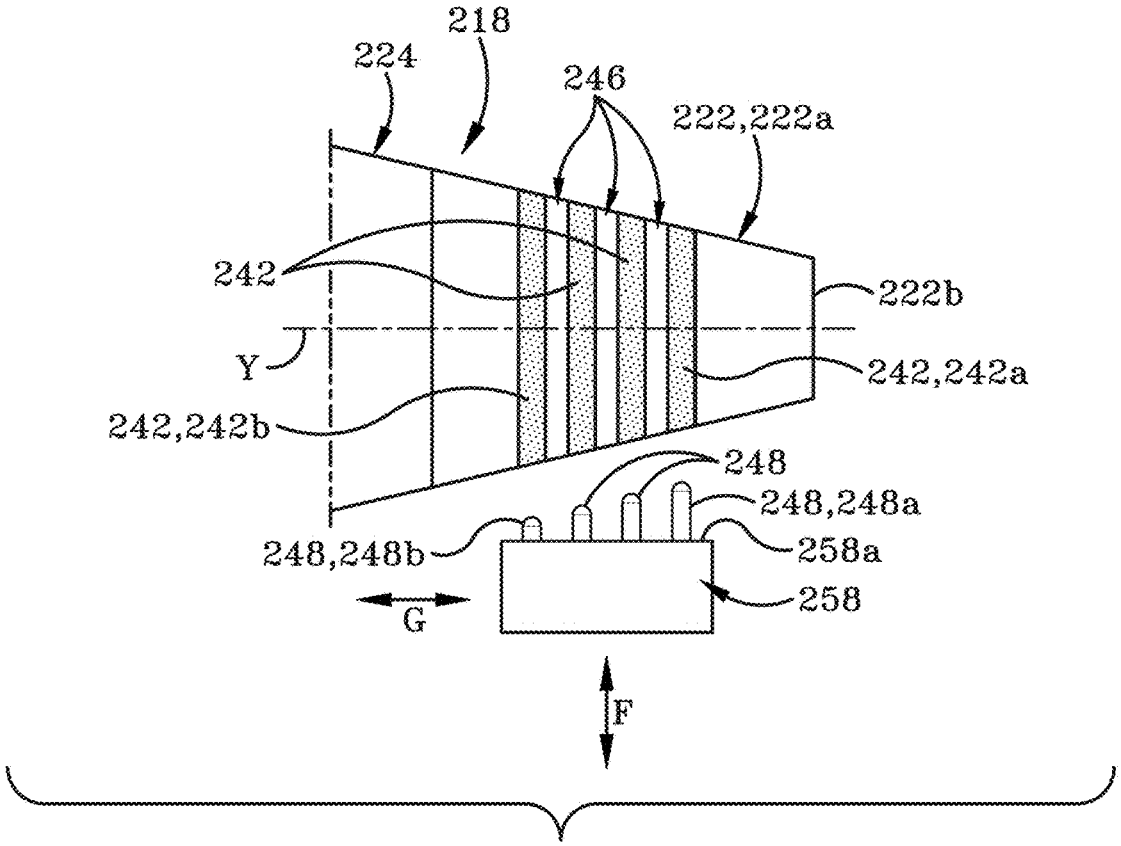
FIG. 7B is a side elevation view of a fuze radome housing showing the third embodiment of the electrical contact pad configuration on the sidewall of the radome housing, and showing the radome housing positioned adjacent to a programming block of a fuze setter.

Referring to FIGS. 7A and 7B, there is shown a third embodiment of a fuze setter system that may be utilized to form an electrical interface between a fuze 218 and a fuze setter station 216. Fuze 218 includes a radome housing 222 and a fuze body 224. In accordance with the present disclosure, fuze 218 includes a third embodiment of an electric contact arrangement and fuze setter station 216 includes a complementary electric contact arrangement. The third embodiment electric contact arrangements of fuze 218 and fuze setter station 216 form a third embodiment electrical interface between fuze 218 and fuze setter station 216. This electrical interface enables power and/or data to be transferred from fuze setter station 216 to fuze 218 during a fuze setting operation.

Radome housing 222 includes a sidewall 222*a* and a front end 222*b*. A plurality of electrical contact pads 242 is provided on sidewall 222*a*. Electrical contact pads 242 are substantially identical in structure and function to electrical contact pads 42, 142 except that the shape and placement of electrical contact pads 242 differs from the shape and placement of electrical contact pads 42 and 142.

Each electrical contact pad 242 comprises a circular ring or band that extends circumferentially around the exterior surface of sidewall 222*a*. Because each electrical contact pad 242 is circular, the pad is rotationally symmetric. The circular bands or rings are concentric and are longitudinally spaced from each other. Because sidewall 222*a* tapers toward front end 222*b*, the electrical contact pad 242*a* closest to front end 222*b* is of the smallest diameter while the electrical contact pad 242*b* that is closest to fuze body 224 is of the greatest diameter. The electrical contact pads 242 between electrical contact pad 242*a* and 242*b* progressively increase in diameter. In one example, electrical contact pads 242 are spaced at regular intervals from each other along sidewall 222*a*. In one example, adjacent electrical contact pads 242 are separated from each other by a circumferential space 246 or a circumferential section of sidewall 222*a*.

In one example, a plurality of spaced-apart concentric grooves may be defined in sidewall 222*a* of radome housing 222. A complementary circular electrical contact pad 242 may be received in each groove. In one example, the outer surface of the electrical contact pad 242 may be slightly recessed relative to a remaining portion of sidewall 222*a* of radome housing 222. In one example, eight grooves and complementary electrical contact pads 242 may be provided on radome housing 222. Each electrical contact pad 242 may be about 0.08 inches wide by about 0.03 inches thick. A dielectric material may separate electrical contact pads 242 from each other.

Referring to FIG. 7A, fuze setter station 216 has a wall 216*a* that defines an opening to a port 216*b* which is bounded and defined by a sidewall 216*c* and front wall 216*d*. Fuze setter station 216 includes a plurality of electrical contact pins 248 that are capable of extending outwardly from sidewall 216*c* and into port 216*b*. Sidewall 216*c* of fuze setter station 216 is complementary to sidewall 222*a* of fuze 222 and each electrical contact pin 248 may extend outwardly from sidewall 216*c* to substantially the same extent so as to be able to engage electrical contact pads 242. In one example, electrical contact pins 248 are located at regular intervals from each other along sidewall 216*c*. In one example, adjacent electrical contact pins 248 are separated from each other by a space 250 or by a section of sidewall 216*c*. The placement of electrical contact pins 248 corresponds substantially with the placement of electrical contact pads 242 of fuze 218 such that when fuze 218 is inserted into port 216*b*, each electrical contact pin 248 will contact one of the electrical contact pads 242. Electrical contact pads 242 and electrical contact pins 248 form an electrical interface that permits power and/or data to transfer from fuze setter station 216 to fuze 218.

Fuze 218 may be moved toward fuze setter station 216 to insert radome housing 222 into port 216*b* in order to perform a fuze setting operation. Fuze 218 may be moved away from fuze setter station 216 to remove radome housing 222 from port 216*b* once fuze setting has occurred. Alternatively, fuze setter station 216 may be moved toward fuze 218 to perform a fuze setting operation and may be moved away from fuze 218 once fuze setting has occurred. In one example, the fuze 218 and fuze setter station 216 may both be moved toward each other to perform a fuze setting operation and one or both may be moved away from each other after fuze setting has occurred. The relative movement between fuze 218 and fuze setter station 216 is indicated by arrow "E" in FIG. 7A.

FIG. 7B shows and alternative arrangement of forming an electrical and mechanical interface with fuze 218. A programming block 258 is provided for engagement with fuze 218. This type of engagement approach may be referred to herein as a "side approach" and tends to be compatible only with a direct contact approach. Programming block 258 includes a plurality of axially aligned spring electrical contact pins 248 that extend outwardly from a surface 258*a* of block 258. Surface 258*a* may be oriented generally parallel to longitudinal axis "Y" of fuze 218. Programming block 258 differs from programming blocks 54 and 56 disclosed previously herein in that, in one example, the plurality of electrical contact pins 248 extend outwardly from surface 258*a* to different degrees. A first electrical contact pin 248*a* extends outwardly from surface 258*a* to a greater extent than the remaining electrical contact pins. A second electrical contact pin 248*b* extends outwardly from surface 258*a* to a lesser extent than the remaining electrical contact pins. The plurality of electrical contact pins 248 gradually decrease in height relative to surface 258*a* from first electrical contact pin 248*a* to second electrical contact pin 248*b*. The differences in the height of the electrical contact pins 248 ensures that each electrical contact pin 248 will contact one of the electrical contact pads 242 even though radome housing 222 tapers from fuze body 224 to front end 222*b*.

FIG. 7B indicates that programming block 258 is movable in a direction oriented at right angles to longitudinal axis "Y" of radome housing 222. In other words, programming block 258 is movable laterally toward and away from radome housing 222 as indicated by arrow "F" in order to move electrical contact pins 248 into engagement with electrical contact pads 242 and out of engagement with electrical contact pads 242. Programming block 258 is selectively movable relative to radome housing 222 in a direction substantially parallel to longitudinal axis "Y" in order to ensure electrical contact pins 248 are able to align and engage with electrical contact pads 242. This longitudinal movement is indicated by arrow "G". In one example, fuze 218 may be moved relative to programming block 258 in one or both of the directions indicated by arrows "F" and "G". Programming block 258 is mechanically aligned to electrical contact pads 242 on radome housing 222. Radome housing 222 is initially in an arbitrary rotational orientation relative to programming block 258. Each band 242 on radome housing 222 is assigned to a specific signal and each band 242 is contacted by a single electrical contact pin 248. As indicated above, this side approach of forming the electrical interface between fuze setter 216 and fuze 218 is limited to working only with a direct electrical contact pin configuration on one side of radome housing. The side approach may not work well for manual fuze setting as it is somewhat more complex to mechanically align and secure the radome housing 222 during programming. Providing electrical contact pads 242 on sidewall 222*a* may tend to reduce an amount of copper in front of any HoB antenna that might be provided in radome housing 222 so the signals from the antenna will not be obscured by electrical contact pads 242. The electrical contact pads 242 are typically made of copper (although any suitably electrically conducting material will suffice). These electrical contact pads 242, being electrically conductive, can obscure the signals emanating from the HoB sensor. Thus, locating the electrical contact pads 242 on the sidewall 222 moves the electrical contact pads out of the radiated field pattern of the HoB sensor antenna thus avoiding (or at least minimizing) obscuration of the HoB sensor signal. At least the amount of obscuration may be minimized by locating the electrical contact pads on the side wall.

In one example, instead of the surface 258*a* of programming block 258 being oriented substantially parallel to longitudinal axis "Y" of fuze 218, surface 258*a* of programming block 258 may, instead, be angled to match the taper of sidewall 222*a* of radome housing 222. When surface 258*a* is angled to match the taper of sidewall 222*a*, electrical contact pins 248 may extend outwardly from the surface 258*a* to substantially the same extent.

In one example, localized contact grooves are formed in sidewall 222*a* of radome housing 222. In one example, the grooves are defined in side wall in four locations about the circumference of sidewall 222*a* with the locations being spaced every ninety degrees from each other. In one example, an electrical contact pad 242 is seated in each of the contact grooves. In one example, eight grooves are defined in sidewall 222*a* and one complementary electrical contact pad 242 is seated in each groove. In one example, the electrical contact pad 242 is about 0.08 inches wide by 0.03 inches thick. A dielectric material may separate electrical contact pads 242 from each other.

Figure 8A:
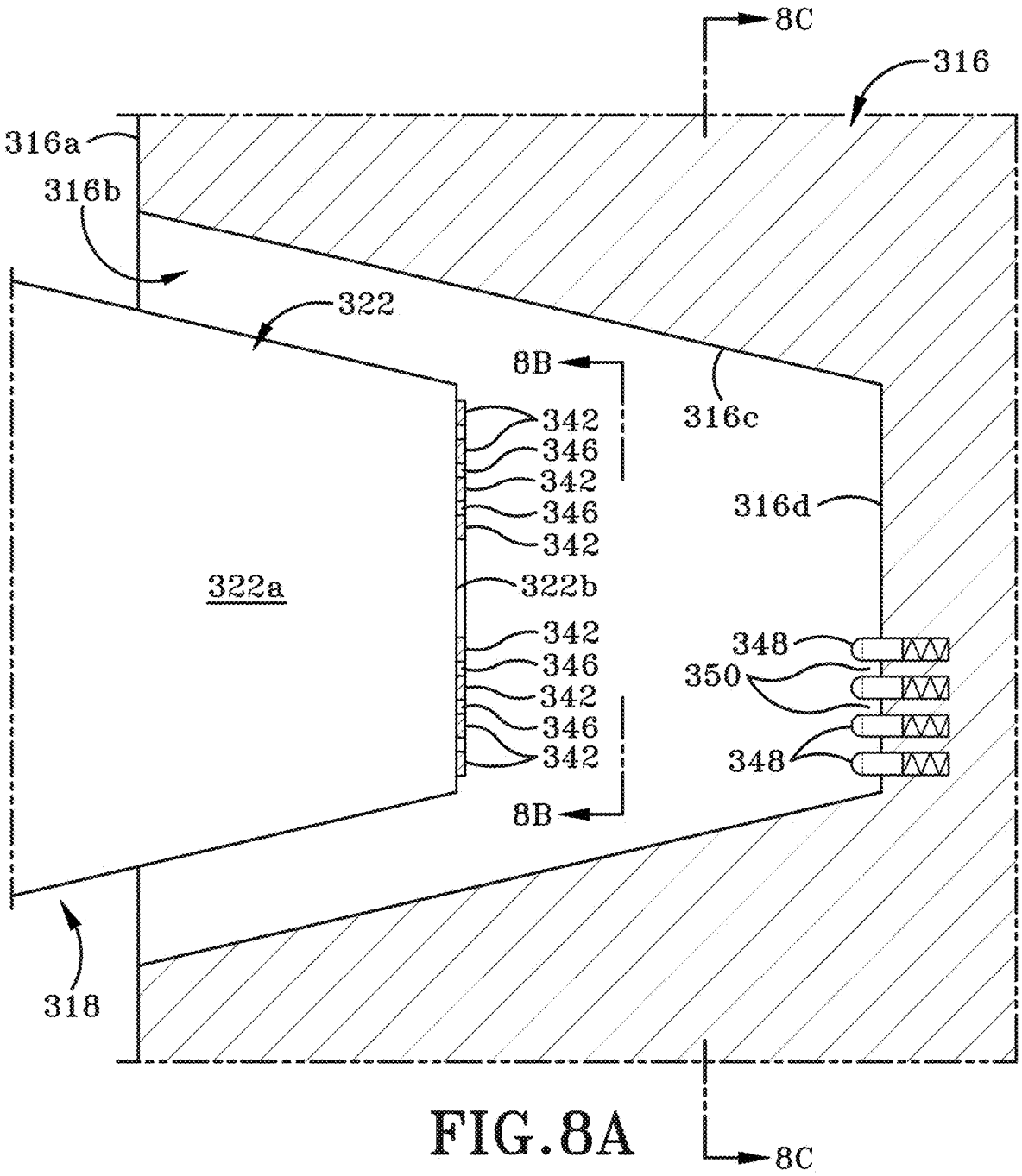
FIG. 8A shows a side elevation view of a fuze radome housing showing a fourth embodiment of an electrical contact pad configuration on the nose of the radome housing, and showing the radome housing positioned partially inserted into a fuze setter station having a complementary set of electrical contact pins.
Figure 8B:
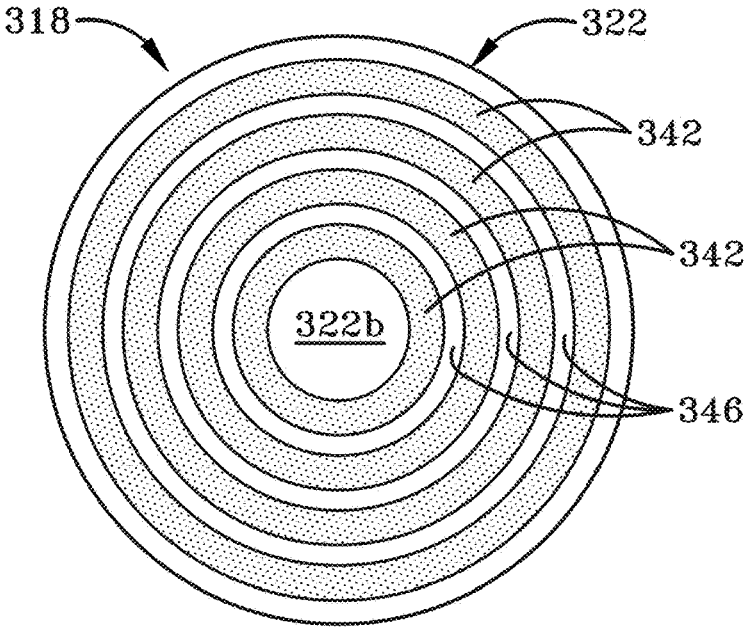
FIG. 8B is a front end elevation view of the fuze radome housing taken along line 8B-8B of FIG. 8A.
Figure 8C:
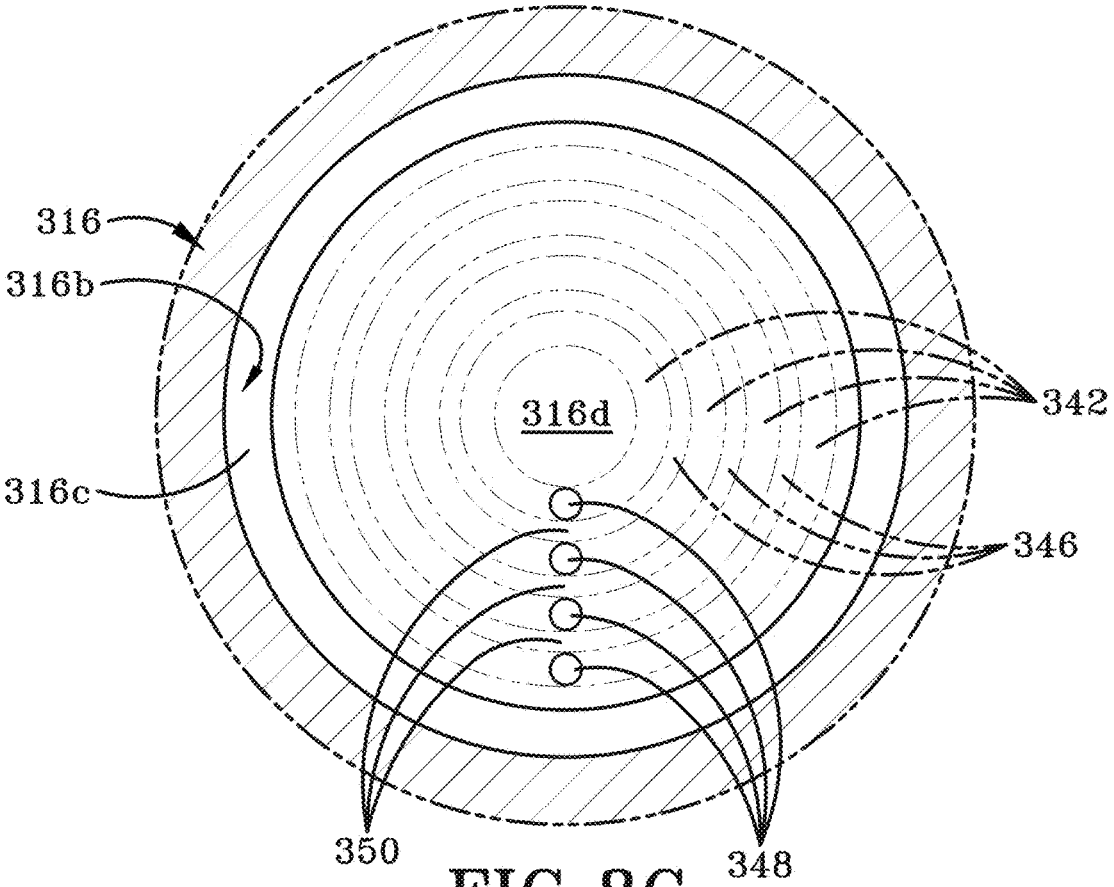
FIG. 8C is a rear end elevation view of part of the fuze setter station taken along line 8C-8C of FIG. 8A.

Referring now to FIGS. 8A to 8C, there is shown a fourth embodiment of a fuze setter system that may be utilized to form an electrical interface between a fuze 318 and a fuze setter station 316. Fuze 318 includes a radome housing 222 that includes a fourth embodiment of an electric contact arrangement. Fuze setter station 316 includes a complementary electric contact arrangement to that of fuze 318. The fourth embodiment electric contact arrangements of fuze 318 and fuze setter station 316 form a fourth embodiment electrical interface between fuze 318 and fuze setter station 316. This electrical interface enables power and/or data to be transferred from fuze setter station 316 to fuze 318 during a fuze setting operation.

FIG. 8A shows a portion of the radome housing 322 of fuze 318. Radome housing 322 includes a sidewall 322*a* and a front end 322*b*. A plurality of electrical contact pads 342 is provided on front end 322*b*. Electrical contact pads 342 are substantially identical in structure and function to electrical contact pads 42 except for their shape and placement on radome housing 322. FIG. 8B shows that, in one example, each of the electrical contact pads 342 is generally circular in shape and that the plurality of electrical contact pads 342 is arranged in a plurality of concentric circles on front end 322*b*. In one example, adjacent electrical contact pads 342 are separated from each other by a space 346. Since all of the electrical contact pads 342 are on front end 322*b*, electrical contact pads 342 are all arranged in the same plane. Each concentric ring (i.e., each electrical contact pad 342) may correspond to a particular electrical signal. This arrangement of electrical contact pads 342 may be rotationally symmetric, requiring no specific rotational orientation or fuze 318 in fuze setter station 316. This configuration requires a radial arrangement of the electrical contact pins on the fuze setter 312 as described below.

FIG. 8A also shows that fuze setter station 116 includes a wall 316*a* defining an opening to a port 316*b*. A sidewall 316*c* and a front wall 316*d* bound and define port 316*b*. Port 116*b* is complementary to the region of radome housing 122 that is receivable into port 116*b*. A plurality of electrical contact pins 348 extend outwardly from front wall 316*d* of fuze setter station 316 and into port 316*b*. In one example, one electrical contact pin 348 is provided for each one of the electrical contact pads 342. In other words, in one example there is a one-to-one ratio between electrical contact pads 342 and electrical contact pins 348. Since all of the electrical contact pins 348 are provided on front wall 316*d* of fuze setter station 316, all of the electrical contact pins 348 are located in the same plane.

FIGS. 8A and 8C show that each electrical contact pin 348 is located in a position complementary to one of the electrical contact pads 342. FIG. 8C shows in phantom the positions that the various electrical contact pads 342 may assume relative to electrical contact pins 348 when fuze 318 is inserted into port 316*b*. In one example, adjacent electrical contact pins 348 are separated from each other by a space 350 or by a section of front wall 316*d*. In one example, electrical contact pins 348 are radially aligned with each other (as shown in FIG. 8C). In other examples, electrical contact pins 348 may not be radially aligned with each other. In other examples, each electrical contact pin 348 is located anywhere on the front wall 316*d* that will permit that individual electrical contact pin 348 to align with and contact an associated one of the circular electrical contact pads 342. When contact is made between electrical contact pads 342 and electrical contact pins 348, the electrical interface is formed and power and/or data may be transferred between fuze setter station 316 and fuze 318 via this interface.

The continuous concentric ring electrical contact pads 342 provided on front end 222*b* of radome housing 222 as in FIG. 8B permit a nose approach of setting up electrical and mechanical interfaces between fuze setter station 316 and fuze 318. Each electrical contact pad 342 (i.e., each ring) is utilized for one signal. There is a limit to the width of each ring based on the geometry constraints. Because the ring configuration of electrical contact pads 342 is rotationally symmetric, no specific orientation of fuze 218 in fuze setter 216 is required.

Figure 9A:
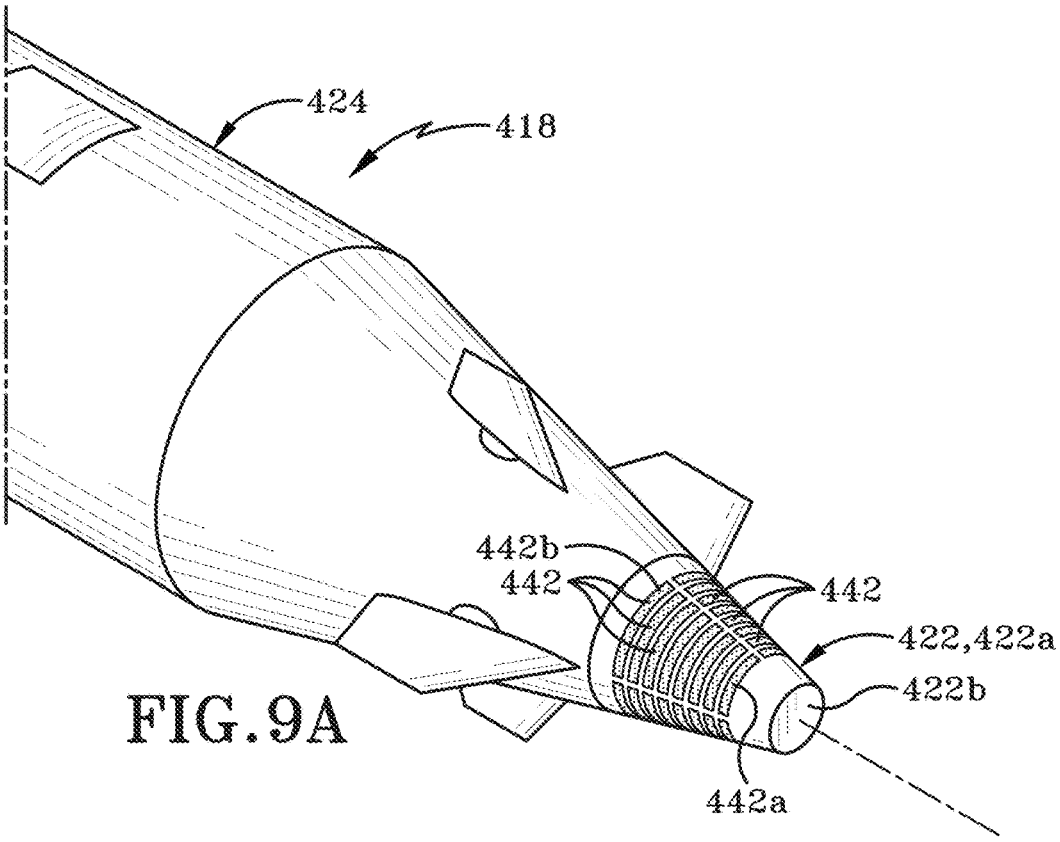
FIG. 9A is a front perspective view of fuze radome housing showing a fifth embodiment of an electrical contact pad configuration on the sidewall thereof.
Figure 9B:
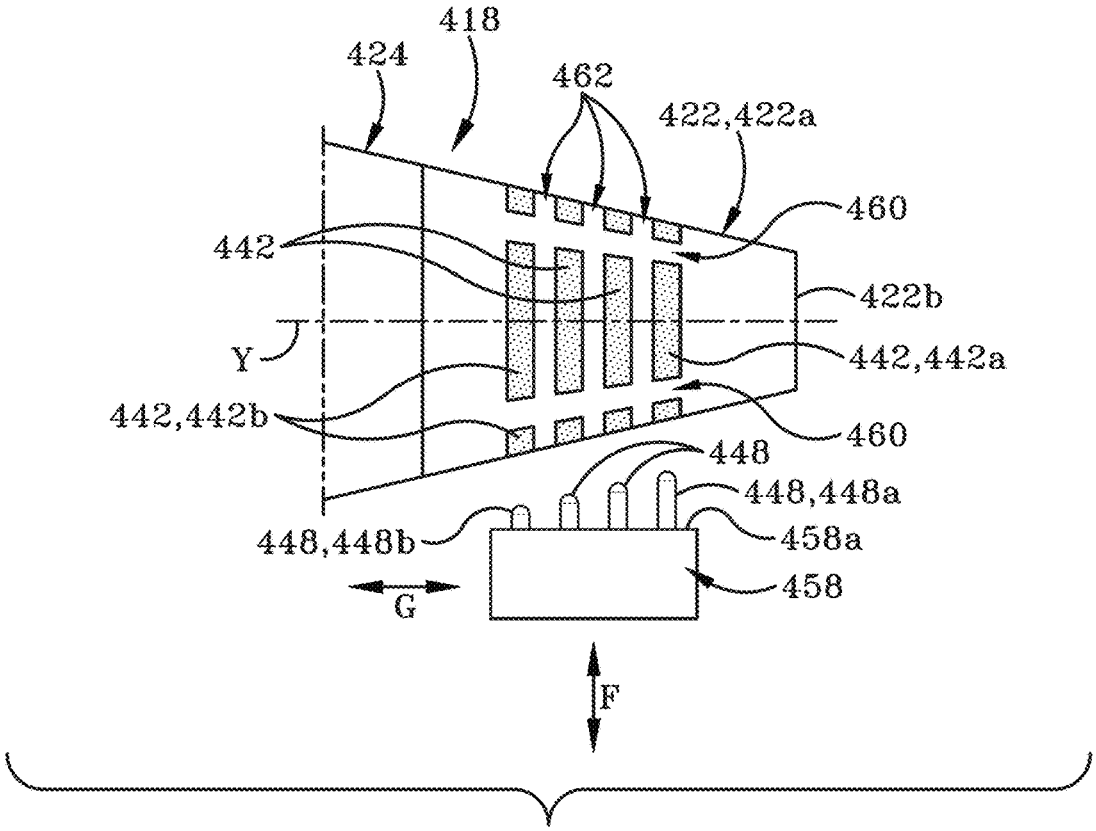
FIG. 9B is a side elevation view of the fuze radome housing of FIG. 9A showing an alternative fifth embodiment of the electrical contact pad configuration on the sidewall of the radome housing; and showing a programming block of a fuze setter adjacent to the radome housing.

Referring to FIGS. 9A and 9B, there is shown a fifth embodiment of a fuze setter system that may be utilized to form an electrical interface between a fuze and a fuze setter. Fuze 418 includes a radome housing 422 and a fuze body 424. Radome housing 422 includes a sidewall 422*a* and a front end 422*b*. FIG. 9B shows a programming block 458 that forms part of the fuze setter. Programming block 458 may be similar in structure and function to programming block 258 (FIG. 7B). In one example, more than one programming block 458 is selectively brought into engagement with fuze 418. In other examples, the fuze setter includes a fuze setter station that is substantially similar in structure and function to fuze setter station 216 shown in FIG. 7A.

In accordance with the present disclosure, fuze 418 includes a fifth embodiment of an electric contact arrangement and the fuze setter programming block 458 includes a complementary electric contact arrangement. The fifth embodiment electric contact arrangements of fuze 418 and programming block 458 form a fifth embodiment electrical interface between fuze 418 and programming block 458. This electrical interface enables power and/or data to be transferred from programming block 458 to fuze 418 during a fuze setting operation.

FIGS. 9A and 9B show a plurality of segmented electrical contact pads 442 provided on sidewall 422*a* of fuze 418. The provision of segmented electrical contact pads 442 reduces the ability (or tendency) of the loop to function as an antenna. A complete loop or band on radome housing 422 may pick up unwanted electromagnetic interference that may be present in the ambient environment. Segmenting the loop into discrete electrical contact pads 442 that are spaced from each other can reduce the ability of the electrical contact pads to function as an antenna.

The discrete electrical contact pads 442 are arranged in a plurality of concentric rings or bands around the circumference of sidewall 422*a*. As a result, electrical contact pads 442 are arranged in a rotationally symmetric fashion. Each concentric ring of electrical contact pads 442 is oriented generally at right angles to a longitudinal axis "Y" of fuze 418. Each of the rings of electrical contact pads 442 is segmented and includes two or more electrical contact pads arranged in the same vertical plane when radome housing 422 is viewed from the side as in FIG. 9B. Adjacent electrical contact pads 442 in each ring may be circumferentially separated from each other by a space 460 or by a section of sidewall 422*a*. Adjacent concentric rings of electrical contact pads 442 may be separated from each other by a concentric space 462. The ring of electrical contact pads 442 closest to front end 422*b* is of a smaller diameter than the ring of electrical contact pads 442 that is closest to fuze body 424. The number of concentric rings of electrical contact pads 442 may differ from one fuze 418 to another. By way of example only, FIG. 9A shows a fuze 418 having eight concentric rings of electrical contact pads 442 and FIG. 9B shows a fuze 418 having four concentric rings of electrical contact pads 442. Each ring may have multiple individual segments or electrical contact pads 442.

FIGS. 9A and 9B show multiple segmented bands of electrical contact pads 442, with one band of electrical contact pads being utilized per signal. One electrical contact is required per electrical contact pad segment in a band. FIG. 9A shows eight bands and there are four segments (pads 442) in each band. Consequently, this configuration would require thirty-two interconnects. The increased electronic complexity of the fuze 418 tends to simplify the electrical and mechanical interfaces for the fuze setter that will be used to program fuze 418. In one example, two or more segments can be combined into one continuous band to reduce interconnect complexity if inductive and antenna effects can be tolerated.

The location of electrical contact pads 442 on sidewall 422*a* of radome housing 422 tends to avoid HoB Sensor transmitter obscuration. Since these electrical contact pads 442 are closer to bottom of radome housing 422 there is a shorter electrical path length to electronics and the segmented contact band configuration tends to reduce inductive/antenna effects of individual contact bands. Additionally, the use of rotationally symmetric contact bands avoids the need to rotationally align the fuze 418 to a fuze setter. The configuration is compatible with the nose approach of engaging the fuze 418 with a fuze setter station that includes a programming cup or port. The configuration is also compatible with software upgrade programming while fuze 418 (or the associated projectile) is packaged in a storage container. (It will be understood that the other embodiments disclosed herein that are suitable for a nose approach of engagement between the fuze and fuze setter are similarly compatible with software upgrade programming when the fuze or projectile is packaged in a storage container.)

FIG. 9B shows a programming block 458 that may be brought into contact with fuze 418 instead of a fuze setter station that includes a programming cup or port. Programming block 458 includes a plurality of electrical contact pins 448 that extend outwardly from an interior surface 458*a* of block 458. Surface 458*a* may be oriented generally parallel to the longitudinal axis "Y" of fuze 418. Programming block 458 is substantially similar in structure and function to programming block 258 (FIG. 7B). In other words, a first electrical contact pin 448*a* extends outwardly from surface 458*a* to a greater extent than the remaining electrical contact pins and a second electrical contact pin 448*b* extends outwardly from surface 458*b* to a lesser extent than the remaining electrical contact pins. The plurality of electrical contact pins 448 gradually decrease in height relative to surface 458*a* from first electrical contact pin 448*a* to second electrical contact pin 448*b*. The differences in the height of the electrical contact pins 448 ensures that each electrical contact pin 448 will contact one of the electrical contact pads 442 even though radome housing 422 tapers from fuze body 424 to front end 422*b*.

FIG. 9B shows that programming block 458 is selectively movable toward and away from radome housing 422 as indicated by arrow "F" in a similar manner to the way programming block 258 is movable. Programming block 458 is further movable longitudinally relative to fuze 418 as indicated by arrow "G" and in a similar fashion to the movement of programming block 258. This longitudinal adjustability helps to ensure alignment and contact of electrical contact pins 448 with electrical contact pads 442. In one example, programming block 458 may be moved relative to fuze 418 in one or both directions indicated by arrows "F" and "G".

In one example, instead of the surface 458*a* of programming block 458 being oriented substantially parallel to longitudinal axis "Y" of fuze 418, surface 458*a* of programming block 458 may, instead, be angled to match the taper of sidewall 422*a* of radome housing 422. When surface 458*a* is angled to match the taper of sidewall 422*a*, electrical contact pins 448 may extend outwardly from the surface 458*a* to substantially the same extent.

Segmented electrical contact pads 442 as in FIGS. 9A and 9B help to avoid possible inductive and/or antenna effects associated with using a full loop electric contact. For each segmented ring (such as ring 442*b*), two electrical contact pins 448 may be required in the programming block 458. The two electrical contact pins are separated by a distance greater than a gap width between adjacent electrical contact pads in the same ring i.e., greater than the space 460. This helps to ensure that at least one of the two electrical contact pins 448 makes contact with electrical contact pad 442.

Figure 10A:
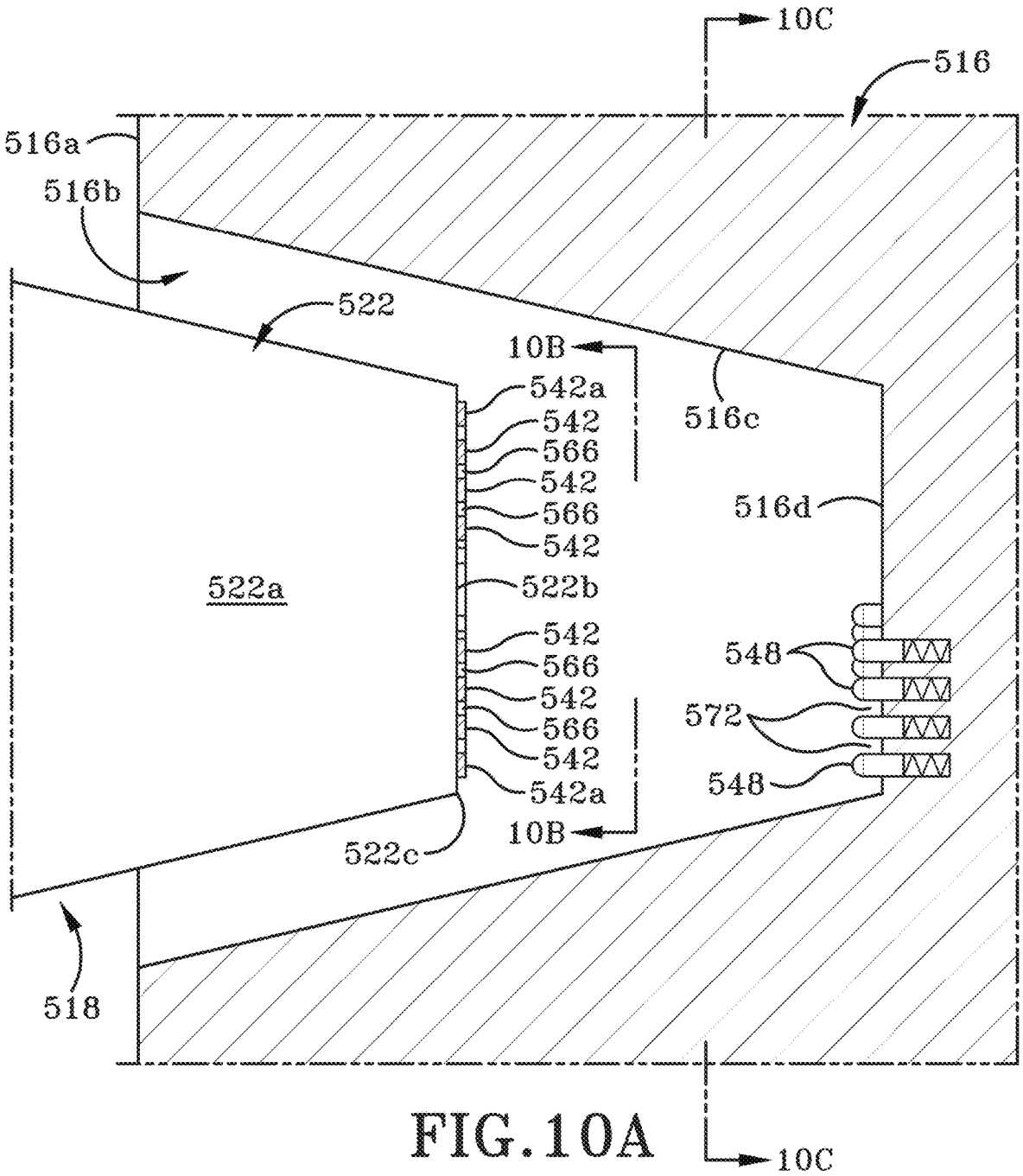
FIG. 10A shows a side elevation view of a fuze radome housing showing a sixth embodiment of an electrical contact pad configuration on the nose of the fuze, and showing the radome housing positioned partially inserted into a fuze setter station having a complementary set of electrical contact pins.
Figure 10B:
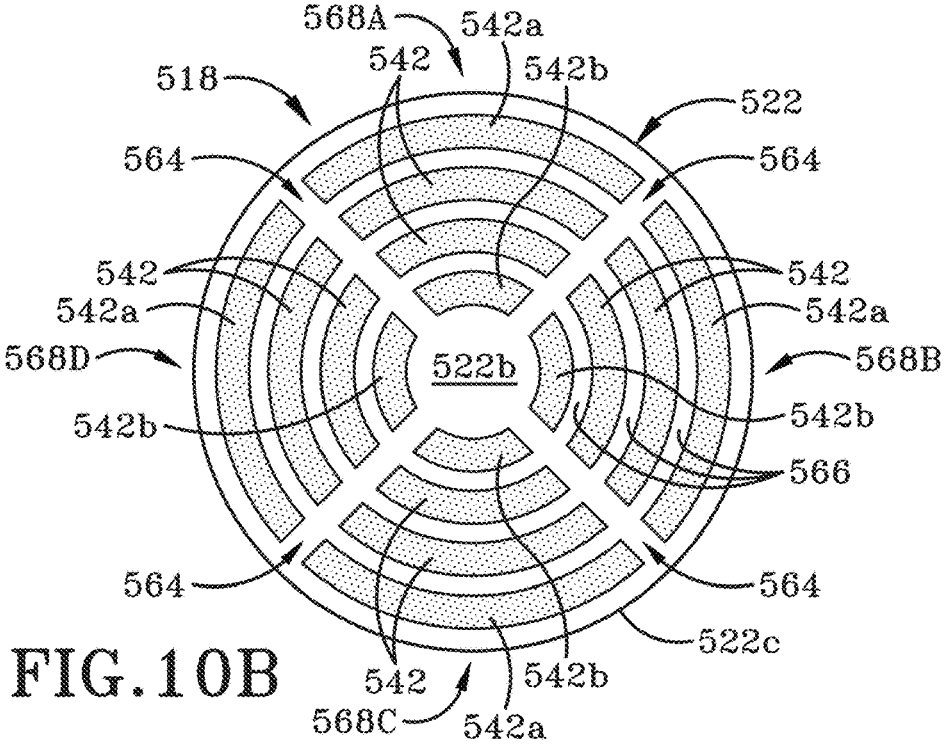
FIG. 10B is a front end elevation view of the fuze radome housing taken along line 10B-10B of FIG. 10A.
Figure 10C:
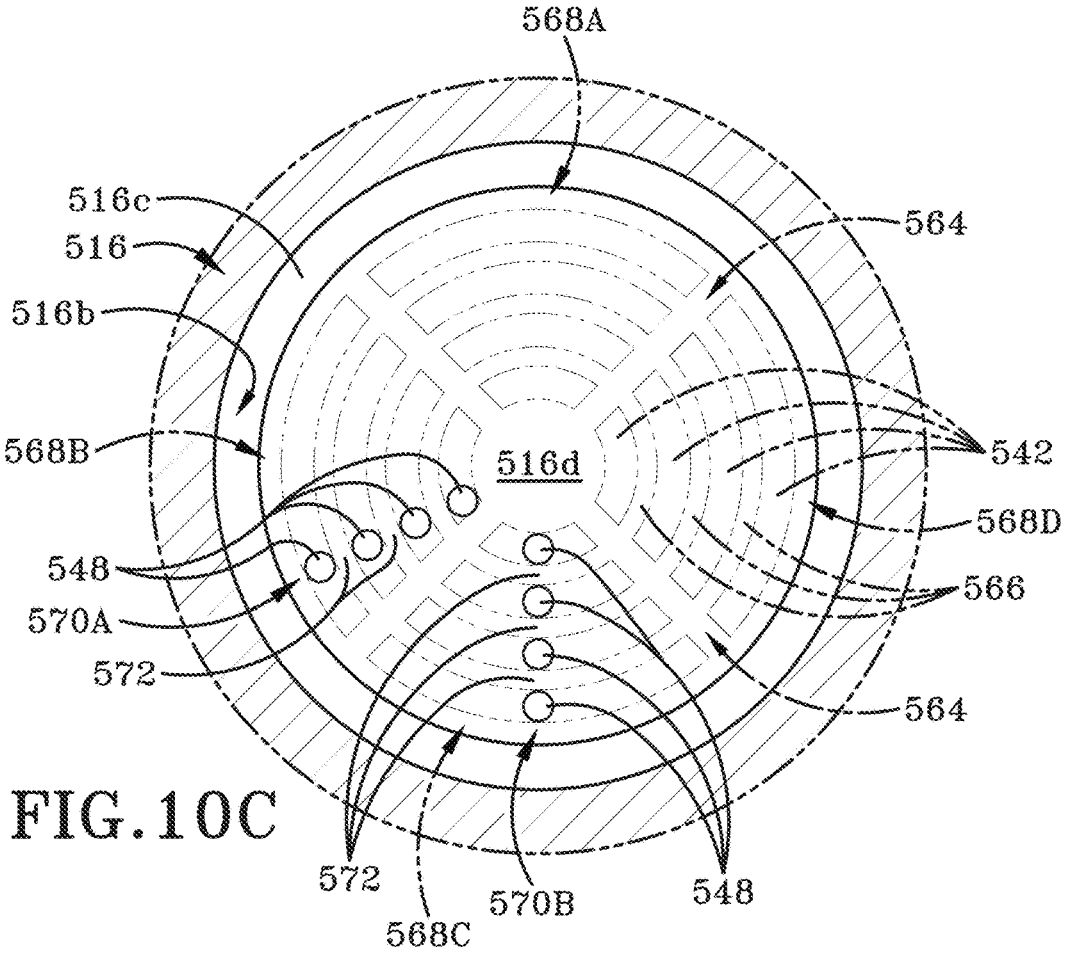
FIG. 10C is a rear end elevation view of part of the fuze setter station taken along line 10C-10C of FIG. 10A.

Referring to FIGS. 10A to 10C, there is shown a sixth embodiment of a fuze setter system that may be utilized to form an electrical interface between a fuze 518 and a fuze setter station 516 of a fuze setter. Fuze 518 includes a radome housing 522 at a leading end thereof. Radome housing 522 includes a sidewall 522*a* and a front end 522*b*. FIG. 10A shows fuze setter station 516 that includes a wall 516*a* which defines an opening into a port 516*b*. A sidewall 516*c* and front wall 516*d* bound and define the port 516*b*.

In accordance with the present disclosure, fuze 518 includes a sixth embodiment of an electric contact arrangement and the fuze setter station 516 includes a complementary electric contact arrangement. The sixth embodiment electric contact arrangements of fuze 518 and fuze setter station 516 form a sixth embodiment electrical interface between fuze 518 and fuze setter station 516. This electrical interface enables power and/or data to be transferred from fuze setter station 516 to fuze 518 during a fuze setting operation.

FIG. 10B shows front end 522*b* of radome housing 522. A plurality of electrical contact pads 542 is provided on front end 522*b*. Electrical contact pads 542 are arranged in segmented concentric circles and the pattern of electrical contact pads 542 is rotationally symmetric. In one example, adjacent electrical contact pads 542 in the same circle are separated from each other by a radially oriented space 564 or by a section of front end 522*b*. Adjacent segmented circles of electrical contact pads 542 are separated from each other by a circular space 566 or a section of front end 522*b*. Electrical contact pads 542*a* closest to edge 522*c* are of a greater diameter than the electrical contact pads 542*b* that are closest to a central region of front end 522*b*. Since all of the electrical contact pads 542 are on front end 522*b* of radome housing 522, electrical contact pads 542 are all arranged in the same plane.

FIG. 10B shows that the segmented circles of electrical contact pads 542 form a plurality of sectors of electrical contact pads 542 that cover one sector of front end 522*b*. In one example, there are four sectors of front end 522*b* that include electrical contact pads, with each sector being located in a different quadrant of front end 522*b*. The sectored areas of front end 522*b* are identified as sectors 568A, 568B, 568C, and 568D. Each sector includes multiple segments or electrical contact pads 542 therein. One electrical signal may have multiple segments (i.e., electrical contact pads 542) associated with it. Each ring may correspond to a particular electrical signal. As indicated above, this arrangement may be rotationally symmetric, requiring no specific rotational orientation of fuze 518 in fuze setter station 516. This configuration may require a radial arrangement of the electrical contact pins on the fuze setter station 516 as will be described below.

FIGS. 10A and 10C show that a plurality of electrical contact pins 548 are provided on fuze setter station 516 and these electrical contact pins 548 extend outwardly from front wall 516*d* of fuze setter station 516 and into port 516*b*. FIG. 100 shows that electrical contact pins 548 are arranged into two separate columns identified as columns 570A and 570B. The two columns 570A and 570B each include a plurality of aligned electrical contact pins 548. The two columns 570A, 570B are located a distance circumferentially apart from each other and are oriented at an acute angle relative to each other. In one example, the column 570A is oriented at about 45° relative to the column 570B. In one example, adjacent electrical contact pins 548 in each column 570A, 570B are separated from each other by a space 572 or by a section of the front wall 516*d*.

The configuration of electrical contact pads 542 is suitable for a nose approach of engaging fuze 518 and fuze setter station 516. When fuze 518 is received in port 516*b* such that nose 522 of radome housing 522 is located proximate front wall 516*d* of fuze setter station 516, an electrical interface will be formed between at least one column 570A, 570B of electrical contact pins 548 and at least one sector 568A, 568B, 568C, 568D of electrical contact pads 542. The electrical interface enables the transfer of power and/or data from fuze setter station 516 to fuze 518.

Figure 11:
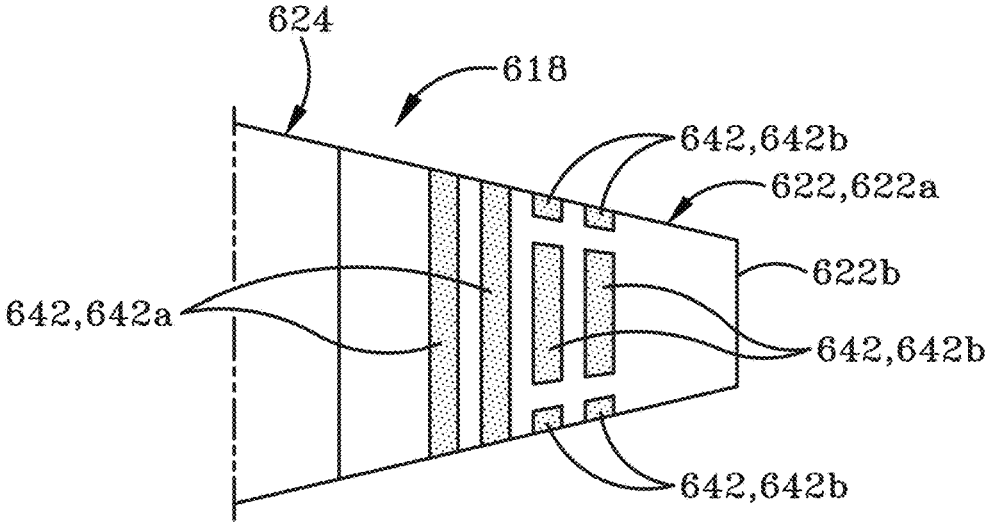
FIG. 11 shows a side elevation view of a fuze radome housing and showing a seventh embodiment of an electrical contact pad configuration on the sidewall of the radome housing.

FIG. 11 shows a seventh embodiment of an electrical contact pad configuration on a fuze 618. Fuze 618 includes a radome housing 622 and fuze body 624. A plurality of electrical contact pads 642 are provided on sidewall 622*a* of radome housing 622. In one example, the electrical contact pads 642 are configured as a combination of a plurality of circumferential rings of electrical contact pads 642*a* and segmented circumferential rings of electrical contact pads 642*b*. Two spaced-apart concentric rings of electrical contact pads 642*a* are illustrated as being located proximate fuze body 624 and two concentric and spaced-apart segmented rings of electrical contact pads 642*b* are illustrated as being located proximate front end 622*b*. The rings of electrical contact pads 642*a* are substantially identical to the circumferential rings of electrical contact pads 242 shown in FIGS. 7A and 7B and described earlier herein. The rings of electrical contact pads 642*b* are substantially identical to the segmented circumferential rings of electrical contact pads 442 shown in FIGS. 9A and 9B and described earlier herein. The pattern of electrical contact pads 642 in each ring or band is rotationally symmetric.

It will be understood that a fuze setter station or a fuze programming block will be provided for engagement with fuze 616. The selected fuze setter station or fuze programming block will be one that is configured to be complementary to the configuration of electrical contact pads 642*a*, 642*b* on fuze 618. The electrical contact pins 648 will therefore be arranged as a combination of the electrical contact pins 248 and 448 shown in FIGS. 7A, 7B, 9A, and 9B and described earlier herein.

It will further be understood that any different pattern of circumferential rings of electrical contact pads 642*a* and segmented circumferential rings of electrical contact pads 642*b* may be utilized on fuze 616 and that a complementary fuze setter station for engagement therewith will then be provided to perform a fuze setting operation.

Figure 12:
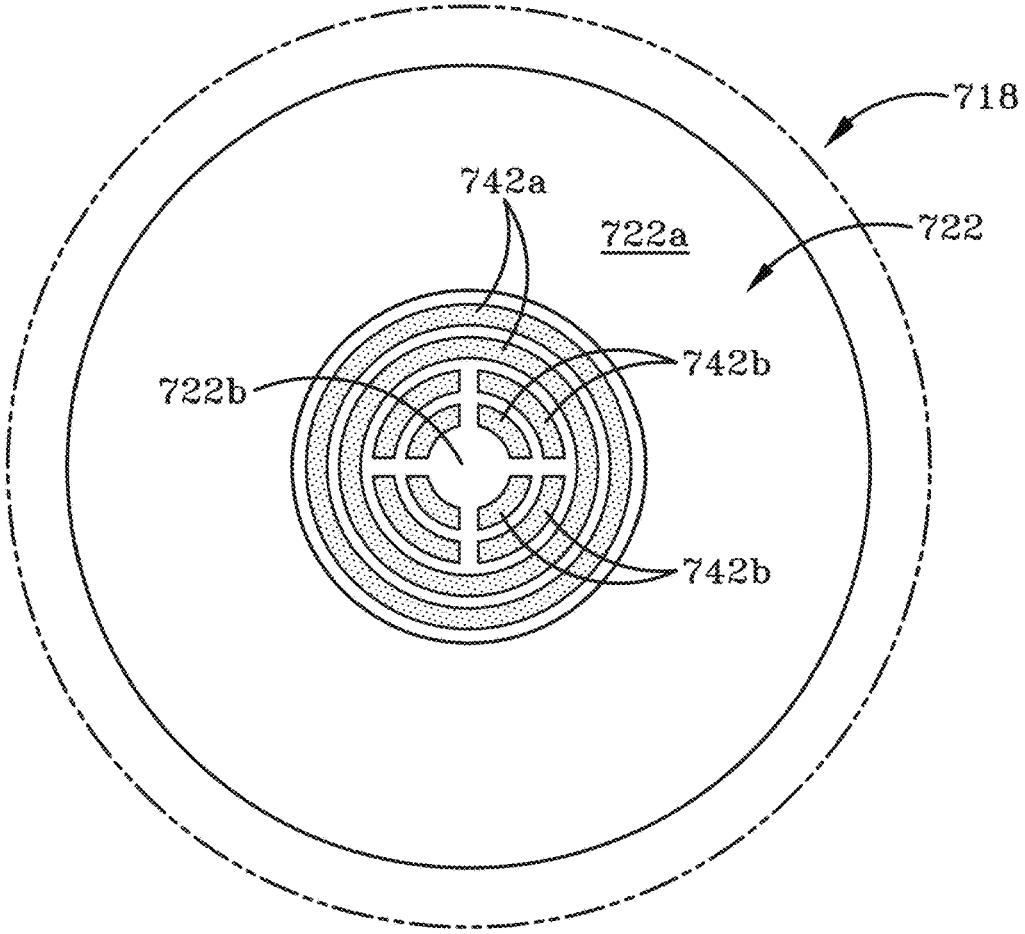
FIG. 12 shows a front end elevation view of a fuze radome housing showing an eighth embodiment of an electrical contact pad configuration on the nose of the radome housing.

FIG. 12 shows an eighth embodiment of a fuze 718 that includes a plurality of electrical contact pads 742*a*, 742*b* on front end 722*b* of radome housing 722 instead of on the sidewall 722*a* thereof as in FIG. 11. The electrical contact pads may comprise one or more concentric, circular rings of electrical contact pads 742*a* and one or more concentric, segmented, circular rings of electrical contact pads 742*b*. The pattern of electrical contact pads 742*a*, 742*b* is rotationally symmetric. The circular rings of electrical contact pads 742*a* are substantially identical in structure and function to the circular rings of electrical contact pads 342 shown in FIGS. 8A and 8B, and described earlier herein. The segmented rings of electrical contact pads 742*b* are substantially identical in structure and function to the segmented circular rings of electrical contact pads 542 shown in FIGS. 10A and 10B, and described earlier herein.

It will be understood that a complementary fuze setter station will be provided for engagement with fuze 718 to set up an eighth embodiment of an electrical interface for the transfer of power and/or data from the fuze setter station to the fuze 718. The fuze setter station may be a combination of the fuze setter stations shown in FIGS. 8A, 8C, and 10A, 10C and described earlier herein. In particular, the complementary fuze setter station will include electrical contact pins similar to electrical contact pins 348, 548 of FIGS. 8A, 8C, and 10A, 10C positioned to engage with the complementary electrical contact pads 742*a*, 742*b* to form the desired electrical interface.

It will be understood that the circular rings of electrical contact pads 742*a* and the segmented circular rings of electrical contact pads 742*b* may be arranged differently from the arrangement shown in FIG. 12. Still further, any fuze setter station that engages with the differently configured fuze will include a complementary arrangement of electrical contact pins to engage with the associated electrical contact pads.

Figure 13A:
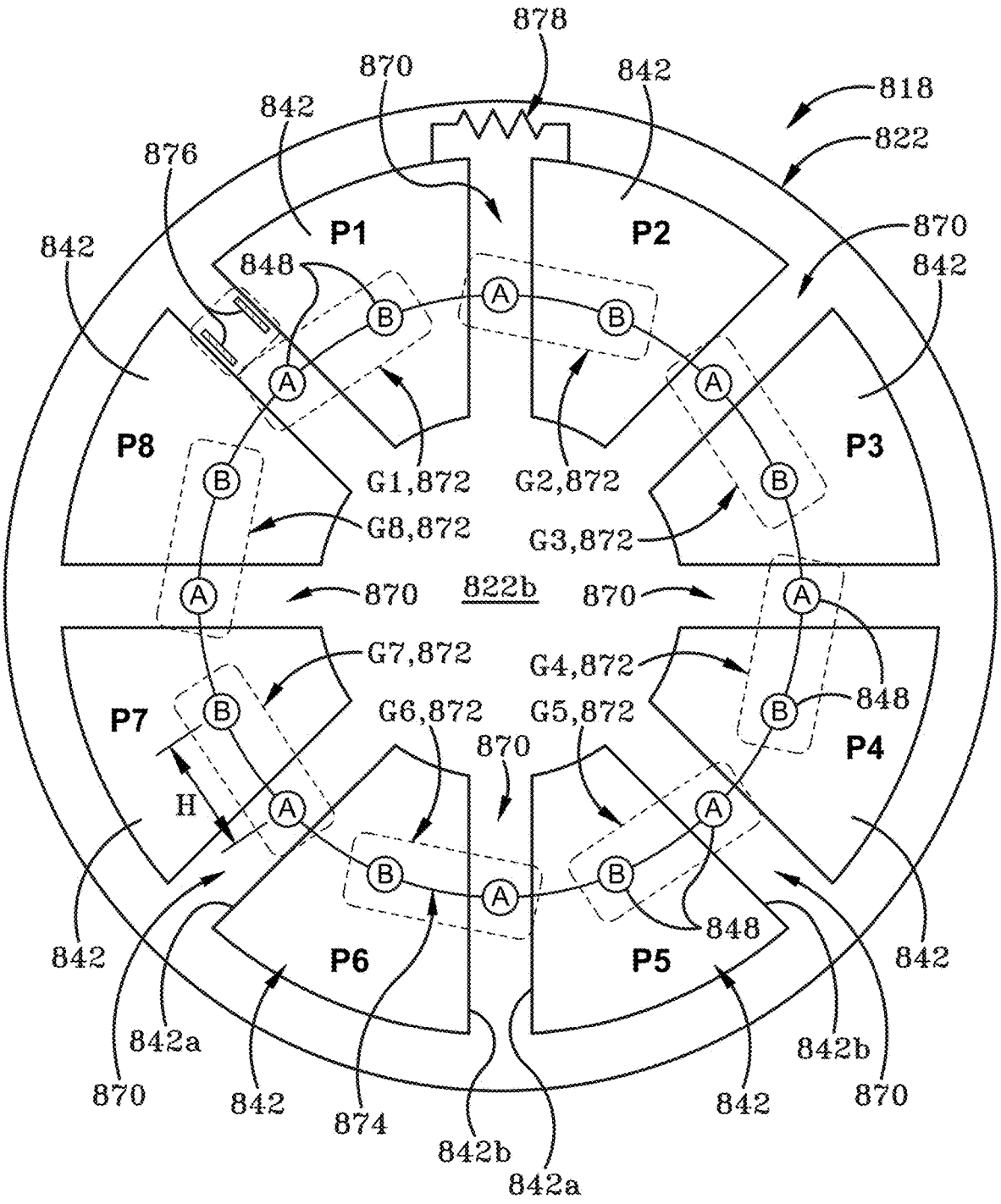
FIG. 13A is a front end elevation view of a front end or nose of a radome housing showing a ninth embodiment of an electrical contact pad configuration, showing a plurality of electrical contact pins of an associated fuze setter superimposed upon the nose; and showing no edge detect electrical continuity with an electrical contact pin "A" of the fuze setter.
Figure 13B:
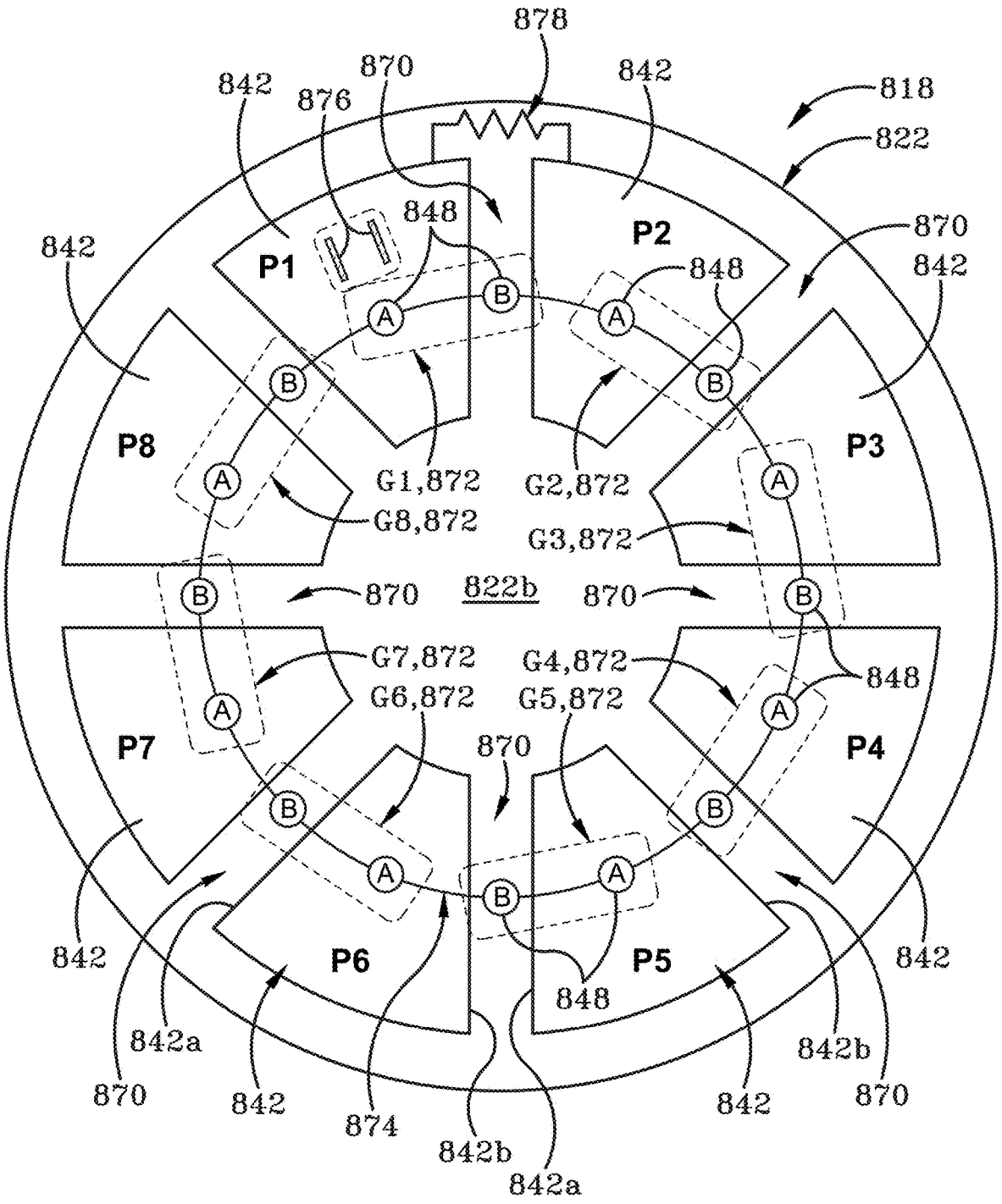
FIG. 13B is a front end elevation view of the radome housing and fuze setter of FIG. 13A showing edge detect electrical continuity with an electrical contact pin "A" of the fuze setter.

FIGS. 13A and 13B are front end elevation views of a front end 822*b* of a radome housing 822 with the electrical contact pins 848 of an associated fuze setter superimposed upon front end 822*b*. A ninth embodiment of an electrical contact pad configuration of a fuze setting system in accordance with the present disclosure is illustrated. FIG. 13A shows a situation where there is no edge detect electrical continuity with an electrical contact pin "A" of the fuze setter as this electrical contact pin does not fully contact one of the electrical contact pads on the fuze. FIG. 13B shows the same radome housing as FIG. 13A except there is edge detect electrical continuity with the electrical contact pin "A". Edge detection and its use will be further described below. The electrical contact pad/electrical contact pin arrangement illustrated in these figures forms mechanical and electrical interfaces that utilize signal commutation to rotationally orient the fuze 818. In other words, the signals are rotated instead of rotating the fuze.

FIGS. 13A and 13B show eight discrete electrical contact pads 842 provided on front end 822*b* of radome housing 822, one electrical contact pad for each signal. (It will be understood that in other examples, ten discrete electric contacts pads 842 may be provided on radome housing 822 and a complementary number of electrical contact pins 848 will then be provided on the mating fuze setter). As illustrated in FIGS. 13A and 13B, each electrical contact pad 842 is wedge-shaped when front end 822*b* is viewed from the front. The wedge shape of each electrical contact pad 842 is truncated proximate a central region of front end 822*b*. Because the electrical contact pads 842 are arranged symmetrically, no rotational orientation of fuze 818 is required for engaging fuze 818 with a fuze setter. This arrangement of discrete electrical contact pads 842 on fuze 818 is suitable for using commutation to determine the fuze orientation and is suitable for a nose approach to engaging fuze 818 and a complementary fuze setter.

To aid in the following description, each electrical contact pad 842 is provided with a number between "1" and "8". The electrical contact pads are therefore identified in the figures as "P1", "P2", "P3", "P4", "P5", "P6", "P7", and "P8". Adjacent electrical contact pads 842, such as "P4" and "P5", are separated from each other by a radially-oriented space 870. Because there are eight discrete pads 842, there are eight radially-oriented spaces 870.

Sixteen electrical contact pins 848 are provided on a fuze setter that is to be used to program fuze 818. Because of commutation, any of the electrical contact pins may be assigned to either be used as an electrical contact pin that transfers power from the fuze setter to fuze 818, or as an electrical contact pin that is used to communicate information from the fuze setter to fuze 818. Typically, the electrical contact pins 848 used to transfer power should be sized larger than those used to transfer data in order for them to handle the larger electrical currents that power transfer typically requires, as compared to communication signals. More generally, since any electrical contact pin 848 may be used for either power or communication transfer, every electrical contact pin 848 should have the characteristics necessary to perform both functions.

Since the configuration of fuze electrical contact pad 842 illustrated in FIGS. 13A and 13B is provided on front end 822*b* of fuze 818, the sixteen electrical contact pins 848 will be provided on the front wall of the fuze setter station. In FIGS. 13A and 13B, the electrical contact pins 848 are illustrated as being superimposed upon front end 822*b* but the rest of the fuze setter is not shown for clarity of illustration. The sixteen electrical contact pins 848 are arranged in eight distinct pairs or groups of two pins. Each group includes a first electrical contact pin identified by the reference character "A" and a second electrical contact pin identified by the reference character "B". The dashed boxes 872 in FIGS. 13A and 13B demarcate each separate group of electrical contact pins "A" and "B". To aid in the following description, the groups of electrical contact pins 848 are as "G1", "G2", "G3", "G4", "G5", "G6", "G7", and "G8". Electrical contact pins 848 may be engaged on an annular ring 874 (or a plate) that is selectively rotatable about a center point.

Each group of electrical contact pins "A" and "B" of the fuze setter is assigned to a signal. The electrical contact pins "A" and "B" of each group are separated angularly by a specific gap size; that size being half the pitch of the electrical contact pads 842. This gap size or spacing between the electrical contact pins "A" and "B" within each group helps to ensure that at least one electrical contact pin "A" or "B" of that group will always be fully engaged with one of the electrical contact pads 842. The gap width between the electrical contact pins "A" and "B" of each group is identified in FIG. 13A by the reference character "H" (see "G7").

A pair of spaced-apart edge detect contacts 876 are provided on the fuze setter. Edge detect contacts 876 are used to determine if a selected electrical contact pin 848 is on an edge of an associated electrical contact pad 842 and is therefore only in partial contact with that electrical contact pad 842. Edge detect contacts 876 make this determination by "bracketing" one of the electrical contact pins of a selected group. The term "bracketing" is used to indicate that the selected electrical contact pin "A" is bracketed by the edge detect contacts 876 in an angular rotation sense. The two edge detect contacts 876 are angularly located at positions on opposite sides of the angular location of the electrical contact pin "A". In contrast, in FIGS. 13A and 13B, the edge detect contacts 876 do not bracket electrical contact pin "A" in a radial direction. The edge detect contacts 876 are at a further distance from the center of the pattern than is electrical contact pin "A". Bracketing of electrical contact pin "A" means that a first edge contact 876 is on one side of the selected electrical contact pin "A" and the second edge contact 876 is on the other side of the selected electrical contact pin "A". FIGS. 13A and 13B show that electrical contact pin "A" of "G1" is bracketed by edge detect contacts 876.

In accordance with an aspect of the present disclosure, fuze 818 is provided with a loopback resistor 878. FIGS. 13A and 13B show loopback resistor 878 includes a first terminal attached to a first electrical contact pad (P1) and a second terminal attached to a second electrical contact pad (P2). Loopback resistor 878 allows the fuze setter to detect whether or not it is connected to fuze 818 and also helps to determine the rotational orientation of the fuze 818 as will be described hereafter. The location of loopback resistor 878 may be used to identify the location of the first electrical contact pad "P1" and the second electrical contact pad "P2". The electrical contact pins associated with electrical contact pads "P1" and "P2" are referred to herein as "loopback electrical contact pins" as they are in contact with the electrical contact pads with which loopback resistor 878 is engaged. The loopback electrical contact pins in FIGS. 13A and 13B are "G1" and "G2". Loopback electrical contact pins are arranged to be rotationally asymmetric as this will aid in helping to identify electrical contact pads "P1" and "P2".

Upon first contact being made between fuze 818 and the fuze setter, the electrical relationship between electrical contact pins 848 and electrical contact pads 842 is unknown, as is the orientation of fuze 818. Locating the loopback resistor 878 is made possible by utilizing a loopback resistor of a known value. The electrical impedance between successive pairs of electrical contact pads, e.g. "P1" and "P2" is measured by the fuze setter. The loopback resistor value may differ from impedance between other pairs of electrical contact pins and this feature may be utilized to identify the location of the loopback resistor 878 on a fuze whose orientation is unknown. Once the loopback resistor 878 location is identified, all other electrical contact pad locations are known.

The components illustrated in FIGS. 13A and 13B are used in the following manner. On initial contact between fuze 818 and fuze setter, the electrical relationship between electrical contact pins 848 and electrical contact pads 842 is unknown. In a first step, a determination is made as to whether or not a selected electrical contact pin 848 is on an edge of one of the electrical contact pads 842. This determination is made by bracketing a selected electrical contact pin and interrogating edge detect contacts 876 to determine whether that electrical contact pin is fully engaged with an electrical contact pad or might only be contacting an edge of the electrical contact pad. As illustrated in FIG. 13A, edge detect contacts 876 are bracketing electrical contact pin "A" of "G1" and this electrical contact pin "A" is not in contact with either of electrical contact pad "P1" or electrical contact pad "P8". While electrical contact pin "A" of "G1" is not in contact with an electrical contact pad, the electrical contact pin "B" of "G1" is in full contact with electrical contact pad "P1". Consequently, the "B" electrical contact pin of "G1", is selected for use in helping to help determine the location of loopback resistor 878 in the second step of the process.

The location of loopback resistor 878 is determined by progressively interrogating adjacent groups of electrical contact pins 848. Since electrical contact pin "A" of "G1" was found to not be in contact with an electrical contact pad, by geometry, all of the electrical contact pins "A" are not in contact with any of the electrical contact pads, based on the geometry of the configuration. This means, by the same geometry, that all of the electrical contact pins "B" are in contact with electrical contact pads. Consequently, the electrical contact pin "B" of each group will be utilizing for locating loopback resistor 878. In the second step of the process, the "B" electrical contact pins of adjacent groups are interrogated until loopback resistor 878 is found. The resistor value between the loopback electrical contact pins differs in impedance from the impedance between other sets of electrical contact pins. This difference in impedance is utilized to uniquely identify the loopback resistor 878. When the loopback resistor 878 is located, the locations of the electrical contact pads "P1" and "P2" are automatically located since it is known that the terminals of the loopback resistor 878 are on these two electrical contact pads. Once the location of loopback resistor 878 and thereby "P1" and "P2" are known, the locations of all other electrical contact pads "P3" through "P8", are immediately known.

In the next step, the signals from the fuze setter are rotated to match the orientation of the electrical contact pads "P1" to "P8". This is accomplished by performing electrical commutation to rotate electrical contact pin assignments on the fuze setter interface to match the rotational orientation of the electrical contact pads "P1" to "P8".

The process and the electrical commutation will now be explained in greater detail. In order to commute the signals, the electrical contact pin out is arranged in groups (G1 to G8) such that two adjacent electrical contact pins ("A" and "B") are associated with each one of the eight signals. Adjacent electrical contact pins "A" and "B" in each group are spaced from each other to ensure that at least one electrical contact pin of each group is in full contact with one of the electrical contact pads 842. An example of electrical contact pin/Pad/Gap spacing geometry is more fully described hereafter. With respect to the geometry, the electrical contact pad-to-gap size ratio (i.e., electrical contact pad 842 to gap between electrical contact pins "A" and "B") is nominally a 3:1 ratio of electrical contact pad width to gap width. For example, as shown in FIG. 13A, the width of electrical contact pad "P7" is measured from a first side edge 842*a* to a second side edge 842*b*. The gap width between the electrical contact pins of "G7" is identified by the distance "H". A nominal spacing between electrical contact pins "A" and "B" in any particular group may be ½ of the electrical contact pad pitch; the pitch being the angular distance between a feature on one electrical contact pad and a corresponding feature on an adjacent electrical contact pad in the configuration. The electrical contact pin diameter is less than the gap width. This electrical contact pin diameter helps to ensure break-before-make behavior. The spacing between the edge detect contacts 876 is related to the interior gap between an electrical contact pin pair, i.e., the distance "H", is greater than the electrical contact pin diameter. The external dimension is less than Contact Pitch/8.

The process of determining the orientation of the fuze involves interrogating the edge detect contact pair 876 to determine a location of an electrical contact pad edge relative to electrical contact pin "A". If electrical contact pin "A" is found to be not in full contact with an electrical contact pad 842 then electrical contact pin "B" is utilized. In another step, groups of adjacent electrical contact pins are interrogated to determine which two groups are connected by the fuze loopback resistor 878. Referring to FIG. 13A for example, electrical contact pin "B" of "G1" and electrical contact pin "B" of "G2" will be found to be connected by fuze loopback resistor 878 after interrogation. This now identifies the signal orientation between the fuze setter and fuze 818, allowing for reconfiguration via commutation. The remaining, unused electrical contact pins are then electrically removed from the circuit, either by electrically tristating or by other means to ensure they do not interfere with proper functioning of the system. For example, in referring to FIG. 14, with Pin "A" at position 6 on the graph and in full contact with "P8", electrical contact pin "B" of the same pin group is in position 10 and in full contact with the adjacent electrical contact pad "P1". This results in electrical contact pin "A" from one group and electrical contact pin "B" from another group, both attempting to drive the same electrical contact pad with different signals corresponding to their group. This would be problematic. So, in this case, all electrical contact pins "B" need to be disconnected from the circuit. This disconnection can be done by electrically tristating the unused signals, in effect placing them into a high impedance state. Alternatively, relay contacts could be used that would open up to break the signal paths corresponding to the unused electrical contact pins.

Electrical commutation is then performed to assign the correct electrical contact pins on the fuze setter station (i.e., "G3" to "G8") to the corresponding electrical contact pads 842 on the fuze 818, i.e., to "P3 to "P8). After the above process, "G1" is assigned to electrical contact pad "P1', "G2" is assigned to electrical contact pad "P2", "G3" is assigned to electrical contact pad "P3" and so on until "G8" is assigned to electrical contact pad "P8".

In order to ensure that the system will function correctly, two factors are considered, namely, the size of electrical contact pads 842 and the ability to detect the edges 842*a*, 842*b* of electrical contact pads 842. With respect to electrical contact pad size, the geometry of electrical contact pads 842 and of electrical contact pins 848 ensures that at least one electrical contact pin of an A-B pair (or group) will be in full contact with an electrical contact pad 842. When an electrical contact pin is only in partial contact with an electrical contact pad (edge contact) then the other electrical contact pin of that pair of electrical contact pins may be utilized for signal mapping.

Figure 14:
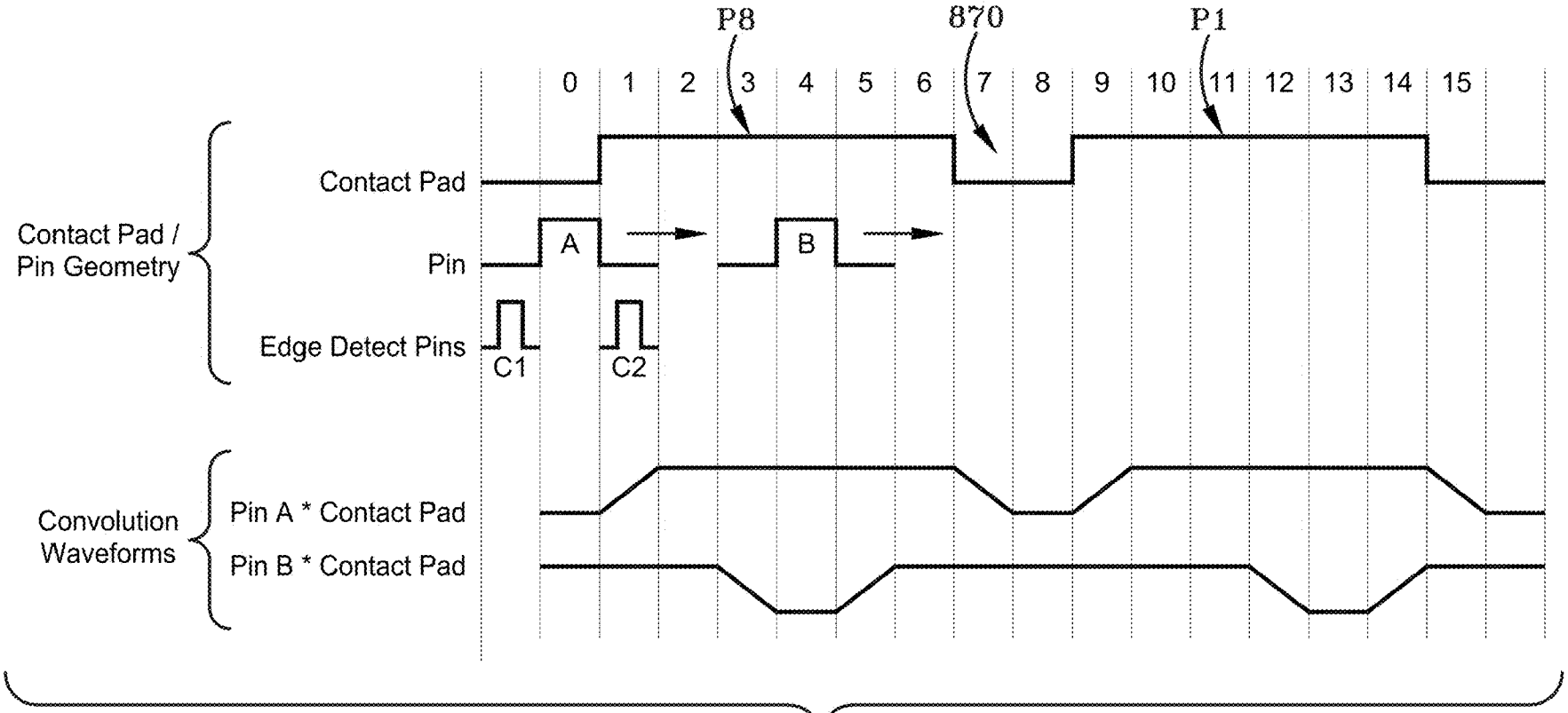
FIG. 14 is a graph representing electrical contact pad and electrical contact pin geometry as well as convolution waveforms of the ninth embodiment of the system.

FIG. 14 is a graph representing electrical contact pad/pin geometry and convolution waveforms. The line labeled as "Electrical contact pad" at the top of the graph represents a series of electrical contact pads, specifically the electrical contact pads "P8" and "P1". When the line on the graph is high, it represents the contact, and when the line is low, it represents a gap between the electrical contact pads. Thus, the top line labeled as "Electrical contact pad" shows two electrical contact pads, each 6 units in length, separated by a gap of 2 units.

Pins "A" and "B" are shown. The convolution waveforms represent the amount of contact overlap between each electrical contact pin and the electrical contact pad at different locations. For example, when electrical contact pin "A" is in Position 0, the convolution waveform is low, indicating that there is no overlap (e.g. no electrical contact) between electrical contact pin "A" and the electrical contact pad. As electrical contact pin "A" is moved to the right, the amount of overlap gradually increases until electrical contact pin "A" is in full contact with the electrical contact pad "P8" when electrical contact pin "A" is completely in position 1. That is, the leading edge of electrical contact pin "A" is at the left edge of position 2. The convolution waveform for electrical contact pin "A" shows that it has reached a maximum value at the end of position 1, meaning that the electrical contact pin "A" is in full contact with the electrical contact pad "P8". Electrical contact pin "A" begins to fall off of the first electrical contact pad "P8" when entering position 7, and it is fully out of contact with the electrical contact pad "P8" when in position 8.

Electrical contact pin "B" is offset from electrical contact pin "A", but it slides to the right along with electrical contact pin "A" because it is part of the same electrical contact pin group "G1". The amount of offset is one-half the contact pitch equivalent to 4 units in this example, but other spacings are possible. The key factor is that the spacings are such that at least one of electrical contact pin "A" or electrical contact pin "B" of this group "G1" is always in full contact with an electrical contact pad. The convolution waveform of electrical contact pin "B" shows this. It is of the same shape as the electrical contact pin "A" waveform, but it is offset by the 4 units, which constitutes the separation distance between electrical contact pin "A" and electrical contact pin "B".

The size and spacing of the electrical contact pads "P8" and "P1" and gap 870 between them, and the size and spacing of electrical contact pins "A" and "B", are adjusted such that at least one of electrical contact pin "A" or electrical contact pin "B" is always fully on an electrical contact pad. This can be seen by observing the convolution waveforms and noting that whenever one of the electrical contact pins is in either partial or no contact with an electrical contact pad, the other electrical contact pin is in full contact.

It remains then to determine if one of the electrical contact pins is only in partial contact with an electrical contact pad. One example would be examining electrical contact pin "A" when halfway between Positions 0 and 1. The edge detect contacts C1, C2 (i.e., 876 in FIG. 13*a*) are utilized for this purpose. The edge detect contacts C1, C2 bracket electrical contact pin "A" of "G1", and contacts C1, C2 may have a slightly larger gap between them than the width of electrical contact pin "A". Thus, if both edge detect contacts C1, C2 are in contact with the same electrical contact pad, it is assured that electrical contact pin "A" is also in full contact therewith Otherwise, if both edge detect contacts C1, C2 are not in contact with the same electrical contact pad, then it cannot be assured that electrical contact pin "A" is in full contact with either electrical contact pad, and thus, electrical contact pin "B" of each electrical contact pin pair group is used for signal commutation purposes.

An electrical continuity check between edge detect contacts C1-C2 can be performed by the fuze setter side of the interface to detect if both edge detect contacts C1, C2 are in contact with the same electrical contact pad on the fuze. Since the spacing between electrical contact pins "A" and "B" of the "G1" pair of electrical contact pins ensures that at least one of the two electrical contact pins is fully in contact with an electrical contact pad, it is only necessary to determine if "A" is in full contact with an electrical contact pad. If it is, then electrical contact pin "A" can be used. If the edge detect continuity test fails, then electrical contact pin "B" must be in full contact with an electrical contact pad. Consequently, it is only needed to place edge detect contacts C1, C2 on the "A" electrical contact pin.

The method of using the edge detect contacts 876 therefore can be summarized as follows. Edge detect contacts 876 are spaced-apart such that the interior gap between the contacts 876 is greater than a diameter of a signal electrical contact pin 848. Edge detect contacts 876 bracket electrical contact pin "A" of one of the electrical contact pin groups. The fuze setter performs an electrical continuity check between the two edge detect contacts 876 to establish whether both edge detect contacts 876 are contacting the same electrical contact pad. If both edge detect contacts 876 are not in contact with the same electrical contact pad, then electrical contact pin "A" is not in full contact with an electrical contact pad. FIG. 13A illustrates this scenario. Electrical contact pin "A" is not in full contact with electrical contact pad "P1" or with electrical contact pad "P8". By geometry, this means that every electrical contact pin "A" of every one of the electrical contact pin groups is not in full contact with an electrical contact pad but the associated electrical contact pin "B" of every one of the electrical contact pin groups is in full contact with one of the electrical contact pads. In this scenario, the fuze setter will utilize all electrical contact pins "B".

On the other hand, if both edge detect contacts 876 are in contact with the same electrical contact pad 842, then the bracketed electrical contact pin "A" must also be in contact with that same electrical contact pad. This means that, by geometry, all electrical contact pins "A" (i.e., every electrical contact pin "A" in each electrical contact pin group—"G1" to "G8") are in full contact with one of the electrical contact pads and every electrical contact pin "B" is not in full contact with an electrical contact pad. This situation is shown in FIG. 13B. Edge detect contacts 876 are in contact with electrical contact pad "P1" and the electrical contact pin "A" of G1" is also in contact with electrical contact pad "P1". The electrical contact pin "B" of "G1" is not in full contact with electrical contact pad "P1" but is, instead, located between electrical contact pad "P1" and electrical contact pad "P2". All electrical contact pins "A" are in full contact with an associated electrical contact pad and all electrical contact pins "B" are located between two electrical contact pads. In this instance, the fuze setter will utilize all electrical contact pins "A".

Figure 15A:
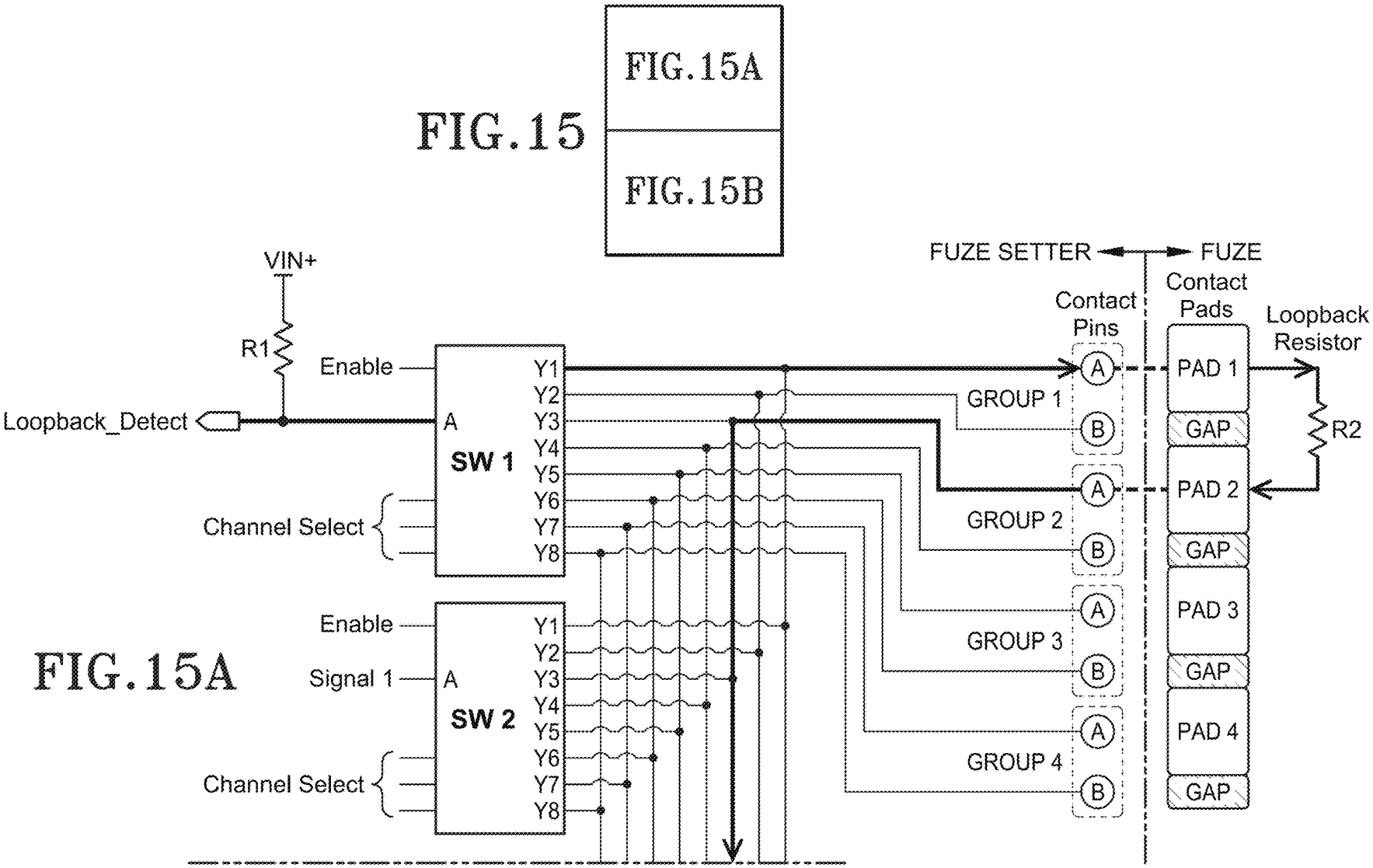
FIG. 15A shows a first portion of the process of FIG. 15.
Figure 15B:
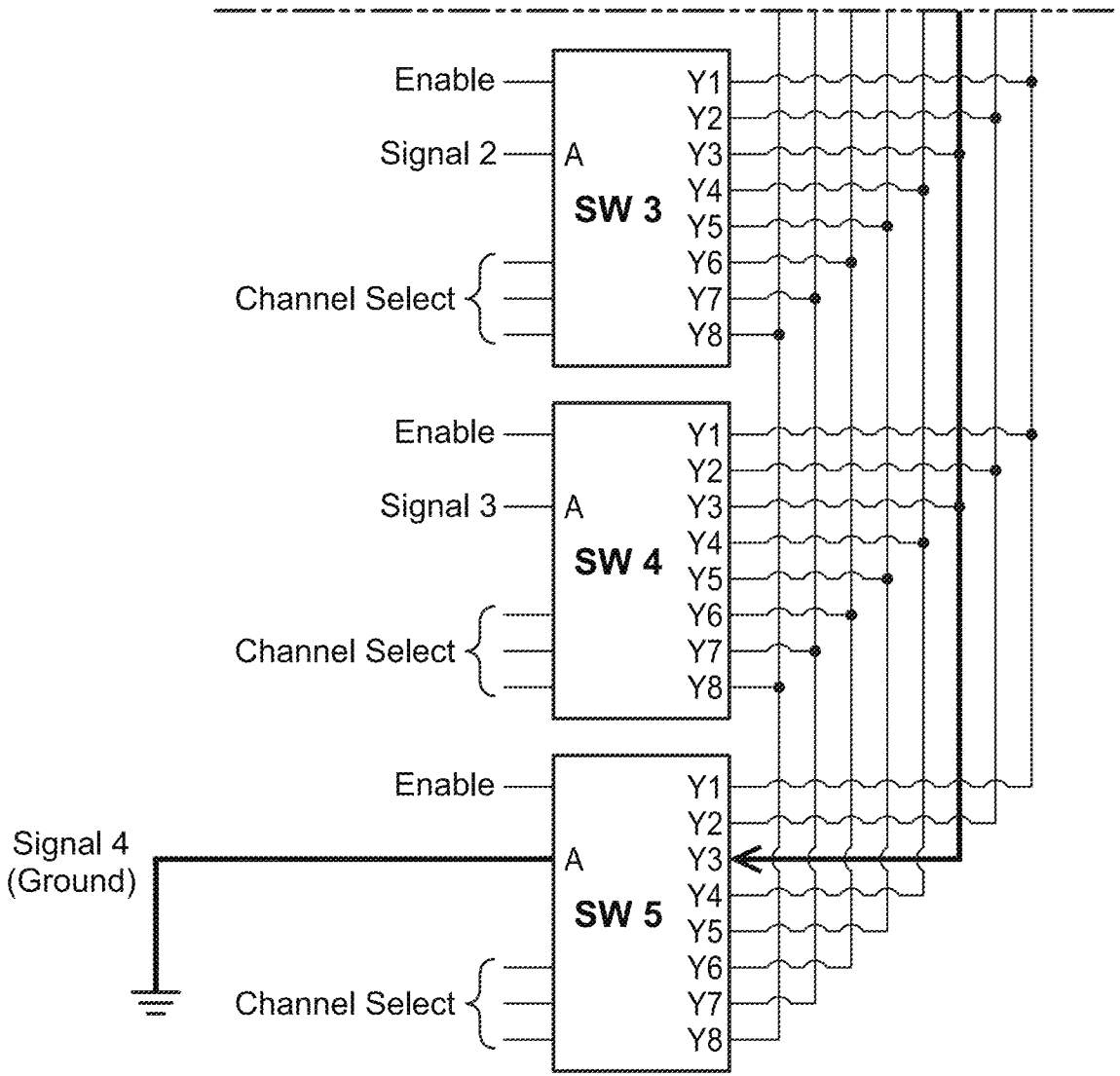
FIG. 15B shows a second portion of the process of FIG. 15.

FIG. 15, i.e., FIGS. 15A and 15B, is an example of how the loopback resistor 878 location (FIGS. 13A and 13B) is determined. The figures show, by way of example only, the electrical contact pins "A", "B" of four of the groups of electrical contact pins 848 on the fuze setter side of the interface. Only four groups of electrical contact pins are shown for clarity of illustration. The four groups of electrical contact pins 848 are labeled Group 1, Group 2, Group 3, and Group 4 in FIG. 15A. In FIG. 13A, the four groups are represented by "G1", "G2", "G3", "G4"). FIG. 15 shows the four groups of electrical contact pins 848 in electrical contact with four electrical contact pads on the fuze side of the interface. The electrical contact pads are identified as Pad 1, Pad 2, Pad, 3 and Pad 4 in FIG. 15A. These four electrical contact pads are identified as "P1", "P2", "P2" and "P4" in FIG. 13A. Adjacent electrical contact pads are separated by a gap. The gaps shown in FIG. 15 correspond to the gaps 870 between electrical contact pads in FIGS. 13A and 13B. FIGS. 15A and 15B also show, by way of example only, five analog switches "SW1", "SW2", "SW3", "SW4" and "SW5". Each of these analog switches is a multichannel, bidirectional analog switch. The Channel Select address input associated with each analog switch allows the Signal (N) associated with the particular analog switch to be connected to any of its channels. (It should be noted that (N)

is the number of signals, from Signal (1) to Signal (N)). All remaining channels are placed into a high impedance state (tristated), effectively removing them from the circuit. This allows, in this fuze setter wiring configuration, every Signal (N) to be connected to any of the "A", "B" electrical contact pins of each group of electrical contact pins, as desired. This configuration allows each Signal N to be mapped to the desired pin "A", "B" on the fuse setter interface.

A separate process, previously described herein with reference to FIG. 13A, was previously used to determine if electrical contact pin "A" or electrical contact pin "B" of each group is in full contact with an associated fuze electrical contact pad. For this example, pin "A" of each group of pins, i.e., Group 1-4, on the fuze setter side of the interface has previously been determined to be the electrical contact pin in full contact with the fuze electrical contact pads, i.e., electrical contact pads 1-4. Consequently, the following discussion is based on use of electrical contact pin "A" of each of Groups 1-4.

The Loopback_Detect signal output falls when a connection has been established between the electrical contact pin on the driving channel and the electrical contact pin on the grounding channel through R2 loopback resistor (see FIG. 15A), due to the voltage divider formed by resistors R1 and R2. The loopback resistor must be chosen to differentiate from any electrical impedance otherwise seen between interrogated contacts. Using analog switch "SW1", apply an input voltage VIN+ to each of the "A" electrical contact pins of Groups 1-4 in sequence. (It should be noted that the use of Vin+ as a DC voltage is specific to the exemplary embodiment. More generally, Vin can be any AC or DC input voltage that is used, in conjunction with an appropriate detection function, to detect a change in the Loopback_Detect signal when the loopback resistor is located.) When electrical contact pin "A" of a particular group is energized, use analog switch "SW5" to sequentially connect each of the electrical contact pins "A" of the remaining groups of electrical contact pins to ground ("SW5", Signal 4 in FIG. 15B) while monitoring the Loopback_Detect output for a change in voltage. A decrease in Loopback_Detect voltage indicates that the loopback resistor 878 spans the two selected groups. As illustrated, the loopback resistor spans Groups 1 and 2, i.e., is connected to Pad 1 and Pad 2 (FIG. 15A). If, after scanning through all of the channels associated with "SW5", no change in the Loopback_Detect signal is seen, then select the next channel on" SW1", and scan through all of the "SW5" channels again. Repeat until a decrease in Loopback voltage is found. The decrease in the Loopback_Detect signal voltage indicates that the loopback resistor 878 spans the fuze electrical contact pads in contact with the two fuze setter pin groups currently selected by "SW1" and "SW5". Once the location of the loopback resistor has been determined, the analog switches may be disabled (tristated) effectively removing them from the circuit. A separate set of analog switches may then be used to apply the remaining signals to fuze electrical contact pads based on the now known orientation of the electrical contact pads relative to the fuze setter electrical contact pins.

Detecting a decrease in Loopback_Detect voltage as described above is specific to the particular embodiment depicted in FIG. 15. It will be understood that other detection embodiments may be implemented that would result in an increase in Loopback_Detect voltage, or more generally, a change in the Loopback_Detect signal that is indicative of having detected the location of the loopback resistor. That is, in various embodiments, a circuit can be devised to detect changes in some other characteristic of the Loopback_Detect signal, such as a change in voltage, current, frequency, amplitude, or any other selected characteristic.

Figures 16, 16A:
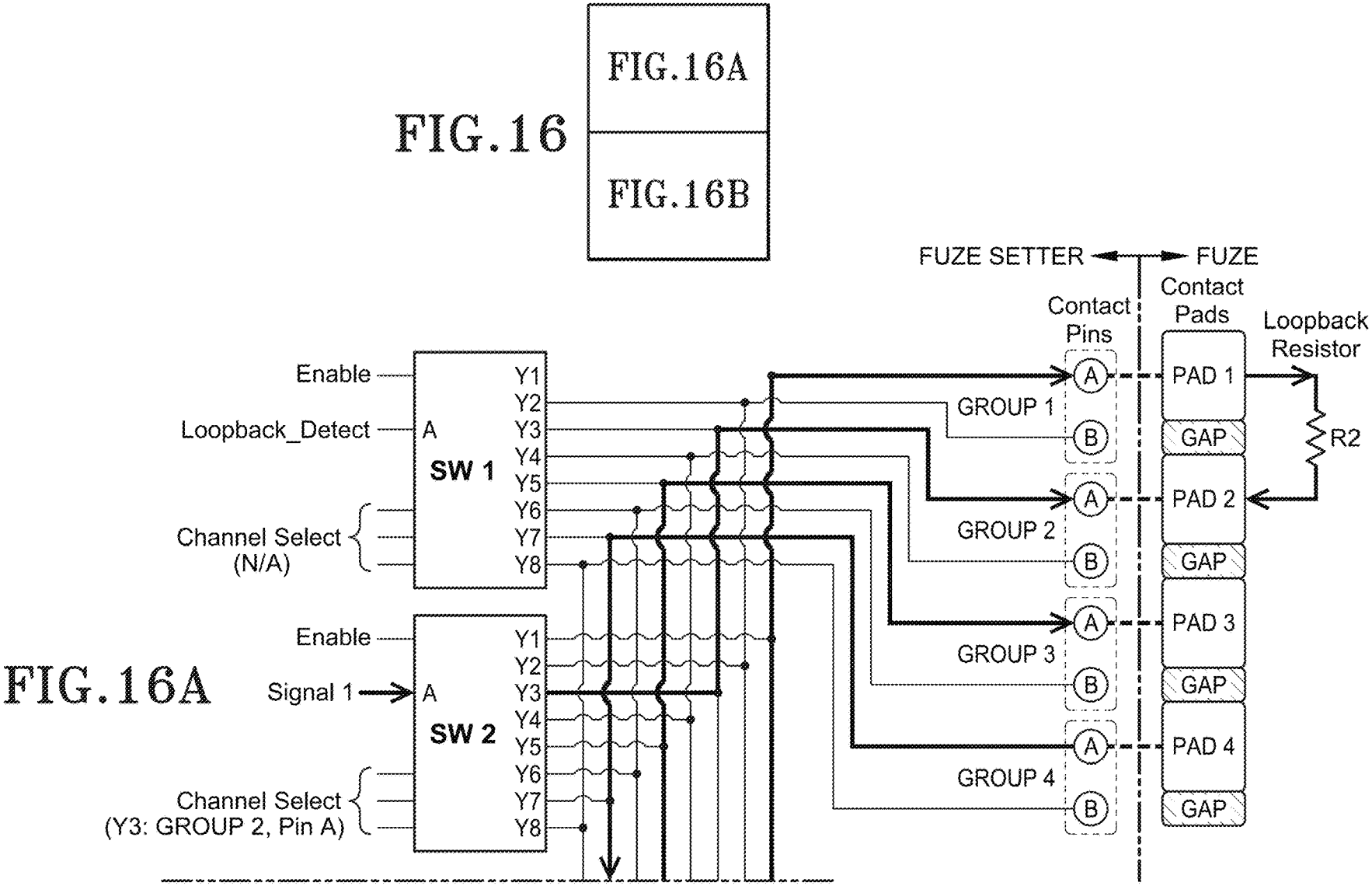
FIG. 16 is a block diagram depicting the commutation of the signals when utilizing the signal commutation approach and after the location of the loopback resistor has been determined; where the process is illustrated in greater detail in FIGS. 16A and 16B.
FIG. 16A shows a first portion of the process of FIG. 16.
Figure 16B:
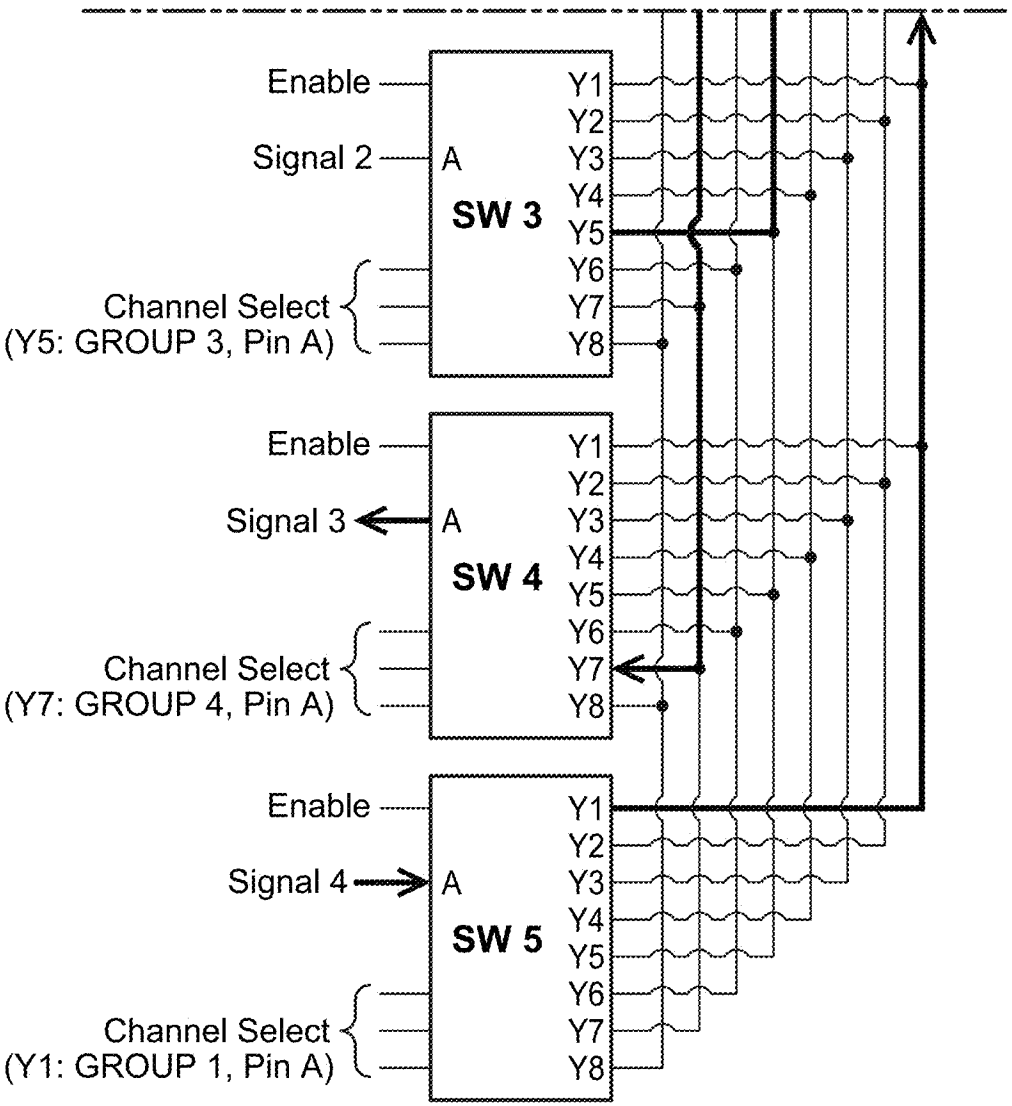
FIG. 16B shows a second portion of the process of FIG. 16

FIG. 16, i.e., FIGS. 16A and 16B provides a more detailed look into how the signal commutation works. In essence, FIG. 16 shows that each of the channels on each analog switch is connected to a corresponding electrical contact pin "A", "B" (848 from FIG. 13A) on the fuze setter side of the interface. By selecting an appropriate channel via the Channel Select address inputs associated with each analog switch, any signal can be applied to any fuze setter electrical contact pin. FIG. 16 only shows four electrical contact pads (Pad 1, Pad 2, Pad 3, Pad 4) on the fuze side of the interface. This was done only to reduce the complexity of the figure. In practice, this connection architecture is scalable up to, for example, the ten electrical contact pad configuration discussed previously herein. With ten electrical contact pads, the fuze setter would need twenty pins, i.e., ten "A" and "B" pairs or groups of electrical contact pads 848. The ten electrical contact pad configuration would also require that each analog switch, e.g. "SW1", "SW2", etc. have twenty outputs. It will be understood that, in practice, an analog switch such as "SW1" may not be a single device but may, instead, be an overall electrical circuit comprised of a multitude of components to realize an equivalent function.

FIGS. 16A and 16B show signal remapping via commutation. As with FIG. 15, FIGS. 16A and 16B show the five analog switches "SW1", "SW2", "SW3", "SW4" and "SW5" that allow, in this fuze setter wiring configuration, every Signal (N) to be connected to any of the "A", "B" electrical contact pins of each group, Group 1-4, as desired. This allows each Signal (N) to be mapped to the desired electrical contact pin on the fuse setter interface. Again, as with FIG. 15, FIGS. 16A and 16B, show the electrical contact pins of the four groups on the fuze setter side of the interface in electrical contact with the electrical contact pads on the fuze side of the interface. Adjacent electrical contact pads, Pad 1-4, are separated from each other by a gap. In this example, a separate process described earlier herein with reference to FIG. 13A was previously used to determine if electrical contact pin "A" or "B" of each group, Group 1-4, is in full contact with a fuze electrical contact pad, Pad 1-4. For this example, electrical contact pin "A" of each of Groups 1-4 on the fuze setter side of the interface has previously been determined to be the electrical contact pin in full contact with the fuze pad. Consequently, the following discussion is based on use of electrical contact pins "A" of each of Groups 1-4.

The corresponding output pin from each of the analog switches "SW1" to "SW2" (i.e., (Y1-Y8) are connected to one of the eight electrical contact pins "A", "B" of the four groups of two electrical contact pins). Thus, as illustrated, Y1 of each of the switches "SW1" to "SW5" is connected to electrical contact pin "A" of Group 1. Similarly, corresponding signal pins Y(N) from each of the analog switches "SW1" to "SW5" is connected to an individual electrical contact pin on the fuze setter interface. In this manner, every signal (Signal N) applied to "SW1" to "SW5" is applied to any of the fuze setter electrical contact pins.

The Enable pin is used to activate or disable a particular analog switch device "SW1" to "SW5". This tristates all of the Y(N) channel, thereby effectively removing the particular switch from the circuit when not needed. When the Enable signal activates a switch, the Channel Select inputs determine which of the Y(N) channels is connected to the "A" pin on the fuze setter. Thus, any signal applied to electrical contact pin "A" is able to be directed to any of the Y channels as an output. Since the analog switches "SW1"

to "SW5" are bidirectional, any signals applied to the Y(N) channels as inputs can be directed to the electrical contact pin "A" of the fuze setter as an output.

Figure 17:
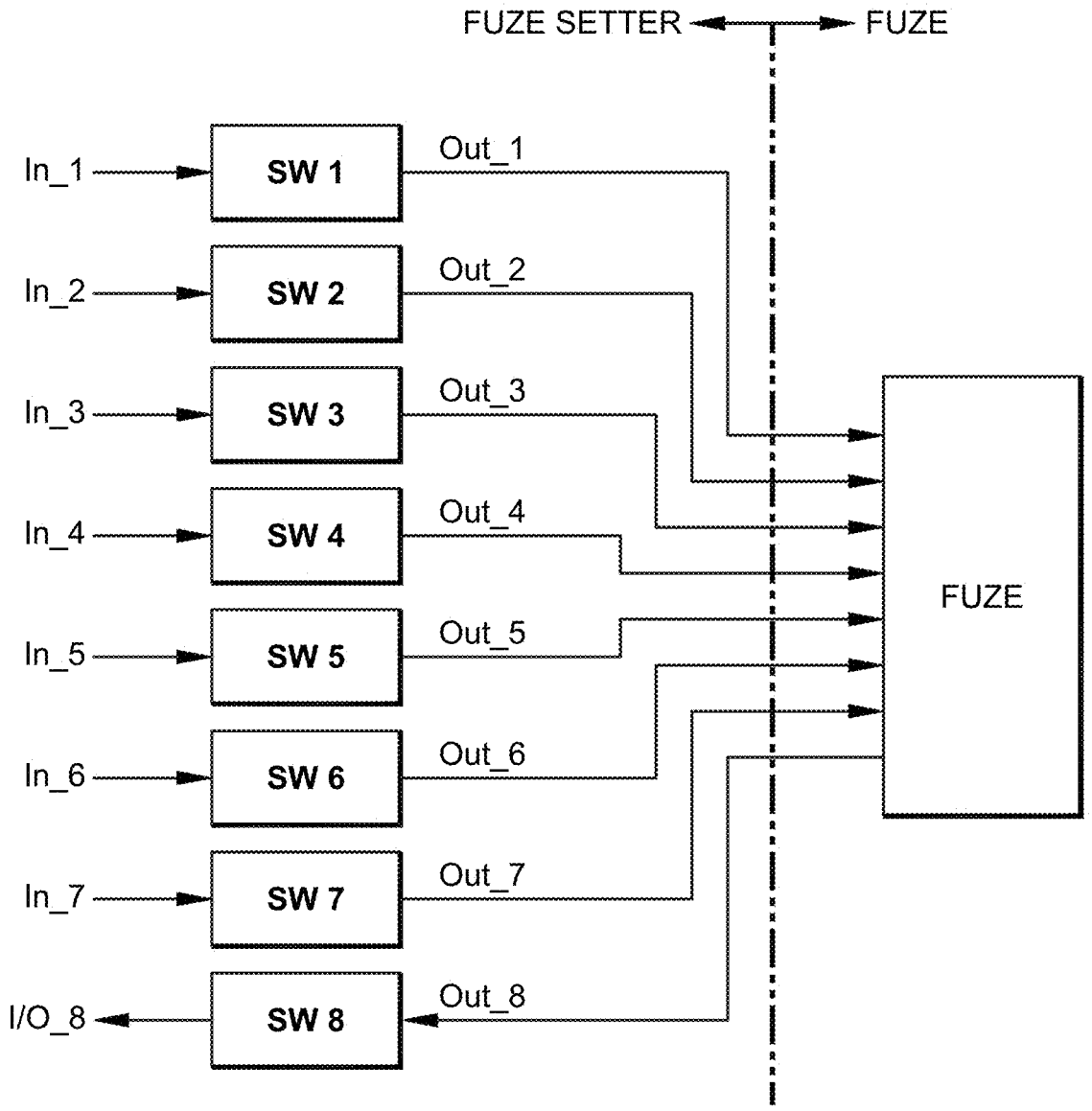
FIG. 17 shows the signal commutation approach.

FIG. 17 is an exemplary illustration of the signal commutation approach. Each of the eight fuze setter signals is associated with an analog switch (SW). The figure shows each of the analog switches "SW1", "SW2", "SW3", "SW4", "SW5", "SW6", "SW7" and "SW8", with each switch output associated with (i.e., connected to) one of the eight fuze setter contact points to the fuze. Although each analog switch contains eight outputs, only the active output is shown in the diagram. The remaining seven outputs on all analog switches are tristated, except for the selected channel, to avoid signal conflict. Once the location of the loopback resistor 878 is known, the channel assignment of each input signal to its respective analog switch output can be made. The analog switches "SW1" to "SW8" are capable of bidirectional operation, allowing data output from the fuze to be communicated back to fuze setter. The roles of input and outputs of each device are reversed in this case (see channel 8 in FIG. 17). All signal paths are designed to support input power current levels, as any of the signal paths can end up being connected to the fuze power pins based on fuze roll orientation.

Figure 18:
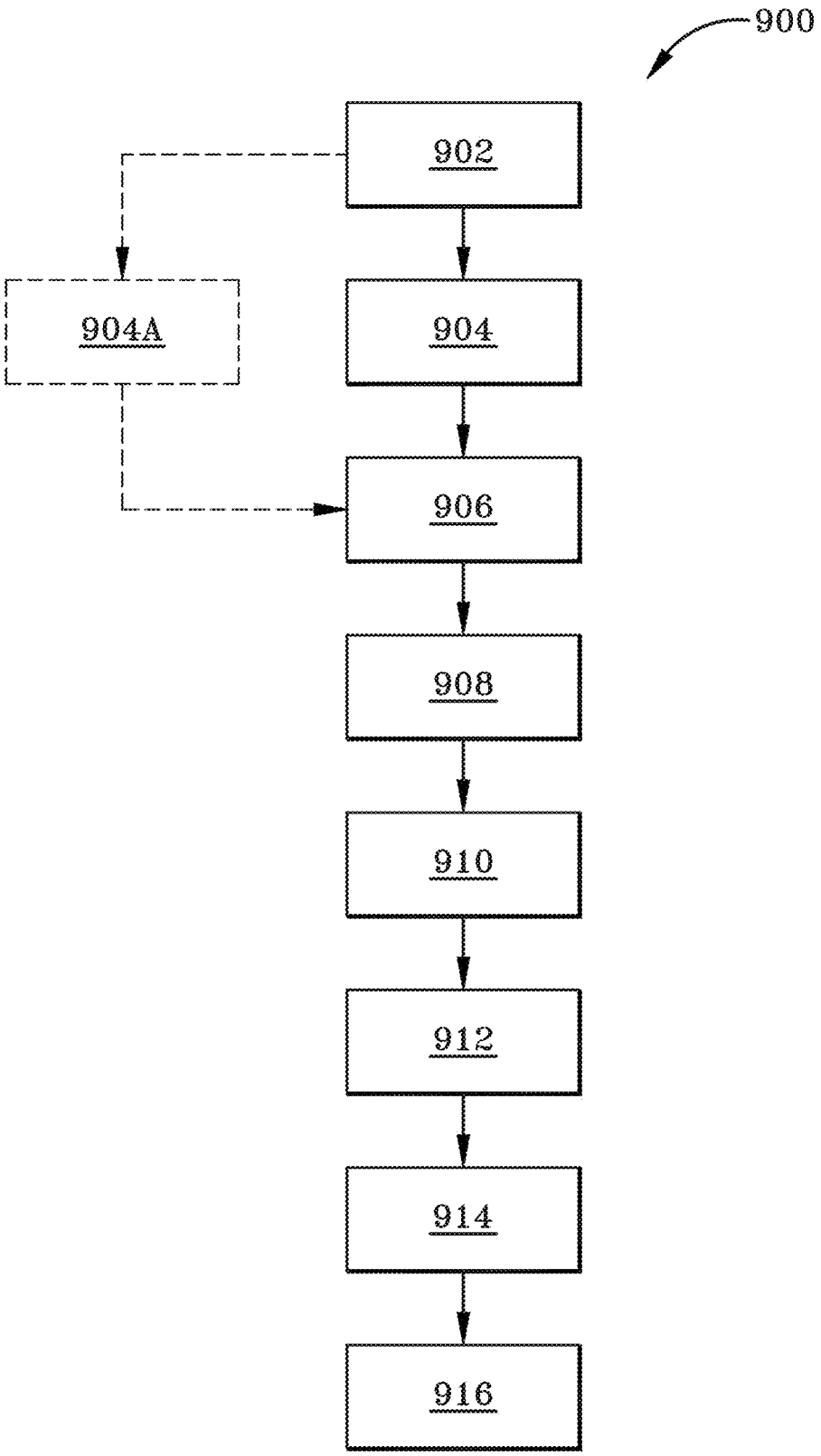
FIG. 18 is a flowchart depicting two alternative methods of using the system of FIGS. 13A and 13B utilizing the commutation approach that involves rotating the signals.

FIG. 18 is a flowchart showing a method 900 of using the fuze setting system of FIGS. 13A and 13B utilizing electrical commutation. On initial contact between fuze setter and fuze, the electrical relationship between fuze setter electrical contact pins 848 and fuze electrical contact pads 842 is unknown. In a first step 902, a determination is made as to whether or not a selected electrical contact pin is on an edge of an electrical contact pad. This is done by bracketing a selected electrical contact pin, e.g. "A" of "G1" in FIG. 13A with edge detect contacts 876 and interrogating the edge detect contacts 876. In a second step 904, based on the results of the edge detect contact interrogation, one of the electrical contact pins of a group is selected for use. If, for example, pin "A" of "G1" is found not to be in full contact with an electrical contact pad, then "B" of "G1" is selected and thereby all pins "B" are selected for use. A third step 906 involves finding the location of the loopback resistor 878. This is accomplished by interrogating different pairs of pins (using pin "B" of every two adjacent groups) until loopback resistor 878 is located. In a fourth step 908, the location of the loopback resistor 878 is used to identify the location of the loopback pins, i.e., the electrical contact pins on electrical contact pads "P1" and "P2". (Resistor value must differ from impedance between other pairs of pins to uniquely identify the loopback resistor.) In a fifth step 910, once the loopback resistor location is identified, the location of the electrical contact pads connected to the loopback resistor are identified. This information is used to identify the location of all other electrical contact pads. In other words, the electrical contact pad orientation is identified. In a sixth step 912, the signals from the fuze setter are rotated to match the electrical contact pad orientation. This step is accomplished by performing electrical commutation to rotate pin assignments on the fuze setter interface to match the fuze electrical contact pad rotational orientation. In a seventh step 914, the fuze is configured, i.e., programmed. In other words, power and/or data is transferred from the fuze setter to the fuze. In an eighth step 916, the programmed and powered guided projectile is launched toward a remote target.

In summary, the computer that is operatively engaged with the fuze setter 1 is provided with software that is capable of identifying a location of the loopback resistor 878, associates the location of the loopback resistor 878 with a location of the pair of electrical contact pads "P1", "P2", and ultimately rotates signals to the plurality of second electrical contacts 848 based on the location of the pair of electrical contact pads "P1", "P2".

In one example, when electrical commutation is performed to rotate the pin assignments on the fuze setter interface to match the electrical contact pads 842, the electrical commutation also rotates the pin assignments on the fuze setter interface to match a HoB sensor within fuze 818.

It should further be noted that because electrical contact pads 842 are located on front end 822*b* of radome housing 822, they may melt off radome housing 822 in flight and this melting removes any HoB sensor obscuration that pads 842 may have previously caused.

It will be understood that instead of providing discrete wedge-shaped electrical contact pads 842 on front end 822*b* of radome housing 822, the electrical contact pads 842 may be provided on the sidewall of radome housing 822. A complementary pattern of electrical contact pins will then be provided on a fuze setter that is to be used to program the fuze utilizing the electrical contact pads on the sidewall. The manner of programming this fuze will be the same as described above with respect to FIGS. 13A and 13B.

Referring again to FIGS. 13A and 13B, the ninth embodiment of the system may be utilized in a different way. As indicated earlier herein, in one example, all electrical contact pins 848 are assembled onto a mechanical assembly (electrical contact pin ring 876) that is able to rotate about a center point.

If after step 902 where the edge detect contacts 876 are interrogated it is found that the selected pin "A" of "G1" is not in full contact with an electrical contact pad, then instead of selecting to use electrical contact pin "B" in step 904, electrical contact pin ring 876 is rotated in a step 904A. (Step 904 is omitted.) Electrical contact pin ring 876 is rotated through one-half of the angular pitch between fuze contacts. This moves all of the fuze setter electrical contact pins 848 into full contact with their associated fuze electrical contact pads. For example, both pin "A" and pin "B" of "G1" will be in contact with "P1". The process then continues as described earlier herein with step 904 of finding the location of the loopback resistor 878.

Figure 19:
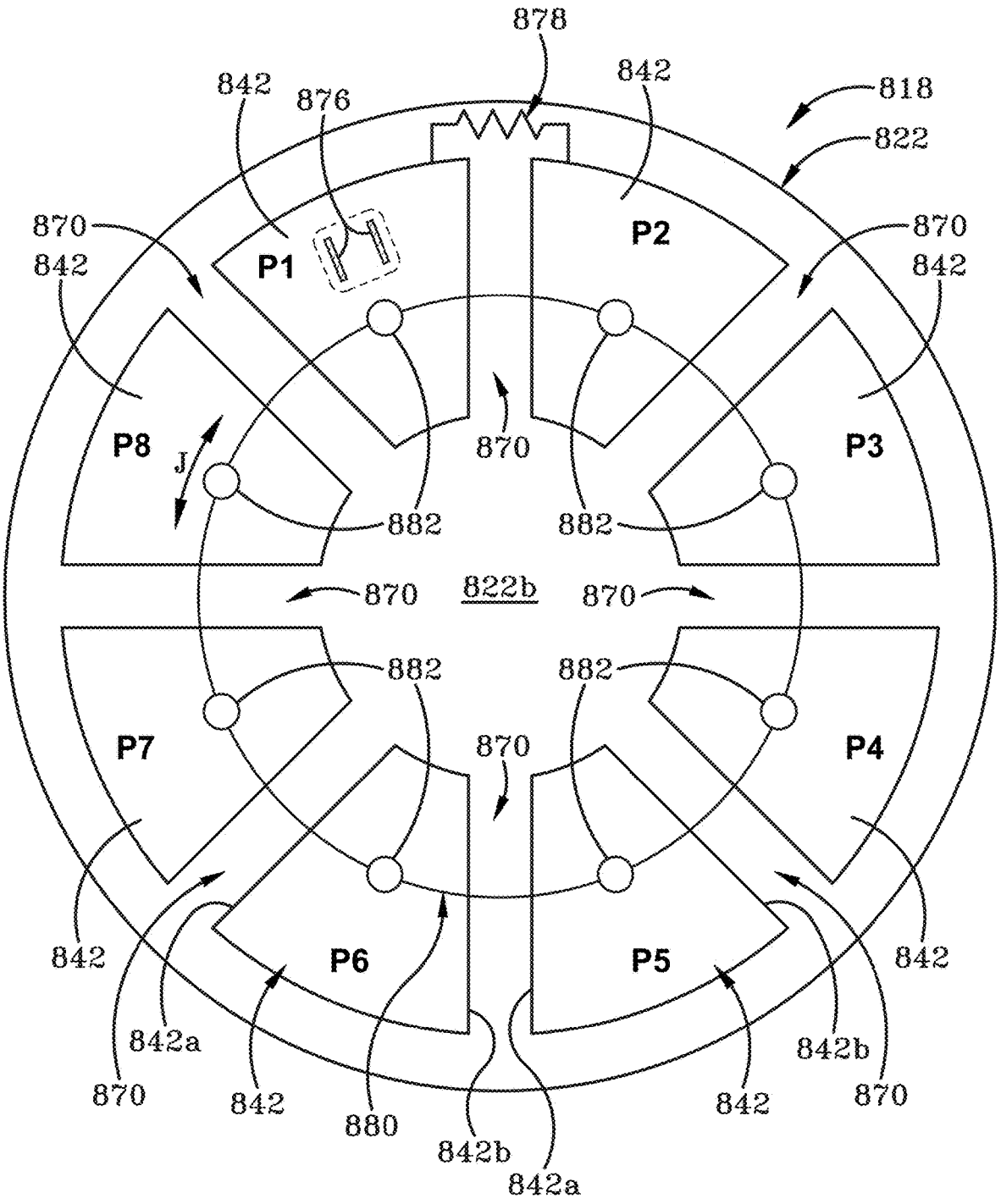
FIG. 19 is a front end elevation view of the radome housing of FIG. 13A showing an alternative configuration of a plurality of electrical contact pins of a fuze setter that are superimposed upon the electrical contact pads of the radome housing.

FIG. 19 shows the same electrical contact pad configuration as is illustrated in FIGS. 13A and 13B but the configuration of the electrical contact pins used on the fuze setter side to form an electrical interface therewith is different. The fuze setter of FIG. 19 functions in substantially the same manner as the fuze setter of FIGS. 13A and 13B, but utilizes fewer electrical contact pins to do so. The number of electrical contact pins is reduced by utilizing indexing, as will be described hereafter.

In this option, a mechanical structure 880 is provided and the edge detect contacts 876 and the electrical contact pins 882 are mounted on the mechanical structure. The mechanical structure 880 may be an electrical contact pin ring or electrical contact pin plate. The structure is illustrated as a pin ring 880 in FIG. 19 and both the ring 880 and associated electrical contact pins 882 are superimposed on the figure. Pin ring 880 may rotate one half of the angular pitch of the electrical contact pads 842 on the fuze side of the interface in either direction indication by the arrow "J". In one example, the angular pitch is equivalent to 360 degrees divided by the number of fuze electrical contact pads (360/8=45 degrees). In this alternative configuration, electrical contact pins 882 are not organized into pairs or groups as is the case with the configuration illustrated in FIG. 13A. Instead, there are only eight electrical contact pins 882 that are spaced at regular intervals from each other around ring 880. There is a one-to-one correlation between electrical contact pads 828 and electrical contact pins 882. The edge detect contacts 876 may also be engaged with ring 880.

When needed, the ring 880 may be rotated through one-half pitch thereby causing movement of all of the electrical contact pins 882 and edge detect contacts 876 by the same amount relative to the fuze electrical contact pads 842. This rotational motion guarantees that all fuze setter electrical contact pins 882 are now in full electrical contact with associated fuze electrical contact pads 842. Since this approach requires a means to perform the rotation of the fuze setter electrical contact pins 882, the approach introduces mechanical complexity into the fuze setter configuration. However, the approach simplifies the electrical interface by requiring only one fuze setter electrical contact pin 882 for each fuze electrical contact pad 842. Thus, by incorporating electrical contact pin rotational indexing, the number of channels required in an analog switch and the overall number of analog switches required may be reduced by a corresponding amount.

Figure 20:
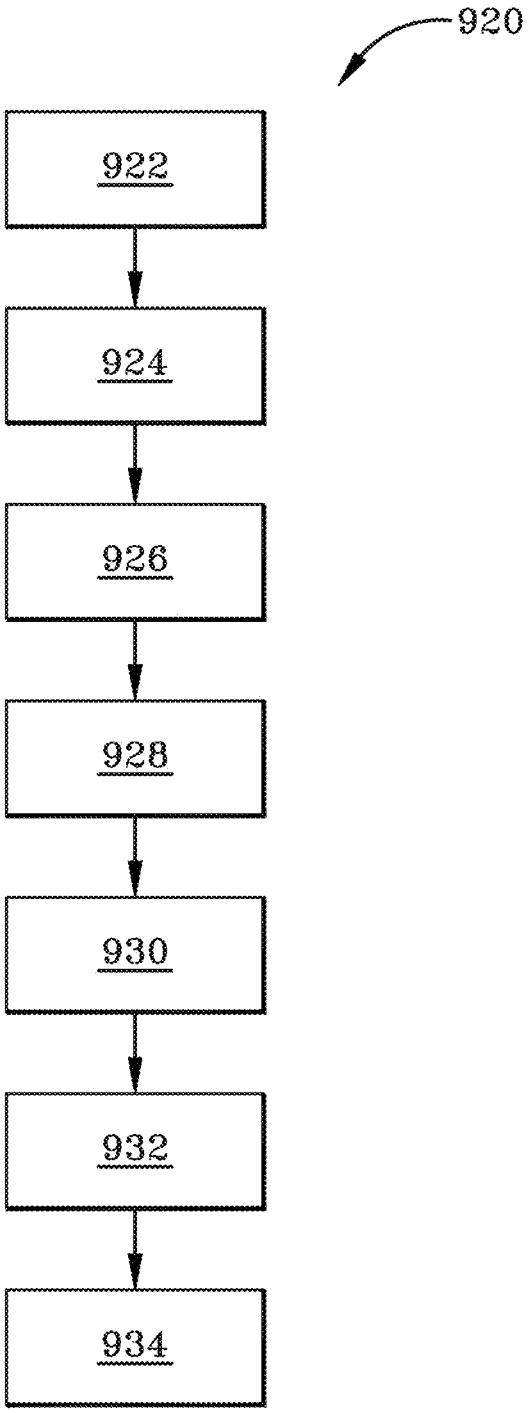
FIG. 20 is a flowchart depicting a method of using the system of FIG. 19 utilizing the commutation approach and which involves rotating an electrical contact pin ring on the fuze setter.

FIG. 20 is a flowchart depicting a method 920 of using the system of FIG. 19. Method 920 includes a first step 922 of determining whether or not a selected electrical contact pin 882 is on an edge of an electrical contact pad 828. This is done by bracketing any selected electrical contact pin with edge detect contacts 876 and interrogating the edge detect contacts 876. If the bracketed and selected pin is found not to be in full contact with an electrical contact pad 828, then, in a second step 922, power ring 880 is rotated to a position where all of the electrical contact pins 882 are positioned in contact with an associated electrical contact pad 828. A third step 924 involves finding the location of the loopback resistor 878. This is accomplished by interrogating adjacent pins 882 until loopback resistor 878 is located. In a fourth step 926, the location of the loopback resistor 878 is used to identify the location of the loopback pins, i.e., the electrical contact pins on electrical contact pads "P1" and "P2". (Resistor value must differ from impedance between other pairs of adjacent pins that are interrogated to uniquely identify the loopback resistor.) In a fifth step 928, once the loopback resistor location is identified, the location of the electrical contact pads connected to the loopback resistor are identified. This information is used to identify the location of all other electrical contact pads. In other words, the electrical contact pad orientation is identified. In a sixth step 930, the signals from the fuze setter are rotated to match the electrical contact pad orientation. This step is accomplished by performing electrical commutation to rotate pin assignments on the fuze setter interface to match the fuze electrical contact pad rotational orientation. In a seventh step 932, the fuze is configured, i.e., programmed. In other words, power and/or data is transferred from the fuze setter to the fuze. In an eighth step 934, the programmed and powered guided projectile is launched toward a remote target.

Utilizing a signal commutation approach, each of the eight fuze setter signals is associated with an analog switch. Each of the analog switches is 1:8, with each switch output associated with (connected to) one of the eight fuze setter contact points on the fuze. All outputs on all analog switches are tristated except for the selected channel, to avoid signal conflict. Once the location of the loopback resistor is known, the channel assignment of each input in its respective switch output can be made. Analog switches can be designed for bidirectional operation, allowing data output from fuze to be communicated back to fuze setter. All analog switches/signal paths need to be designed to support input power current levels, as any of them could end up being connected to fuze electrical contact pins based on fuze roll orientation.

Under this process, the fuze setter 12 utilizes a half-duplex communication protocol. Therefore, the fuze 18 only responds to messages initiated and sent by the fuze setter 12. The fuze setter 12 and the fuze 18 take turns using a single communication link, which in turn minimizes the number of electrical contacts needed to realize the link. Full duplex communication between fuze setter and fuze, allowing simultaneous, bi-directional communication may be implemented. The number of electrical contacts in the interface may need to be adjusted accordingly to accommodate full-duplex communication capability. For example, ten electrical contact pads may need to be used instead of eight electrical contact pads in order to provide full-duplex communication capability.

Figure 21:
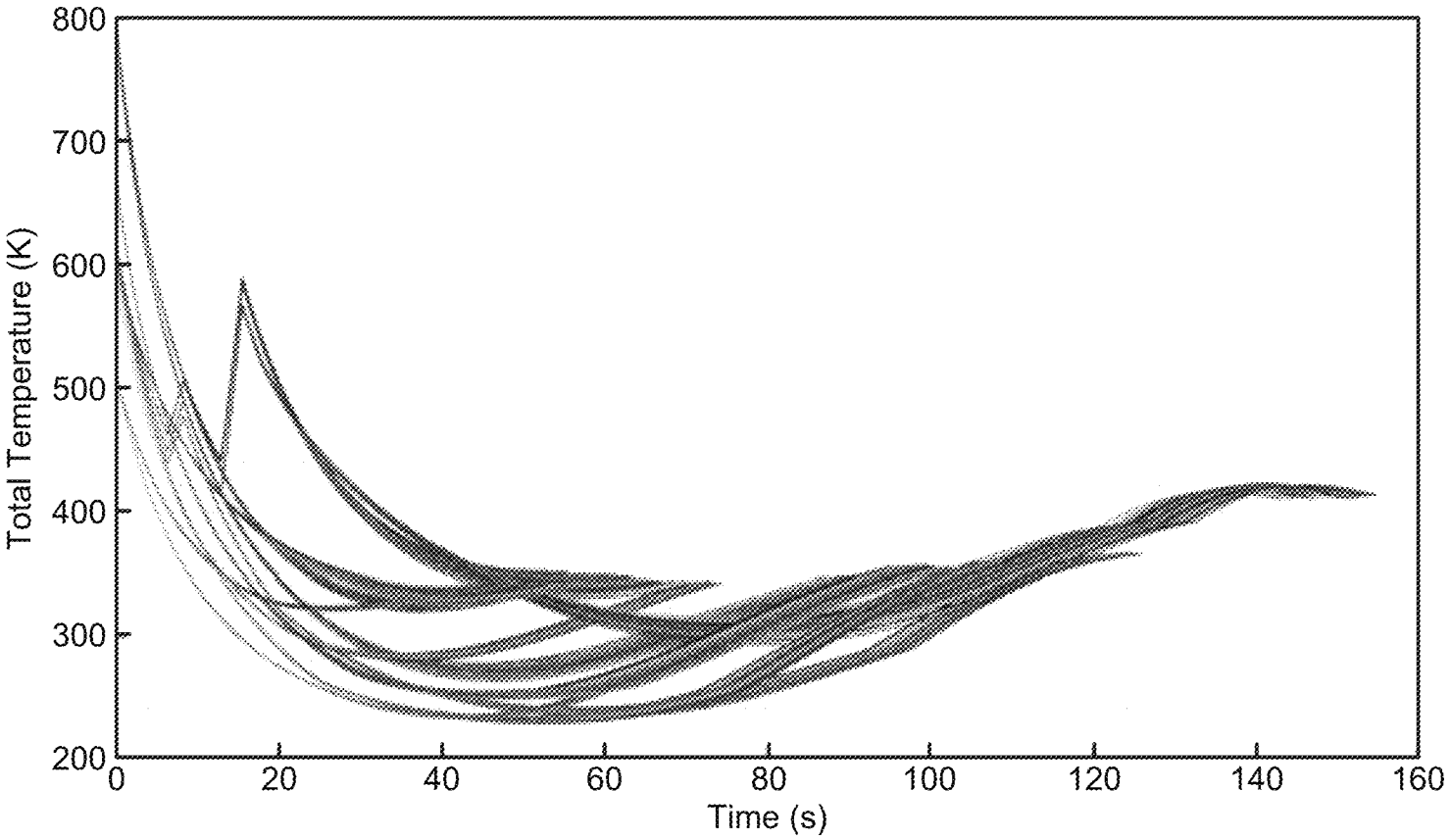
FIG. 21 is a graph representing the temperature on the radome housing nose after a projectile launch across a range of launch conditions.

FIG. 21 is a graph of a family of curves representing the temperature on the radome housing nose after the launch of a guided projectile under a variety of different conditions. Electrical contacts such as any of the electrical contact pads that are provided on the front end or nose of the radome housing may interfere with the performance of any radar transmitter that may typically be located within the radome housing. For example, the electrical contact pads may affect the performance of devices such as HoB sensors. High temperatures at launch potentially allow for the electrical contact pads on the front end of the radome housing to possibly melt off or soften an adhesive bond such that aerodynamic forces may blow the electrical contact pads off the radome housing. If the electrical contact pads melt or blow off the radome housing, this tends to remove any obscuration for any communication transceiver antenna that may be retained within the radome housing.

It should be noted that the various embodiments of electrical contact pad configurations disclosed herein as being provided on the fuze side of the programming interface (i.e. on the fuze) are compatible with a high acceleration launch environment; typically in excess of 10,000 g's; the configurations tend not to affect aerodynamic behavior of guided projectile 10. These configurations also tend not to affect or be affected by any electromagnetic signals transmitted from or received by the fuze (e.g. HoB sensor radar, telemetry, GPS) or by the ambient environment. Additionally, the electrical contact pad configurations disclosed herein are compatible with reprogramming while the fuze or the guided projectile is in a storage container.

In the nose approach of forming the mechanical and electrical interfaces between the fuze and fuze setter, the programming cup or port of the fuze setter approaches the nose of the radome housing on the fuze. This nose approach make it possible to access all electrical contact pads located around the radome housing substantially simultaneously. The nose approach is compatible with both commutation and direct electrical contact pad/electrical contact pin configurations and can be used with autoloader and manual fuze setting operations. In a manual fuze setting operation, an embodiment of the fuze setter programming cup (similar to as element 16 shown in FIG. 4A) can be manually placed by an operator over the nose of the fuze, allowing the fuze to be programmed. The manual operation may be utilized rather than relying on an autoloader mechanism to place the cup 16 as is shown in FIG. 5*a*. In a manual or autoloader operation, the fuze setter will typically have a display that informs the operator when the fuze setting is complete and whether or not it was successful. In an autoloader setup, the projectiles are located in a magazine and sequentially programmed and moved into firing position without the need for operator intervention.

In the side approach of forming the mechanical and electrical interfaces between the fuze and fuze setter, the programming interface (e.g. programming block) comes toward the radome housing from one side. The side approach is therefore limited to working with direct electrical contact pin configurations on one side of the radome housing. In some instances the side approach may not work well for manual fuze setting as it is somewhat more complex to mechanically align and secure the programming block to the radome housing during programming.

In the clamshell approach of forming the mechanical and electrical interfaces between the fuze and fuze setter, the fuze setter components may approach the fuze from two sides or from multiple opposed directions. The clamshell approach has similar benefits to the nose approach and makes it possible to access all contacts around the radome housing substantially simultaneously. The clamshell approach may be compatible with both commutation and direct electrical contact pad configurations on the sidewall of the radome housing but may not be compatible with electrical contact pad configurations on the front end of the radome housing. The clamshell approach tends to be compatible with both autoloader and manual fuze setting operations.

With respect to any of the embodiments of fuze and fuze setter disclosed herein each electrical contact pad on the fuze may be assigned to a specific signal. Each electrical contact pad may engage a corresponding electrical contact pin dedicated to a specific signal. Each electrical contact pad may have a separate electrical connection to the internal electronics of the artillery projectile.

It will be understood that any of the arrangements of electrical contact pads disclosed herein may be combined with each other configuration of electrical contact pad on a fuze. Furthermore, the electrical contact pads may be differently shaped and sized from what is disclosed herein. Still further, some electrical contact pads may be provided on the sidewall of the radome housing or fuze body and other electrical contact pads may additionally be provided on the nose of the radome housing. Whatever arrangement of electrical contact pads is utilized, a complementary arrangement of electrical contact pins will be utilized in a fuze setter station or on a programming block to ensure that there is the formation of an electrical interface. The arrangement of the electrical contact pads and of the electrical contact pins preferably is such that there is little to no need to rotate the fuze to obtain alignment of the electrical contact pads and electrical contact pins to form the desired electrical interface.

It will further be understood that any configuration of electrical contact pad and electrical contacts (such as electrical contact pins) may be utilized on a fuze and fuze setter that enable direct electrical contact, electrical commutation or signal commutation for programming of the fuze.

It will further be understood that any of the embodiments of the fuze configuration disclosed herein may include ten electrical contact pads instead of eight electrical contact pads. In other examples fewer than eight electrical contact pads or more than eight electrical contact pads may be utilized. In other examples more than ten electrical contact pads may be utilized. In each example, the number of electrical contact pads will be arranged to be rotationally symmetrical. The fuze setter that is configured to mate with a fuze having other than eight electrical contact pads will be configured to include a number of electrical contact pins that is sufficient to enable communication between the fuze and fuze setter.

It will further be understood that in any of the embodiments disclosed herein, the electrical contact pins may be located on the fuze and the electrical contact pads may be located on the fuze setter.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

It will be understood that in other examples, electrical contact pads may be provided on fuze body instead of on radome housing. In other examples, electrical contact pads may be partially provided on radome housing and partially on fuze body.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch electrical contact pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the FIGS. is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately"

may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A system, comprising:

a fuze adapted to be engaged with a projectile body;

a fuze setter configured to engage with the fuze;

a plurality of first electrical contacts provided on an exterior surface of the fuze;

a plurality of second electrical contacts provided on the fuze setter, and when the fuze and fuze setter are engaged, the plurality of first electrical contacts and the plurality of second electrical contacts form an electric interface adapted to transfer one or both of power and data from the fuze setter to the fuze; and two spaced-apart edge detect contacts positioned to selectively bracket a selected one of the plurality of second electrical contacts;

wherein each of the plurality of first electrical contacts comprises an electrical contact pad that is applied to the exterior surface of the fuze.

2. The system according to claim 1, wherein the plurality of first electrical contacts are arranged in a pattern and the plurality of second contacts are arranged in complementary pattern.

3. The system according to claim 1, wherein the plurality of first electrical contacts are arranged in a rotationally symmetric pattern.

4. The system according to claim 1, wherein the plurality of first electrical contacts are provided on a radome housing at a leading end of the fuze.

5. The system according to claim 4, wherein the plurality of first electrical contacts are provided on a sidewall of the radome housing.

6. The system according to claim 4, wherein the plurality of first electrical contacts are provided on a front end of the radome housing.

7. The system according to claim 1, wherein the plurality of first electrical contacts are connected by feedthroughs to an electronic system of the fuze.

8. The system according to claim 1, further comprising a loopback resistor integrated with a pair of electrical contact pads.

9. The system according to claim 1, wherein the plurality of second electrical contacts is a plurality of electrical contact pins.

10. The system according to claim 9, wherein a plurality of powers pins are arranged into discrete pairs of electrical contact pins, and each pair of electrical contact pins is positioned to be selectively engageable with one electrical contact pad on the fuze.

11. The system according to claim 9, wherein the plurality of electrical contact pins are mounted on a rotatable ring.

12. The system according to claim 8, further comprising a computer operatively engaged with the fuze setter, said computer being provided with software that identifies a location of the loopback resistor, associates the location of the loopback resistor with a location of the pair of electrical contact pads, and rotates signals to the plurality of second electrical contacts based on the location of the pair of electrical contact pads.

13. A system, comprising:

a projectile including a fuze having a radome housing at a leading end;

a fuze setter configured to engage the radome housing;

a plurality of electrical contact pads on the radome housing, wherein the plurality of electrical contact pads are in electrical communication with a system of electronics internal to the fuze;

a plurality of electrical contact pins provided on the fuze setter, wherein the plurality of electrical contact pins are positioned to engage the plurality of electrical contact pads when the fuze setter engages the radome housing; and a loopback resistor integrated with a pair electrical contact pads from the plurality of electrical contact pads.

14. The system according to claim 13, wherein the plurality of electrical contact pads is arranged in a rotationally symmetric pattern.

15. The system according to claim 13, wherein the plurality of electrical contact pins forms an electrical interface with the plurality of electrical contact pads regardless of a rotational orientation of the fuze.

16. A method of transferring one or both of power and data from a fuze setter to a fuze, comprising:

bracketing a selected electrical contact pin of a plurality of electrical contact pins on a fuze setter with a pair of edge detect contacts;

interrogating the pair of edge detect contacts;

determining whether the selected electrical contact pin is in contact with an edge of an electrical contact pad of a plurality of electrical contact pads provided on a fuze;

interrogating adjacent electrical contact pins of the plurality of electrical contact pins;

locating a loopback resistor connected to two electrical contact pads of the plurality of electrical contact pads;

determining a location of each of the plurality of electrical contact pads based on the location of the loopback resistor;

performing electrical commutation to rotate electrical contact pin assignments on the fuze setter to match the locations of the plurality of electrical contact pads on the fuze; and assigning a signal to each of the plurality of electrical contact pins.

17. The method according to claim 16, further comprising:

rotating the plurality of electrical contact pins through a half pitch of one of the plurality of electrical contact pads after the interrogating of the edge detect contacts.

18. The method according to claim 16, further comprising:

programming the fuze after the assigning of the signal to each of the plurality of electrical contact pins.

19. The system according to claim 13, further comprising a computer operatively engaged with the fuze setter, said computer being provided with software that identifies a location of the loopback resistor, associates the location of the loopback resistor with a location of the pair of electrical contact pads, and rotates signals to the electrical contact pins based on the location of the pair of electrical contact pads.

20. The system according to claim 13, further comprising two spaced-apart edge detect contacts positioned to selectively bracket a selected one of the plurality of electrical contacts.

* * * * *